US010280661B2

(12) United States Patent
Spurr et al.

(10) Patent No.: US 10,280,661 B2
(45) Date of Patent: May 7, 2019

(54) LATCH ASSEMBLY

(71) Applicant: INTEVA PRODUCTS, LLC, Troy, MI (US)

(72) Inventors: Nigel V. Spurr, Solihull (GB); Gurbinder Singh Kalsi, West Midlands (GB); Chris Rhodes, Orleans (FR); Robert Frank Tolley, Straffordshire (GB); David Peatey, Solihull (GB); Robert James Clawley, Straffordshire (GB); Paul Moore, Kings Norton (GB); Jean-Vincent Olivier, Villegusien (FR); Sylvain Remi Chonavel, Thury Harcourt (FR); Denis Cavallucci, Otterswiller (FR)

(73) Assignee: INTEVA PRODUCTS, LLC, Troy, MI (US)

( * ) Notice: Subject to any disclaimer, the term of this patent is extended or adjusted under 35 U.S.C. 154(b) by 412 days.

(21) Appl. No.: 14/531,790

(22) Filed: Nov. 3, 2014

(65) Prior Publication Data

US 2015/0211266 A1 Jul. 30, 2015

Related U.S. Application Data

(63) Continuation of application No. 11/816,445, filed as application No. PCT/GB2006/000586 on Feb. 17, 2006, now Pat. No. 8,876,176.

(30) Foreign Application Priority Data

Feb. 18, 2005 (GB) ..... 0503386.5
Dec. 29, 2005 (GB) ..... 0526546.7

(51) Int. Cl.
*E05C 3/00* (2006.01)
*E05C 3/12* (2006.01)
(Continued)

(52) U.S. Cl.
CPC ..... *E05C 3/12* (2013.01); *E05B 81/14* (2013.01); *E05B 81/20* (2013.01); *E05C 3/006* (2013.01);
(Continued)

(58) Field of Classification Search
CPC . E05C 3/12; E05C 3/006; E05B 81/14; E05B 81/20; Y10T 292/1047; Y10T 292/1082
(Continued)

(56) References Cited

U.S. PATENT DOCUMENTS 709,607 A 9/1902 Podlesak
1,833,572 A * 11/1931 Hardesty ..... E05B 77/48 180/289
(Continued)

FOREIGN PATENT DOCUMENTS

DE 3414475 12/1985
DE 9012785 1/1991
(Continued)

OTHER PUBLICATIONS

International Search Report dated Apr. 6, 2005.
English Translation of EP0978609.

*Primary Examiner* — Kristina R Fulton
*Assistant Examiner* — Faria F Ahmad
(74) *Attorney, Agent, or Firm* — Cantor Colburn LLP

(57) ABSTRACT

A latch assembly includes a chassis, a latch bolt moveably mounted on the chassis and having a closed position for retaining a striker and an open position for releasing the striker, a pawl having an engaged position at which the pawl is engaged with the latch bolt to hold the latch bolt in the closed position and a disengaged position at which the pawl is disengaged from the latch bolt, thereby allowing the latch bolt to move to the open position, an eccentric arrangement defining an eccentric axis and a pawl axis remote from the
(Continued)

CLOSED eccentric axis. The eccentric arrangement is rotatable about the eccentric axis, and the pawl is rotatable about the pawl axis. When the pawl moves from the engaged position to the disengaged position, the eccentric arrangement rotates in one of a clockwise and a counter-clockwise direction about the eccentric axis. With the pawl in the engaged position, a force applied to the pawl by the latch bolt creates a turning moment on the eccentric arrangement in the one of the clockwise and counter-clockwise direction, and the eccentric arrangement is prevented from rotating in said one of the clockwise and counter-clockwise direction by a moveable abutment.

20 Claims, 41 Drawing Sheets

(51) Int. Cl.

| | |
|---|---|
| ***E05B 77/28*** | (2014.01) |
| ***E05B 81/14*** | (2014.01) |
| ***E05B 81/20*** | (2014.01) |
| ***E05B 85/26*** | (2014.01) |
| ***E05C 3/06*** | (2006.01) |
| ***E05C 3/16*** | (2006.01) |

(52) U.S. Cl.
CPC ..... *E05B 77/28* (2013.01); *E05B 85/26* (2013.01); *Y10S 292/23* (2013.01); *Y10T 70/5903* (2015.04); *Y10T 70/70* (2015.04); *Y10T 292/1047* (2015.04); *Y10T 292/1082* (2015.04)

(58) Field of Classification Search
USPC ... 292/201, 216, 219, DIG. 23, 57, 195, 198
See application file for complete search history.

(56) References Cited

U.S. PATENT DOCUMENTS 2,174,078 A 9/1939 Burgin
2,881,021 A 4/1959 Jacobson
3,386,761 A * 6/1968 Johnstone ..... E05B 77/48 292/201
4,518,180 A * 5/1985 Kleefeldt ..... E05B 81/06 292/201
4,624,491 A * 11/1986 Vincent ..... E05B 81/06 185/40 R
4,756,563 A 7/1988 Garwood et al.
4,783,102 A 11/1988 Bernard
4,814,557 A * 3/1989 Kato ..... E05B 81/66 200/61.64
4,824,152 A 4/1989 Jeavons
4,838,588 A 6/1989 Hayakawa et al.
4,842,313 A * 6/1989 Boyko ..... E05B 81/22 292/198
4,978,153 A * 12/1990 Hirsch ..... B04B 7/06 292/201
4,984,385 A * 1/1991 DeLand ..... B60J 5/06 292/341.16
4,988,135 A * 1/1991 Ottino ..... E05B 81/20 292/201
5,092,639 A 3/1992 Di Giusto
5,127,686 A 7/1992 Gleason et al.
5,188,406 A * 2/1993 Sterzenbach ..... E05B 85/26 292/210
5,273,325 A * 12/1993 Zimmermann ..... E05B 81/22 292/216
5,288,115 A * 2/1994 Inoue ..... E05B 81/20 292/201
5,309,745 A 5/1994 Ursel et al.
5,603,539 A * 2/1997 Gruhn ..... E05B 85/243 292/199
6,007,117 A * 12/1999 Spindler ..... E05B 17/042 292/199
6,053,543 A * 4/2000 Arabia, Jr. ..... E05B 81/06 292/201
6,059,327 A 5/2000 Yoshikuwa
6,367,296 B1 * 4/2002 Dupont ..... E05B 81/16 292/201
6,428,058 B1 * 8/2002 Graute ..... E05B 85/01 292/201
6,457,753 B1 10/2002 Wegge
6,497,436 B1 12/2002 DeBlock et al.
6,540,270 B1 * 4/2003 Reddmann ..... E05B 81/22 292/201
6,540,272 B2 4/2003 Spurr
6,557,910 B2 * 5/2003 Amano ..... E05B 81/14 292/201
6,575,003 B1 * 6/2003 Dupont ..... E05B 81/14 292/201
6,575,507 B2 * 6/2003 Reddmann ..... E05B 81/14 292/201
6,601,883 B1 8/2003 Kalsi
6,652,009 B2 * 11/2003 Fisher ..... E05B 77/26 292/216
6,659,515 B2 * 12/2003 Raymond ..... E05B 81/20 292/201
6,705,140 B1 * 3/2004 Dimig ..... E05B 81/06 292/201
6,705,649 B1 * 3/2004 Reddmann ..... E05B 81/06 292/201
6,786,070 B1 * 9/2004 Dimig ..... E05B 77/30 292/201
7,000,956 B2 * 2/2006 Fisher ..... E05B 81/14 292/198
7,413,225 B2 * 8/2008 Spurr ..... E05B 17/007 292/201
7,434,852 B2 * 10/2008 Spurr ..... E05B 85/26 292/201
7,946,634 B2 * 5/2011 Bendel ..... E05B 81/14 292/201
8,146,964 B2 4/2012 Spurr
8,403,380 B2 * 3/2013 Ballhause ..... B04B 7/06 292/201
8,528,950 B2 * 9/2013 Organek ..... E05B 17/007 292/216
8,657,348 B2 * 2/2014 Coleman ..... E05B 85/26 292/198
8,740,263 B2 * 6/2014 Singh ..... E05B 85/243 292/200
8,876,176 B2 * 11/2014 Spurr ..... E05B 81/14 292/201
9,243,429 B2 * 1/2016 Bendel ..... E05B 77/06
9,279,277 B2 * 3/2016 Spurr ..... E05B 81/14 292/195
2004/0056489 A1 * 3/2004 Boecker ..... E05B 81/14 292/201
2004/0094971 A1 * 5/2004 Warmke ..... E05B 81/06 292/201
2004/0227358 A1 * 11/2004 Kachouh ..... E05B 81/14 292/216
2005/0140146 A1 * 6/2005 Spurr ..... E05B 17/007 292/216
2005/0140147 A1 * 6/2005 Spurr ..... E05B 85/26 292/216
2006/0028029 A1 * 2/2006 Spurr ..... E05B 81/20 292/216
2006/0043740 A1 * 3/2006 Torkowski ..... E05B 81/14 292/201
2006/0097523 A1 * 5/2006 Cetnar ..... E05B 85/26 292/216
2006/0163884 A1 * 7/2006 Crotti ..... E05B 77/34 292/216
2006/0170224 A1 * 8/2006 Mitchell ..... E05B 77/04 292/216
2006/0181087 A1 * 8/2006 Wrobel ..... B60N 2/01541 292/216

(56) References Cited

U.S. PATENT DOCUMENTS

2006/0208503 A1* 9/2006 Simchayoff ..... E05B 15/022 292/216
2006/0208504 A1* 9/2006 Kachouh ..... B60N 2/4435 292/216
2006/0267351 A1* 11/2006 Spurr ..... E05B 81/20 292/216
2006/0284425 A1* 12/2006 Torka ..... E05B 81/20 292/201
2007/0046035 A1* 3/2007 Tolley ..... E05B 81/06 292/201
2007/0079640 A1* 4/2007 Bendel ..... E05B 81/14 70/472
2007/0257496 A1* 11/2007 Spurr ..... E05B 17/0037 292/57
2008/0217928 A1* 9/2008 Spurr ..... E05B 81/20 292/198
2008/0303291 A1* 12/2008 Spurr ..... E05B 81/14 292/216
2009/0056393 A1* 3/2009 Otsuka ..... B60N 2/01583 70/205
2009/0199605 A1* 8/2009 Spurr ..... E05B 81/14 70/266
2010/0032967 A1* 2/2010 Otsuka ..... B60N 2/01583 292/240
2010/0032968 A1* 2/2010 Cavallucci ..... E05B 81/14 292/341.16
2010/0171321 A1* 7/2010 Akizuki ..... E05B 77/26 292/200
2010/0253095 A1* 10/2010 Bendel ..... E05B 81/14 292/200
2010/0308624 A1* 12/2010 Juga ..... E05B 13/004 296/155
2011/0012376 A1* 1/2011 Hunt ..... E05B 85/26 292/216
2011/0089705 A1* 4/2011 Barth ..... E05B 85/243 292/226
2011/0187132 A1* 8/2011 Scholz ..... E05B 81/20 292/226
2011/0260475 A1* 10/2011 Spurr ..... E05B 81/14 292/195
2012/0091738 A1* 4/2012 Coleman ..... E05B 85/26 292/200
2015/0097379 A1* 4/2015 Spurr ..... E05B 85/26 292/200

FOREIGN PATENT DOCUMENTS

DE 10214691 10/2003
EP 0978609 2/2000
EP 0978609 A1 * 2/2000 ..... E05B 81/14
FR 2828517 2/2003
GB 785729 11/1957
GB 2182380 5/1987
GB 2189542 10/1987
GB 2401145 11/2004
JP 2289777 11/1990
JP 4306382 10/1992

* cited by examiner

CLOSED

CLOSED

CLOSED

CLOSED

OPENING

OPENING

OPEN

OPEN

OPEN

CLOSING

CLOSED

OPEN

CLOSED

CLOSED

LATCH ASSEMBLY

REFERENCE TO RELATED APPLICATIONS

This application is a continuation of U.S. patent application Ser. No. 11/816,445 filed Oct. 31, 2008, which claims priority to PCT Application PCT/GB2006/00586 filed on Feb. 17, 2006, which claims priority to Great Britain Patent Application Nos. 0503386.5 filed on Feb. 18, 2005 and 0526546.7 filed on Dec. 29, 2005, the entire contents of each of the aforementioned applications are incorporated herein by reference thereto.

BACKGROUND OF THE INVENTION

The present invention relates to latch assemblies, in particular latch assemblies for use with car doors and car boots.

Latch assemblies are known to releasably secure car doors in a closed position. Operation of an inside door handle or an outside door handle will release the latch, allowing the door to open. Subsequent closure of the door will automatically relatch the latch.

In order to ensure that rain does not enter the vehicle, the doors are provided with weather seals around their peripheral edge which close against an aperture in the vehicle body in which the door sits. In addition to providing protection from rain, the weather seals also reduce the wind noise. The ongoing requirement for improved vehicle occupant comfort requires minimizing of wind noise, which in turn requires the weather seals to be clamped tighter by the door. The door clamps the seals by virtue of the door latch, and accordingly there is a tendency for the seal load exerted on the latch to be increased in order to meet the increased occupancy comfort levels required. Because the seal forced on the latch is increased, then the forces required to release the latch are correspondingly increased.

U.S. Pat. No. 3,386,761 shows a vehicle door mounted latch having a rotatable claw which releasably retains a vehicle body mounted striker to hold the door in a closed position. The claw is held in the closed position by a first pawl (which is a tension pawl). The first pawl is held in the closed position by a second pawl. The second pawl can be moved to a release position by an electric actuator which in turn frees the first pawl to rotate counter-clockwise, which allows the claw to rotate clockwise to the open position.

The system is arranged such that once the second pawl has disengaged the first pawl, the first pawl is driven to a release position by the seal load acting on the claw.

US2004/0227358 shows a rotatable claw held in the closed position by a rotatable lever and a link. The rotatable lever can in turn be held in position by a pawl (which is a compression pawl). Disengaging the pawl from the lever (by rotating it clockwise) allows the lever, the link and the pawl to move to an open position. In particular, the link rotates in a clockwise direction. One end of the link remains in permanent engagement with the claw. The system is arranged such that once the pawl has disengaged from the lever, the lever and the link are driven to the open position by the seal load acting on the claw.

EP0978609 shows a rotatable claw that can be held in a closed position by a compression pawl. The pawl is mounted on a cam and during an initial part of opening of the latch, the cam rotates relative to the pawl, thereby initially slightly increasing and then significantly reducing the seal load. During the final part of opening of the latch, the cam and the pawl rotate clockwise in unison, thereby disengaging the pawl tooth from the claw tooth which allows the claw to rotate clockwise to the open position. However, the arrangement is such that the cam must be driven by a motor to release the latch. In particular, in the closed position, the particular configuration of the cam axis, the pawl pivot axis and the pawl tooth is such that the latch will remain shut. Thus, in the closed position, the pawl pivot axis (28 of EP0978609) lies just to one side of a line (31 of EP0978609) drawn between the cam axis and the point where the pawl tooth contacts the claw. Significantly, the pawl pivot axis must initially move towards this line in order for the latch to be opened, and it will be appreciated that a locus defined by movement of the pawl pivot axis during opening crosses this line. In other words, the pawl is at an over-center position, such that the cam is biased in a closing direction (counter-clockwise in this case) by the pawl when the latch has been closed, whereas the cam must be driven in an opening direction (clockwise in this case) to open the latch.

DE10214691 is similarly in an overcenter position when in the closed position. Similarly, the pawl pivot axis must initially move towards the line equivalent of line 31 of EP0978609, and similarly a locus defined by the pawl axis during opening of the latch crosses this line. DE10214691 shows a compression pawl which must be rotated counter-clockwise to disengage the claw, thereby allowing the claw to rotate counter-clockwise to release the striker.

U.S. Pat. No. 5,188,406 shows an example of a latch having a tension pawl (FIG. 2) and a further example of a latch showing a compression pawl. The tension pawl 6 is pivotally mounted on a link 5, which in turn is pivotally mounted on the latch body. As can be seen from FIG. 2 of this patent, the pivot axis of the link 5 with the latch body, the pivot axis between the pawl 6 and the link 5, and the point of contact between the pawl 6 and latch bolt 3 all lie on a straight line. During opening, the pivot axis between the pawl 6 and the link 5 moves clockwise and then counter-clockwise, and in doing so crosses the above mentioned straight line. The pawl must rotate counter-clockwise to disengage the rotating latch bolt 3, which then can rotate clockwise to release the striker. The example of the latch shown in FIG. 4 of this patent is a compression pawl which operates in a similar manner. However, in this case, the pawl must rotate clockwise to disengage the claw which then also rotates clockwise to allow the striker to be released.

U.S. Pat. No. 4,988,135 shows a tension pawl mounted on an eccentric. A pin 28 secured to the pawl proximate the pawl tooth but remote from the eccentric is limited in its movement by an enlargement 38 of the pin 28 contacting a stop 37. The pawl must be rotated clockwise to disengage it from the claw which then rotates counter-clockwise to release the striker.

Thus EP0978609, DE10214691, U.S. Pat. Nos. 5,188,406 and 4,988,135 all show latches in which the component in direct contact with the claw (the pawl) is in a stable position whereas U.S. Pat. No. 3,386,761 and US2004/0227358 both show latches wherein the component in direct contact with the claw is in an unstable position, and therefore requires a further component (the second pawl in U.S. Pat. No. 3,386,761, and the pawl in US2004/0227358) to hold the component that directly engages the claw in its unstable position.

It will be appreciated from the above explanation that where a latch has a compression pawl, the compression pawl rotates in the same direction as the claw (or in the same direction as the lever of US2004/0227358) to release the latch, whereas when a latch includes a tension pawl, the tension pawl must be rotated in the opposite direction to the claw. Thus, U.S. Pat. Nos. 3,386,761, 4,988,135 and FIG. 2 of U.S. Pat. No. 5,188,406 all show tension pawls, whereas EP0978609, DE10214691, US2004/0227358 and FIG. 4 of U.S. Pat. No. 5,188,406 all show compression pawls.

SUMMARY OF THE INVENTION

An object of some embodiments of the present invention is to provide a compact latch arrangement. An object of some embodiments of the present invention is to provide a latch arrangement that requires a reduced force to release.

A latch assembly includes a chassis, a latch bolt moveably mounted on the chassis and having a closed position for retaining a striker and an open position for releasing the striker, a pawl having an engaged position at which the pawl is engaged with the latch bolt to hold the latch bolt in the closed position and a disengaged position at which the pawl is disengaged from the latch bolt, thereby allowing the latch bolt to move to the open position, an eccentric arrangement defining an eccentric axis and a pawl axis remote from the eccentric axis. The eccentric arrangement is rotatable about the eccentric axis, and the pawl is rotatable about the pawl axis. When the pawl moves from the engaged position to the disengaged position, the eccentric arrangement rotates in one of a clockwise and a counter-clockwise direction about the eccentric axis. With the pawl in the engaged position, a force applied to the pawl by the latch bolt creates a turning moment on the eccentric arrangement in the one of the clockwise and counter-clockwise direction, and the eccentric arrangement is prevented from rotating in said one of the clockwise and counter-clockwise direction by a moveable abutment.

Thus, according to the present invention there is provided a latch arrangement as defined in the accompanying independent claims.

BRIEF DESCRIPTION OF THE DRAWINGS

The invention will now be described, by way of example only, with reference to the accompanying drawings in which.

DETAILED DESCRIPTION OF THE PREFERRED EMBODIMENT

Figure 1:
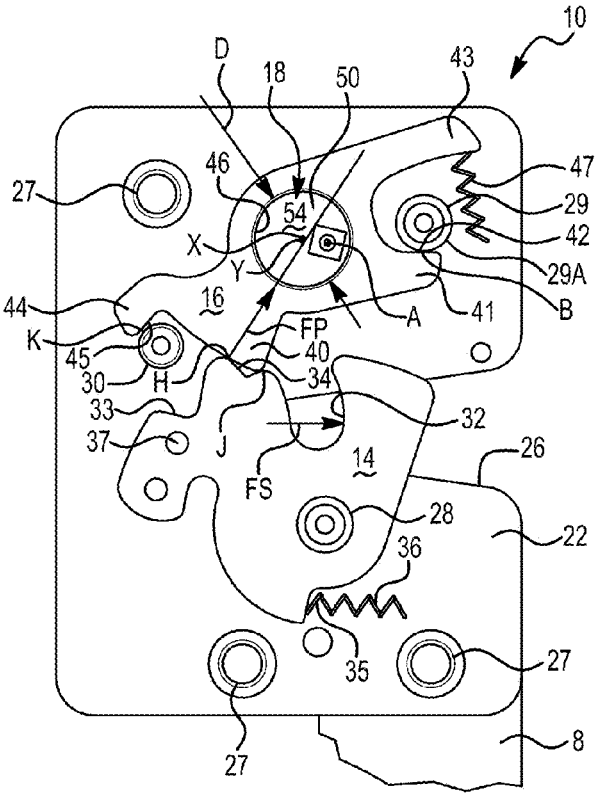
FIGS. 1, 1A and 1B show a view taken from a backplate side of a latch showing certain components of a latch arrangement according to the present invention, in a closed position.
Figure 1A:
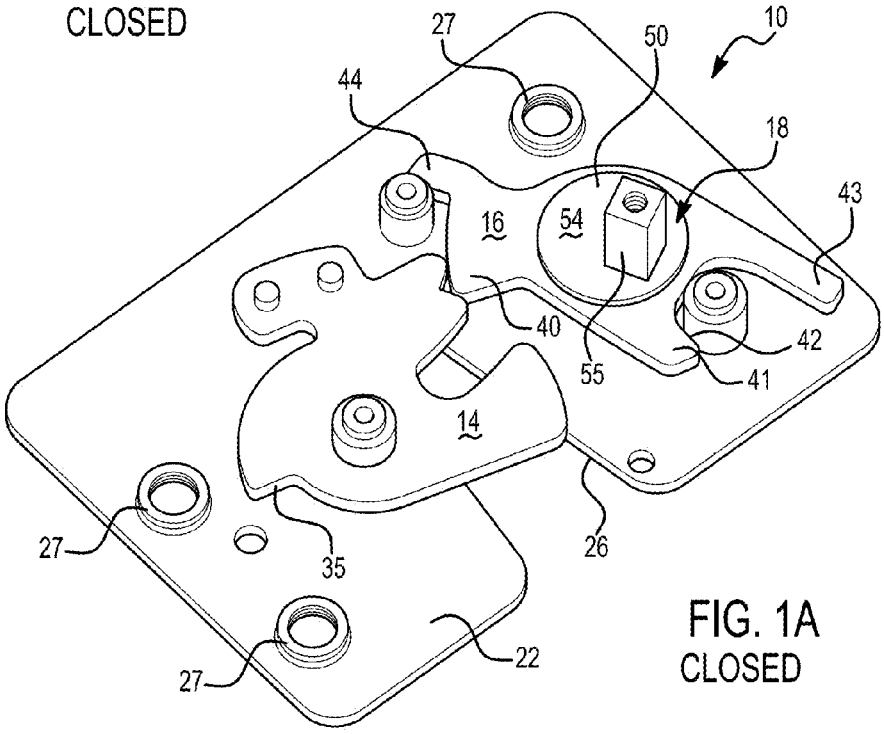

With reference to the FIGS. 1 to 4, there is shown a latch assembly 10, the major components of which are a latch chassis 12, a latch bolt in the form of a rotating claw 14, a compression pawl 16, an eccentric arrangement in the form of a crank shaft assembly 18 and a release actuator assembly 20. The latch assembly 10 is mounted on a door 8 (only shown in FIG. 1).

The major components of the latch chassis 12 are a retention plate 22 and a backplate 24. The retention plate 22 is generally planar (but having an up turned edge, only shown in FIGS. 1B and 2A). The generally planar portion includes a mouth 26 for receiving a striker (not shown). The retention plate 22 includes three threaded holes 27 which in use are used to secure the latch assembly 10 to the door. Projecting from the retention plate 22 is a claw pivot pin 28 and stop pins 29 and 30. The stop pin 29 is fixed relative to the latch chassis 12 and includes a cylindrical outer surface 29A, the purpose of which will be described below.

The backplate 24 includes holes 31A, 31B and 31C for receiving ends of the claw pivot pin 28, the stop pin 29 and the stop pin 30, respectively. During assembly the ends of the pins 28, 29 and 30 are peened over in order to secure the backplate 24 relative to the retention plate 22.

The rotating claw 14 is pivotally mounted on the claw pivot pin 28 and includes a mouth 32 for receiving the striker, a first safety abutment 33 and a closed abutment 34. A spring abutment 35 is engaged by a spring 36 to bias the rotating claw 14 towards its open position.

The rotating claw 14 is generally planar and includes a reset pin 37 which projects out of general plane of the rotating claw 14.

The pawl 16 includes a pawl tooth 40, a first arm 41 having an abutment surface 42, a second arm 43, and a third arm 44 having an abutment surface 45. The pawl 16 also has a pawl pivot hole 46 of an internal diameter D. The pawl 16 is biased in a clockwise direction when viewing FIG. 1C about axis Y (see below) by a spring 47 engaging the second arm 43. The stop pin 30 acts to limit rotation of the pawl 16 in a counter-clockwise direction when viewing FIG. 3 by engaging the third arm 44.

The major components of crank shaft assembly 18 are a crank shaft 50, a reset lever 51 and a release lever 52.

The crank shaft 50 includes a crank pin 54 in the form of disc having a crank pin axis Y. A square shaft 55 projects from one side of the crank pin 54, and a cylindrical pin 56 projects from the other side of the crank pin 54. The square shaft 55 and the cylindrical pin 56 together define a crank shaft axis A. The cylindrical pin 56 is rotatably mounted in a hole (not shown) of the retention plate 22. The retention plate 22 thereby provides a bearing for the cylindrical pin 56.

The diameter of the crank pin 54 is a running fit in the pawl pivot hole 46, i.e., the diameter of the crank pin 54 is slightly less than D. The radius of the crank pin 54 is R. The crank pin axis Y therefore defines a pawl axis about which the pawl 16 can rotate (see below). The thickness of the crank pin 54 is substantially the same as the thickness of the pawl 16.

Figure 3:
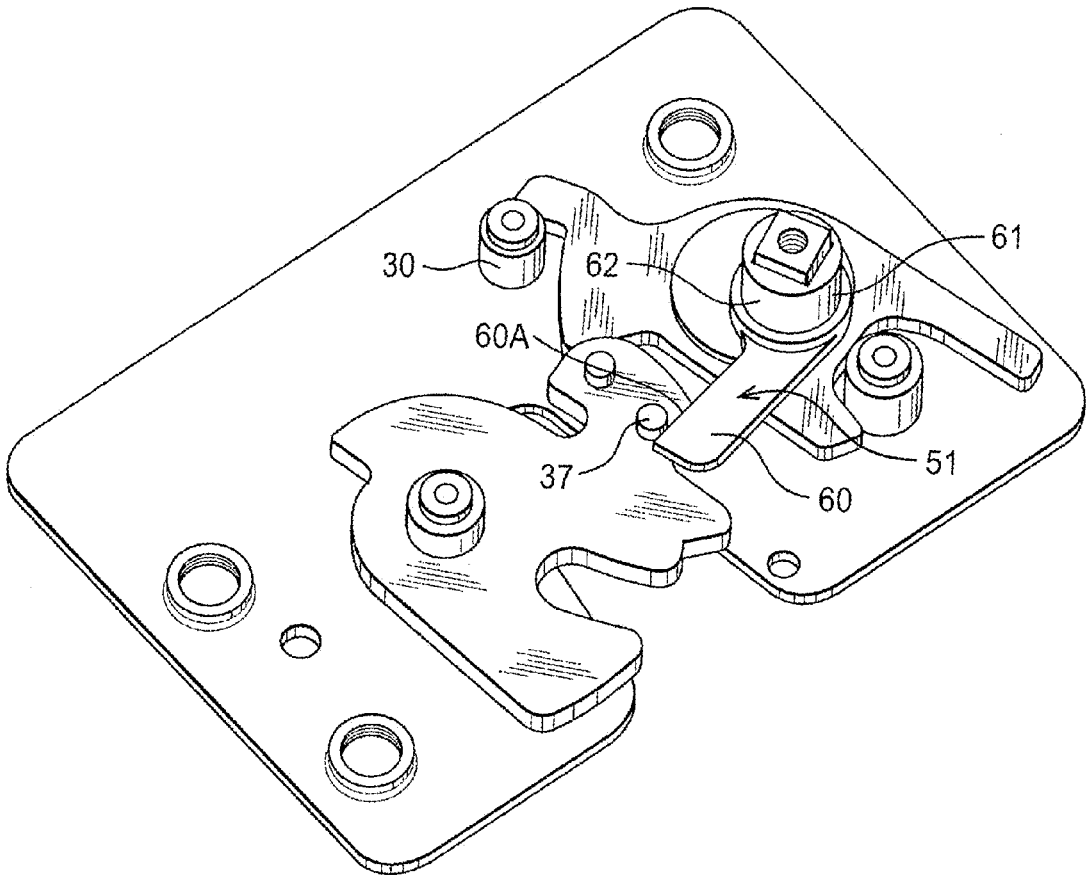
FIGS. 3, 3A and 3B show certain components of the latch of FIG. 1 in an open position.

The reset lever 51 includes an arm 60 and a boss 61 secured to the arm 60. The boss 61 has a cylindrical outer surface 62 and has a central hole of square cross section. Accordingly, when the boss 61 is assembled onto the square shaft 55, as shown in FIG. 3, then the arm 60 becomes rotationally fast with the crank shaft 50. The cylindrical outer surface 62 of the boss 61 is mounted in a hole in the backplate 24, which thereby provides a bearing surface for the cylindrical outer surface 62. It will be appreciated that the cylindrical outer surface 62 and the outer surface of the cylindrical pin 56 are concentric and together define the crank shaft axis A.

The arm 60 includes an edge 60A (also known as a reset abutment) which interacts with the reset pin 37, as will be described further below.

The release lever 52 is generally elongate and includes a square hole 64 at one end to receive an end of the square shaft 55, and includes a release abutment 65 at the other end thereof.

A bolt and washer (not shown) is screwed into the threaded hole 57 of the square shaft 55 to secure the crank shaft, the reset lever and the release lever together. Accordingly, it will be appreciated that the crank shaft 50, the reset lever 51 and the release lever 52 are all rotationally fast relative to each other.

Figure 3A:
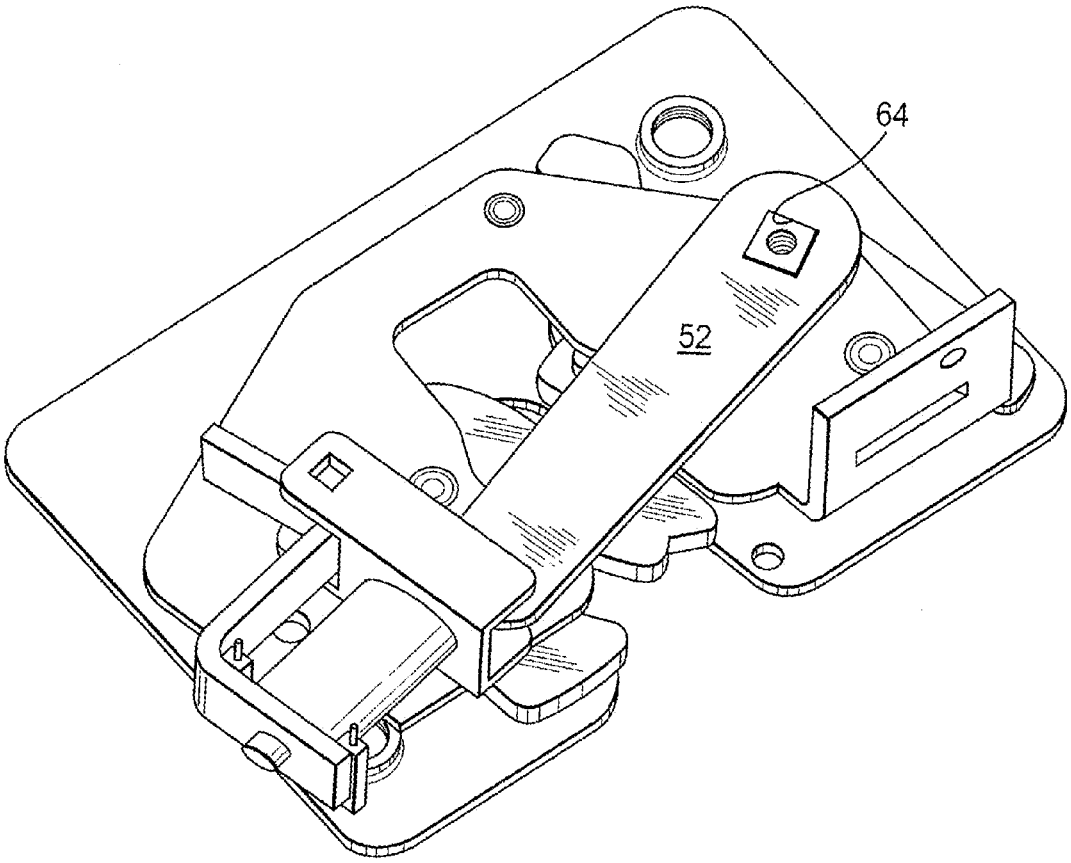
Figure 3B:
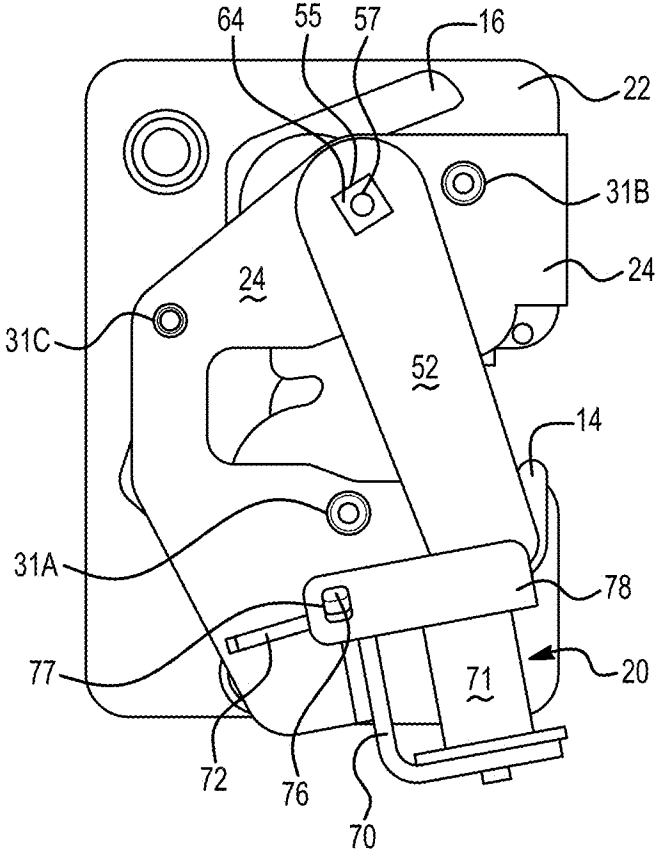

When assembled, the crank pin 54 and the reset lever 51 are positioned between the retention plate 22 and the backplate 24, with the cylindrical outer surface 62 of the boss 61 being rotationally mounted in a hole (not shown) of the backplate 24. It will be appreciated that the release lever 52 lies on an opposite side of the backplate 24 to the reset lever 51 and the crank pin 54 (best seen in FIG. 3A).

The major components of the release actuator assembly 20 are a bracket 70, an electromagnet 71 and a release plate 72. The bracket 70 is bent from the retention plate 22 and is used to mount the electromagnet 71. The bracket 70 is also used to pivotally mount the release plate 72, which is made from a magnetic material, such as steel. The release plate 72 is planar and generally rectangular in plan view and it can be seen from FIG. 2A that it projects equally either side of where it pivots on the bracket 70. Thus, the release plate 72 is balanced.

Figure 1B:
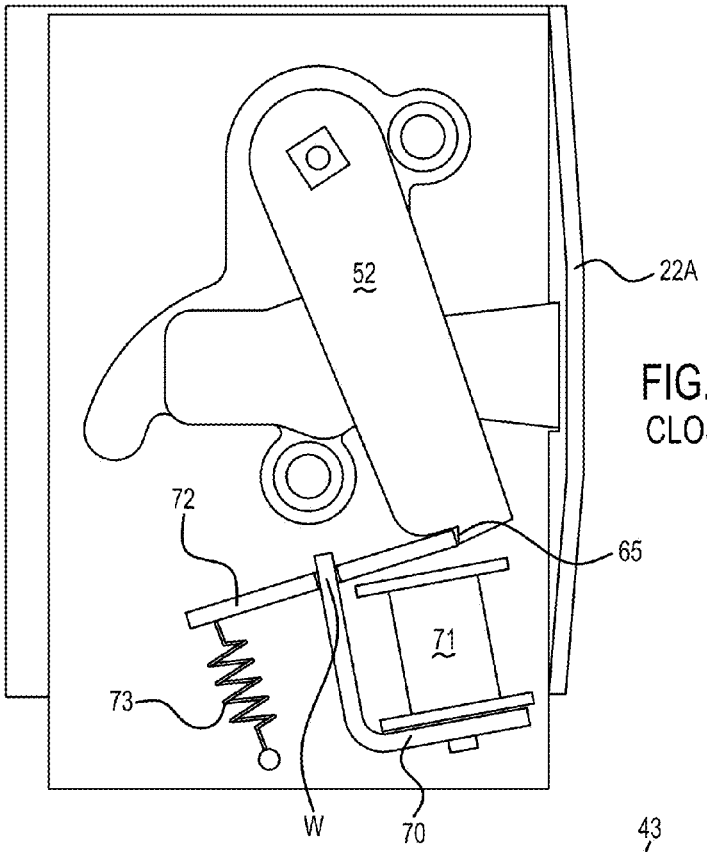

The release plate 72 is biased in a counter-clockwise direction when viewing FIG. 1B by a spring 73 (shown schematically). The release plate 72 includes a moveable abutment 74 at one end.

Figure 1C:
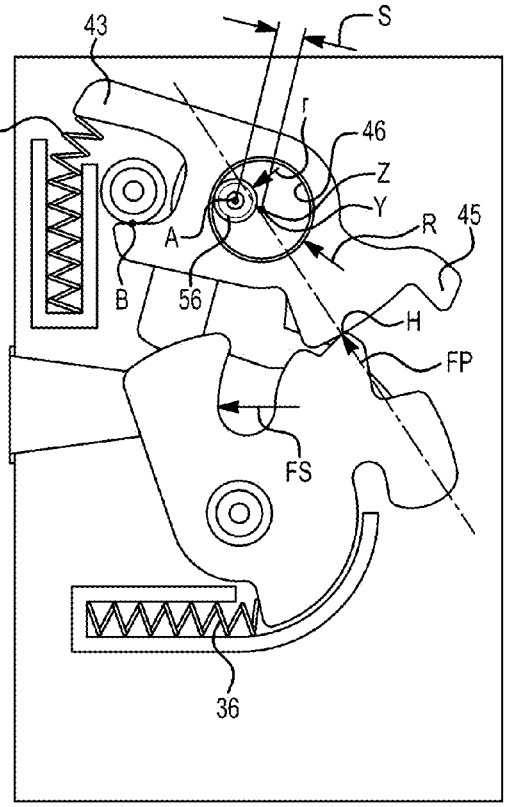
FIG. 1C shows a view taken from a retention plate side of the latch showing certain components of the latch arrangement of FIG. 1 in a closed position.

Operation of the latch assembly 10 is as follows: Consideration of FIGS. 1 to 1C show the latch assembly 10 and the associated door 8 in a closed condition. The rotating claw 14 is in a closed position, retaining the striker (not shown). The pawl 16 is in an engaged position whereby the pawl tooth 40 is engaged with the closed abutment 34, thereby holding the rotatable claw 14 in its closed position. The weather seals of the door are in a compressed state and the striker therefore generates a seal force FS on the mouth 32 of the rotatable claw 14, which tends to rotate the rotatable claw 14 in a clockwise direction when viewing FIG. 1 (a counter-clockwise direction when viewing FIG. 1C).

Force FS in turn generates a force FP onto the pawl tooth 40 and hence onto the pawl 16. Force FP in turn is reacted by the crank pin 54 of the crank shaft 50. The force FP reacted by the crank pin 54 is arranged so as to produce a clockwise (when viewing FIG. 1) torque (or turning moment) on the crank shaft 50 about the crank shaft axis A (a counter-clockwise torque when viewing FIG. 1C). However, the crank shaft assembly 18 is prevented from rotating clockwise when viewing FIG. 1 (counter-clockwise when viewing FIG. 1C) by virtue of the engagement between the release abutment 65 of the release lever 52 and the abutment 74 of the release plate 72 (see FIG. 1B). The release plate 72 has been biased to the position shown in FIG. 1B by the spring 73. Note that in the closed position, no electric current is flowing through the electromagnet 71, which accordingly exerts no magnetic force of the release plate 72.

Figure 2:
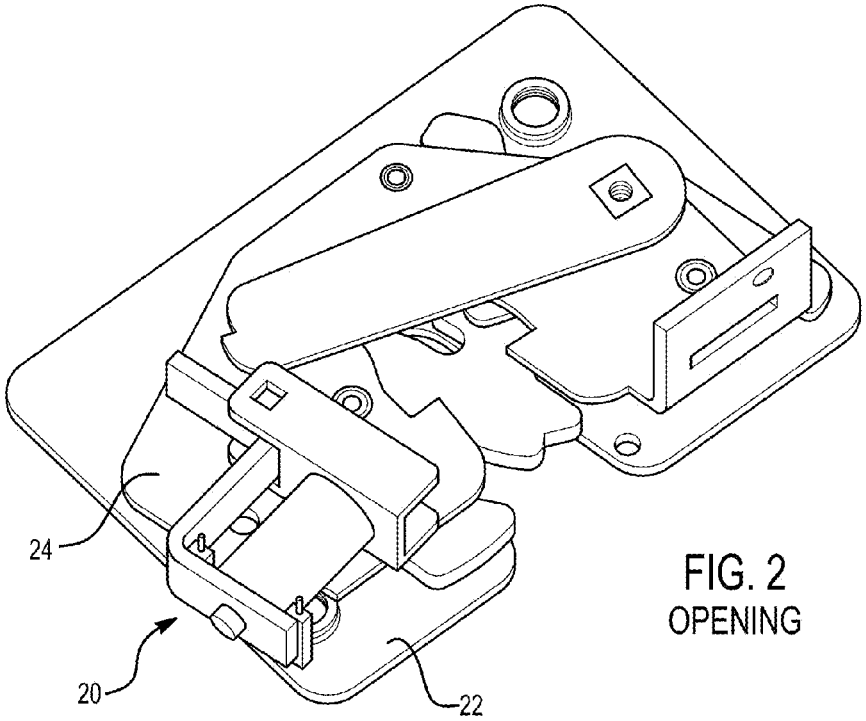
FIGS. 2 and 2A show certain components of FIG. 1 whilst the latch is being opened.
Figure 2A:
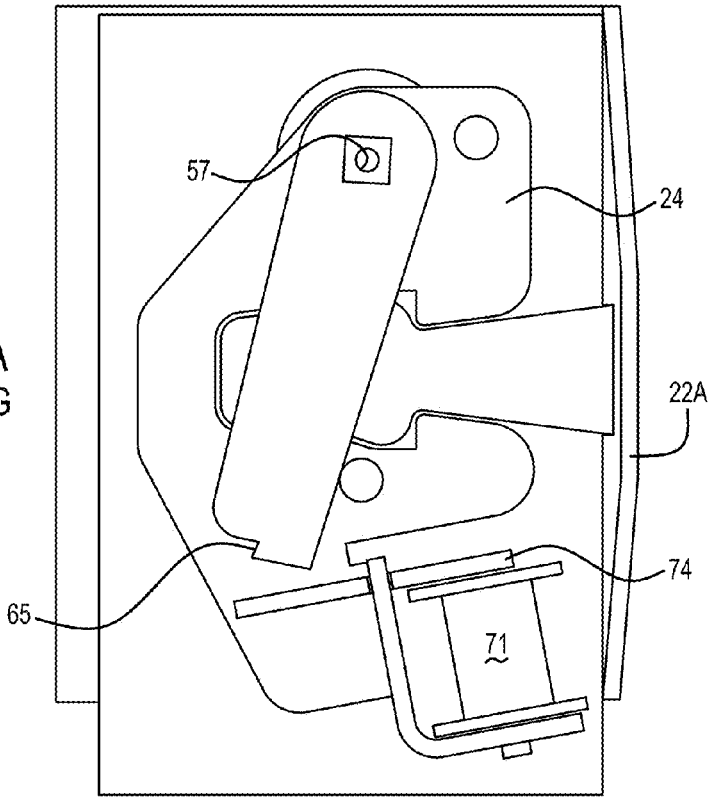

In order to release the latch, electric current is supplied to the electromagnet 71, which creates a magnetic force which attracts the right hand end (when viewing FIG. 1B) of the release plate 72, causing the release plate 72 to rotate clockwise to the position shown in FIG. 2A. This in turn allows the release lever 52 and the crank shaft 50 to rotate clockwise (when viewing FIGS. 2 and 2A) in an opening direction of the crank shaft 50 as a result of the force FP that was reacted by the crank pin 54.

Considering FIG. 1C, the crank shaft 50 rotation upon opening is the counter-clockwise about an axis A, i.e., counter-clockwise relative to the latch chassis 12. It will be appreciated that the crank shaft axis A is defined by the cylindrical pin 56 being rotatably mounted in the retention plate 22 (as mentioned above), and the boss 61 being rotatably mounted in the backplate 24 (as mentioned above). Accordingly, the crank shaft axis A is fixed relative to the latch chassis 12.

As mentioned above, when viewing FIG. 1C, force FP generates a counter-clockwise torque upon the crank shaft 50 about the crank shaft axis A. Once the crank shaft 50 is freed to rotate (i.e., once the abutment 74 has disengaged from the release abutment 65), then the crank shaft 50 will move in a counter-clockwise direction since the crank pin axis Y is constrained to move about an arc centered on the crank shaft axis A. It will be appreciated that since the pawl pivot hole 46 is a close running fit on the crank pin 54, then the pawl axis Z (i.e., the center of the pawl pivot hole 46) is coincident with the crank pin axis Y. Accordingly, the pawl axis Z is similarly constrained to move about an arc centered on the crank shaft axis A.

As the crank shaft 50 starts to rotate in a counter-clockwise direction from the position shown in FIG. 1C, it will be appreciated that the rotating claw 14 starts to open. It will also be appreciated that it is the action of the rotating claw pushing on the pawl 16 that causes the pawl 16 to move i.e., it is the rotating claw 14 that drives the pawl 16 to the disengaged position by virtue of the weather seal load acting on the rotating claw 14. As the pawl 16 moves, the angular position of the pawl 16 is controlled by engagement between the abutment surface 42 of the first arm 41 and the stop pin 29, more particularly contact point B defined between the abutment surface 42 and part of the cylindrical outer surface 29A (which is also known as a chassis control surface).

Note that generally speaking, the movement of the pawl 16 can be approximated to rotation about a contact point B (i.e., rotation about the contact point between the abutment surface 42 and the cylindrical outer surface 29A). However, the movement is not truly rotational since a part of the pawl (namely the pawl axis Z) is constrained to move about the axis A rather than about the contact point B. Thus, the movement of the pawl 16 at the contact point B relative to stop pin 29 is a combination of rotational movement and transitional (sliding) movement. Indeed, the contact point B is not stationary and will move a relatively small distance around the cylindrical outer surface 29A, and will also move a relatively small distance along the abutment surface 42. Thus, the contact point B is the position where (at the relevant time during opening of the latch) the abutment surface 42 contacts the cylindrical outer surface 29A.

Figure 6:
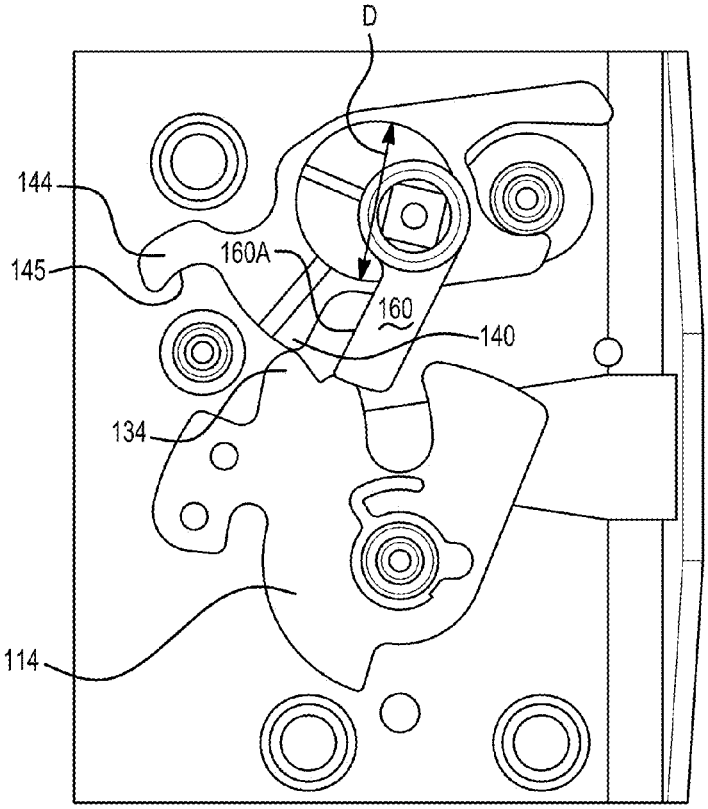

It will be appreciated that, starting from the FIG. 1C position, once the abutment 74 has disengaged from the release abutment 65, the closed abutment 34 of the rotating claw 14 pushes the pawl 16 (via the pawl tooth) to a position whereby the closed abutment 34 can pass under the pawl tooth 40 when viewing FIG. 1C (see in particular FIG. 6 in relation to the second embodiment of the invention). Continued counter-clockwise rotation of the rotating claw 14 (when viewing FIG. 1C) will cause the first safety abutment 33 to approach the pawl tooth 40. As this occurs, the pawl tooth 40 will momentarily engage the first safety abutment 33, since the pawl 16 is biased in a clockwise direction when viewing figure IC by the spring 47. However, the geometry of the system is such that immediately after momentary engagement between the first safety abutment 33 and the pawl tooth 40, the first safety abutment 33 pushes the pawl 16 (via the pawl tooth 40) to a position whereby the first safety abutment 33 continues to rotate in a counter-clockwise direction when viewing FIG. 1C under the pawl tooth 40.

Once the pawl tooth 40 has thus disengaged from first safety abutment 33 of the rotating claw 14, the rotating claw 14 is then free to rotate past the position shown in FIG. 2 to the fully open position as shown in FIG. 3. However, in doing so, the reset pin 37 engages and then moves the edge 60A of the arm 60. This in turn rotates the crank shaft 50 back to the position shown in FIG. 1, thereby resetting the crank pin axis Y to the FIG. 1 position, and also returning the release lever 52 to the FIG. 1 position. As the release lever 52 passes over the right hand end of the release plate 72, the release plate 72 is momentarily deflected and then snapped back into engagement (under the influence of the spring 73) such that the abutment 74 reengages the release abutment 65. Thus, when considering FIGS. 3 and 3A, the pawl 16, the crank shaft assembly 18, and the release actuator assembly 20, are all in the same position as FIGS. 1 to 1B. However, in FIGS. 3 and 3A, the rotating claw 14 is in the open position, whereas in FIGS. 1 to 1B the rotating claw 14 is in the closed position. Also, in FIGS. 3 and 3A the rotational position of the pawl 16 is controlled by engagement between the third arm 44 and the stop pin 30, whereas in FIGS. 1 to 1B the rotational position of the pawl 16 is determined by engagement between the pawl tooth 40 and the closed abutment 34.

Figure 4:
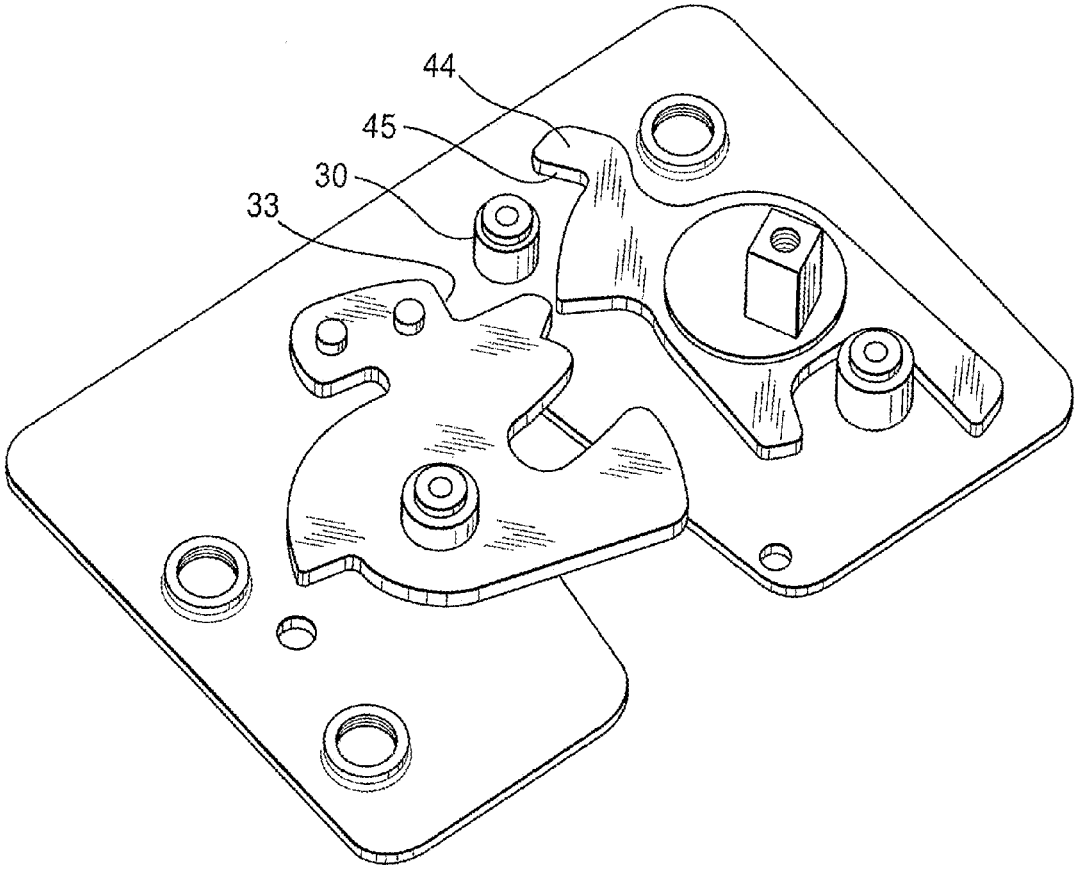
FIG. 4 shows certain components of the latch of FIG. 1 during closing.

Once the latch and associated door has been opened, then closing of the door will automatically relatch the latch. Note however that no rotation of the crank shaft 50 occurs during closing of the door. Accordingly, the crank pin axis Y does not rotate and as such the crank pin 54 itself acts as a simple pivot having a fixed axis. FIG. 4 shows the latch assembly 10 during the closing process and it can be seen that the pawl 16 is free to rotate about pawl axis Z to provide conventional closing dynamics for the first safety and fully latched positions.

As mentioned above, the crank shaft assembly 18 is supported in a bearing of the retention plate 22 on one side of the crank pin 54 and is also supported in a bearing in the backplate 24 on the other side of the crank pin 54. Thus, the crank shaft 50 is supported on both sides of the crank pin 54, which is a particularly compact and strong arrangement. However, in further embodiments, the crank shaft 50 need only be supported on one side, i.e., the crank shaft 50 can be an overhung crank shaft. An example of such an overhung crank shaft would be provided by deleting the cylindrical pin 56. Note that the crank shaft axis would still be in exactly the same position since it would be defined by the cylindrical outer surface 62.

Consideration of FIG. 1C shows that the crank pin 54 has a radius R, and the cylindrical pin 56 has a radius r. The crank throw (the distance between the crank shaft axis A and the crank pin axis Y) is S. In this case, (R-r)=S and accordingly, no part of the cylindrical pin 56 sits outside the circumference of the disc. This provides a particularly compact arrangement. In other words, the crank pin axis Y is offset from the crank shaft axis A by the crank pin radius R minus the crank shaft radius.

In further embodiments, the crank pin axis can be offset from a crank shaft axis by less than the crank pin radius plus the crank shaft radius. Alternatively, the crank pin axis can be offset from a crank shaft axis by less than the crank pin radius, or in a further alternative the crank pin axis can be offset from the crank shaft axis by less than the crank pin radius minus the crank shaft axis. The ratios of: the offset between the crank shaft axis and the crank pin axis (S), the crank pin radius, and the crank shaft radius, together determine the degree of radial overlap between the crank shaft 50 and the crank pin 54.

Consideration of FIG. 3 shows that the cylindrical outer surface 62 of the boss 61 is generally of the same diameter as the cylindrical pin 56. In a further embodiment, the cylindrical outer surface could be larger in diameter than the cylindrical pin 56, and in such an embodiment a crescent shaped portion of the boss 61 would sit outside the diameter of the crank pin 54. Whilst this is a less compact arrangement than the cylindrical pin 56, nevertheless the crank pin axis is offset from the crank shaft axis by less than the radius of the crank pin 54. In further embodiments, the crank pin axis can be offset from the crank shaft axis by more than the radius of the crank pin 54 (see in particular the embodiment shown in FIGS. 62 to 67).

Figure 5:
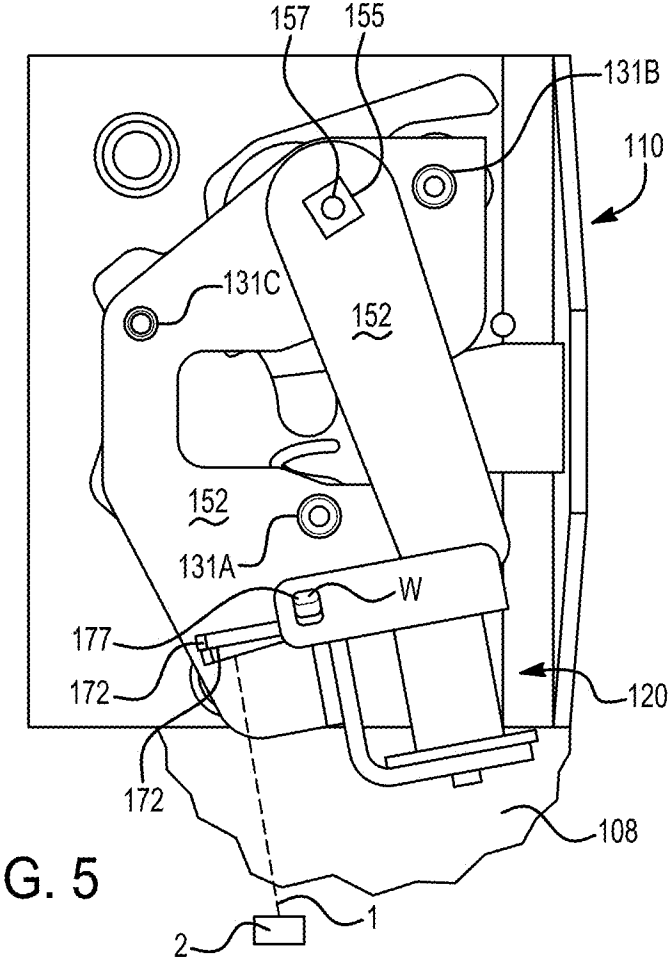
FIGS. 5, 5A, 5B, 6, 6A, 7, 8 and 9 show a further embodiment of a latch assembly according to the present invention.
Figure 5A:
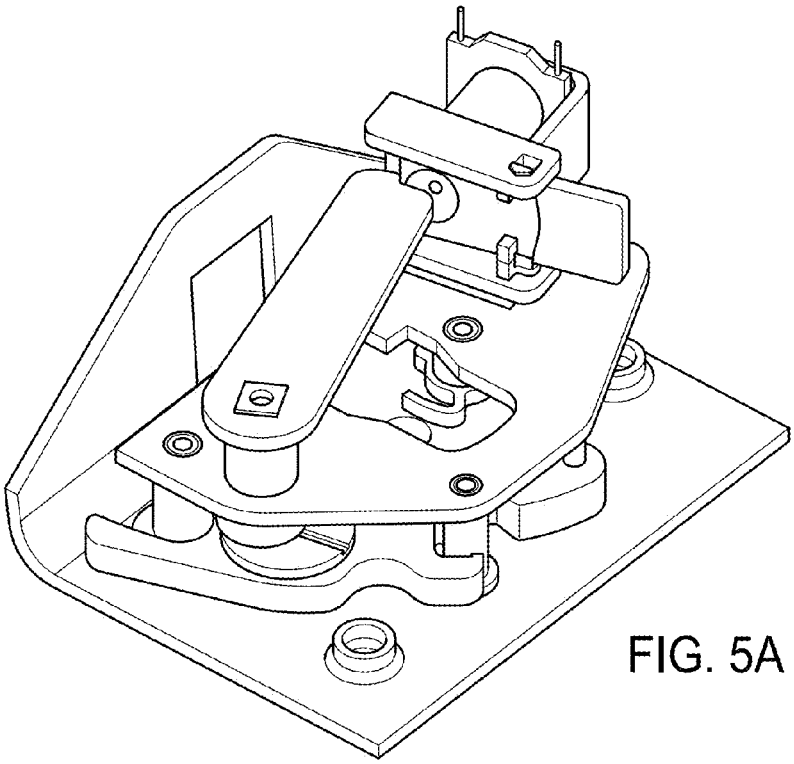
Figure 5B:
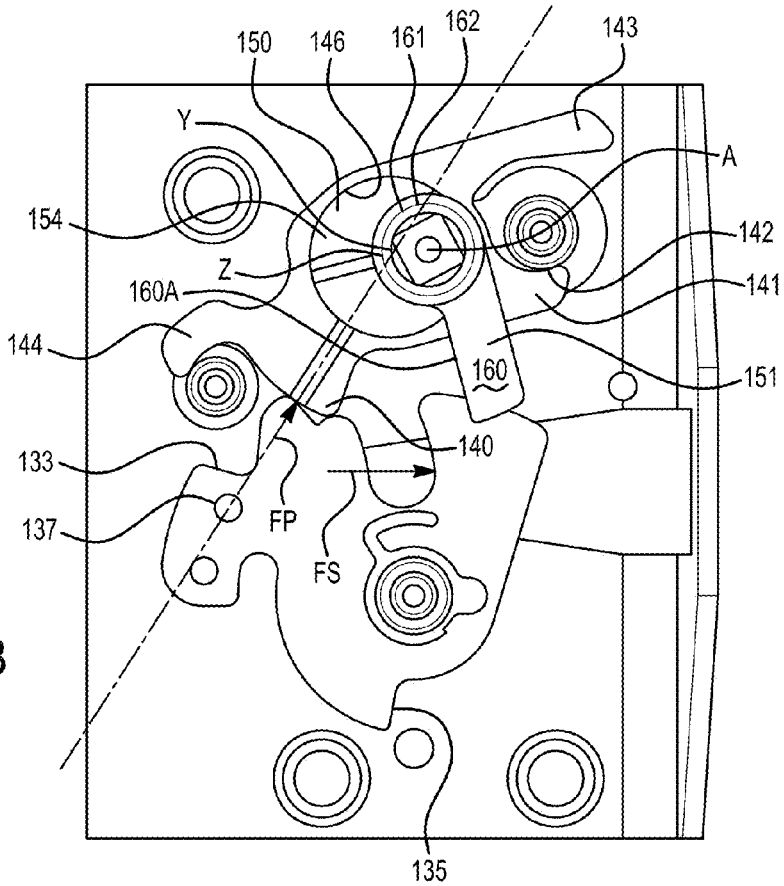

FIGS. 5 to 9 show a second embodiment of a latch assembly 110 in which components that fulfill substantially the same function as shown in the latch assembly 10 are labelled 100 greater. FIGS. 5, 5A and 5B show the latch assembly 110 in a closed position.

Figure 6A:
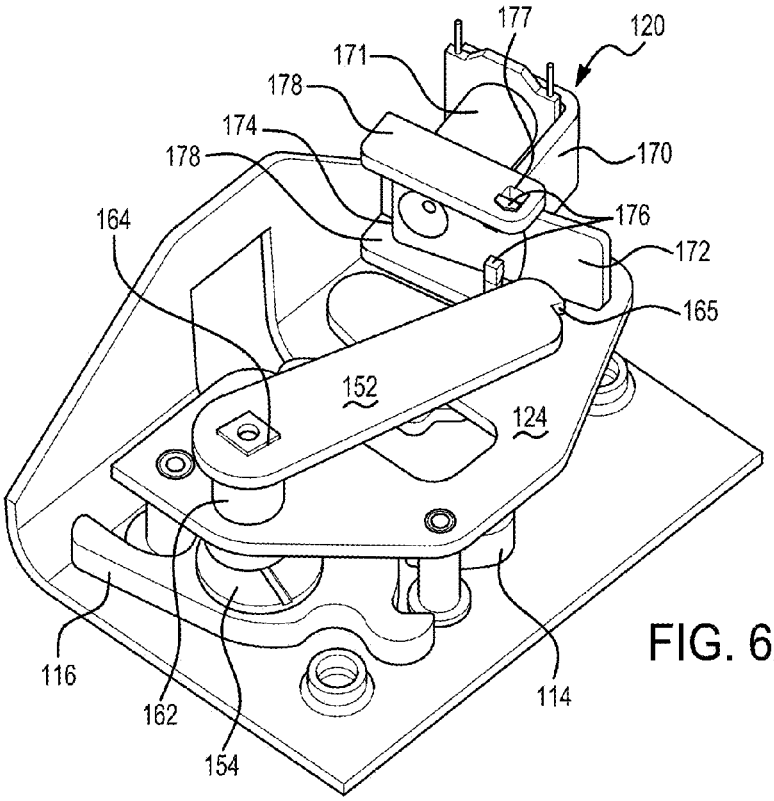

FIGS. 6 and 6A show the latch assembly 110 during opening. In particular, FIG. 6 shows the closed abutment 134 just passing underneath the pawl tooth 140. It can be seen from FIG. 6 that the claw 114 has rotated clockwise slightly (i.e., it has started to open) when compared with the fully closed position shown in FIG. 5B.

FIG. 6A best shows the generally rectangular plan view of the release plate 172. The release plate 172 further includes pivot lugs 176 which are received in respective holes 177 of side plates 178 to allow the release plate 172 to pivot, thereby allowing the moveable abutment 174 to disengage subsequently engage the release abutment 165.

The release plate 72 is mounted in a similar manner to the release plate 172.

Figure 7:
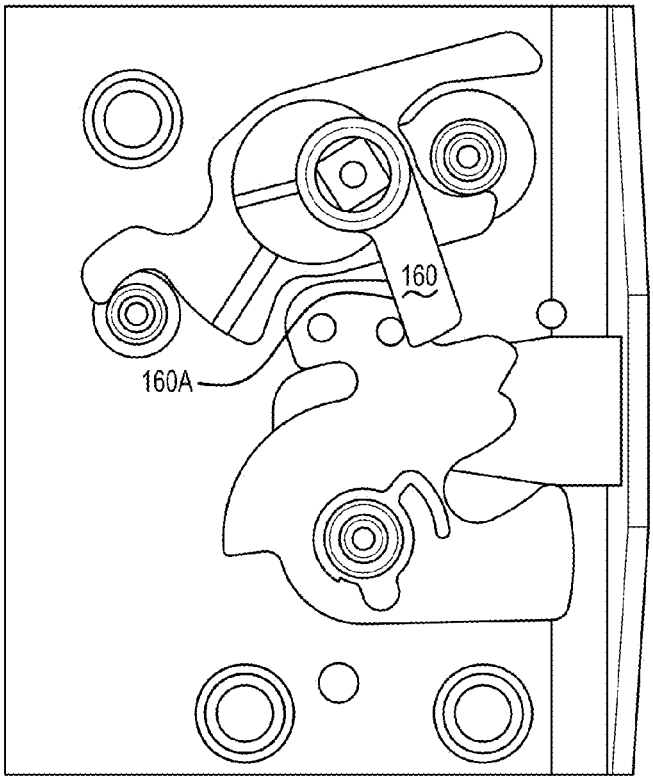

FIG. 7 shows the latch assembly 110 in an open condition.

Figure 8:
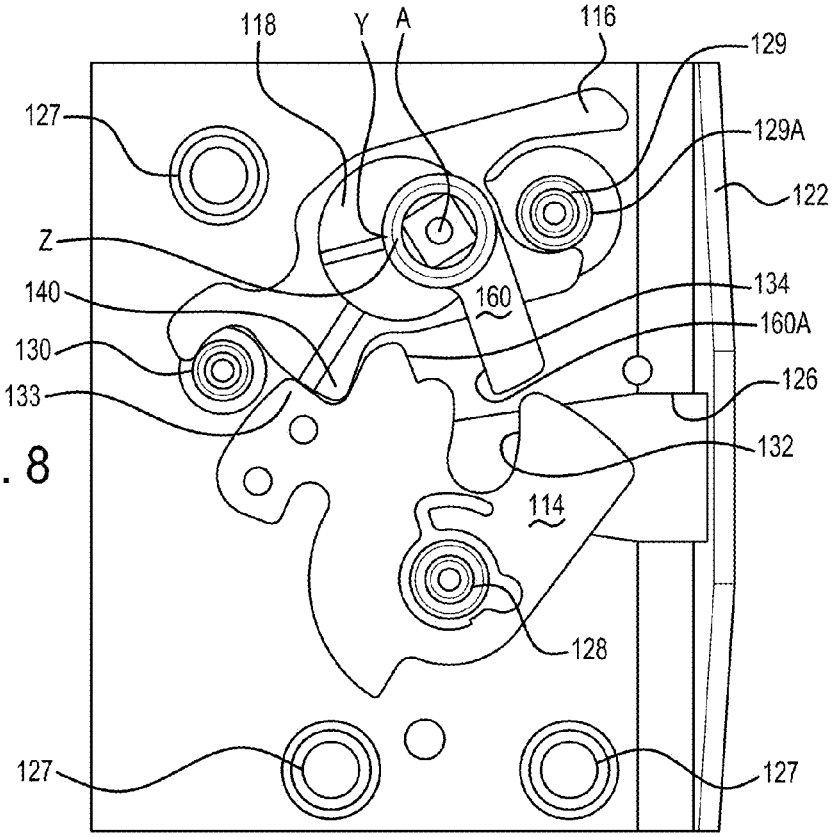

FIG. 8 shows the latch assembly 110 closed to a first safety position, i.e., a position where the door is not fully closed but nevertheless is prevented from being opened. Accordingly, the pawl tooth 140 has engaged the first safety abutment 133. Note that as shown in FIG. 8, the pawl 116 and the crank shaft assembly 118 are in an identical position to that shown in FIG. 5B.

Figure 9:
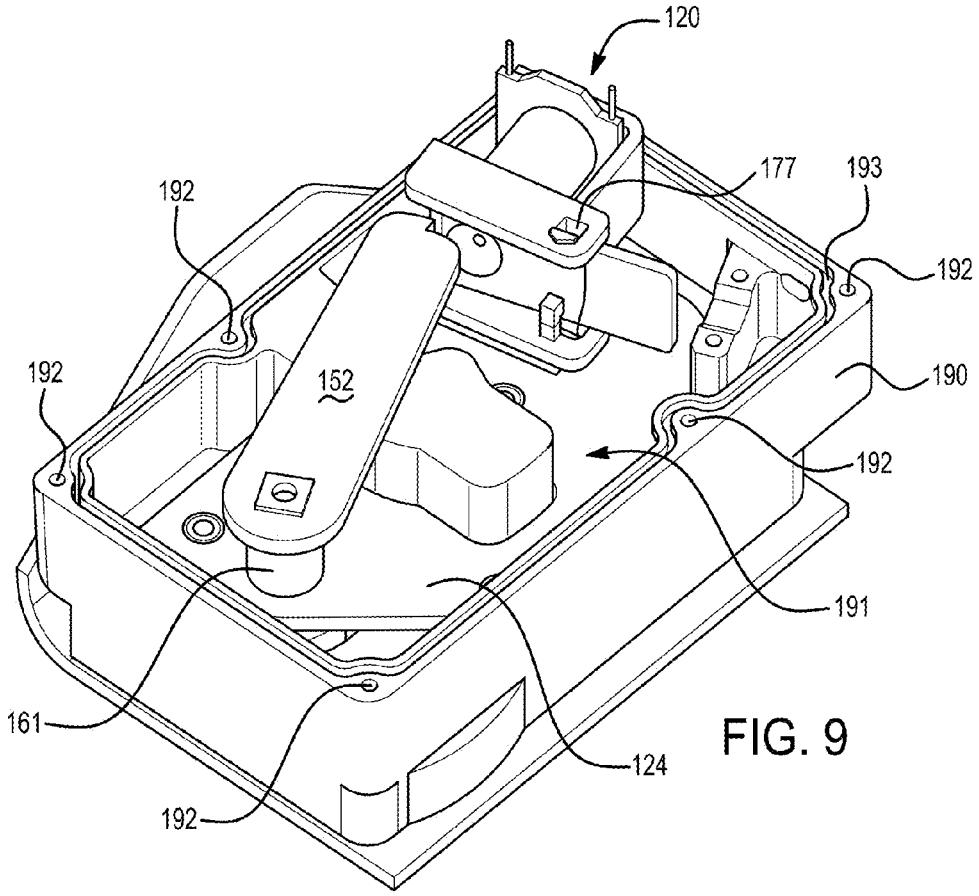

As best seen in FIG. 6A, the release actuator assembly 120 and the release lever 152 lies on one side of the backplate 124, whilst the crank pin 154, the pawl 116 and the claw 114 lie on the other side of the backplate 124. Because the mouth 126 must receive and release the striker, then the claw 114 and the pawl 116 (which is a compression pawl) must inevitably be in an environment that is exposed to dirt and moisture. However, FIG. 9 shows a housing 190 made of a plastics material which closes off the various cut outs in the backplate 124 and provides an appropriate housing enclosure 191 for the release actuator assembly 120 and the release lever 152 thereby providing a dry and dirt free environment. In particular, the bearing of the backplate which supports the boss 161 would prevent dirt and moisture entering the housing enclosure. A cover (not shown) encloses the open side of the housing enclosure 191 and is secured to the housing via screws screwed into holes 192. A seal (not shown) sits in a groove 193 to provide a waterproof seal between the housing 190 and the cover.

The latch assembly 10 and 110 are released by a control system, allowing current to flow through the electromagnet 71 or 171, which thereby attracts the release plate 72 or 172 as appropriate. However, in further embodiments, the release plate 72 or 172 could be actuated manually, for example by provision of a suitable connection to an inside door handle or an outside door handle. Chain dotted line 1 on FIG. 5 shows a schematic representation of just such a suitable connection, and box 2 is a schematic representation of an inside door handle or an outside door handle. Alternatively, the release plate could be actuated by an alternative power actuator, such as a motor in particular an electric motor.

Figure 10:
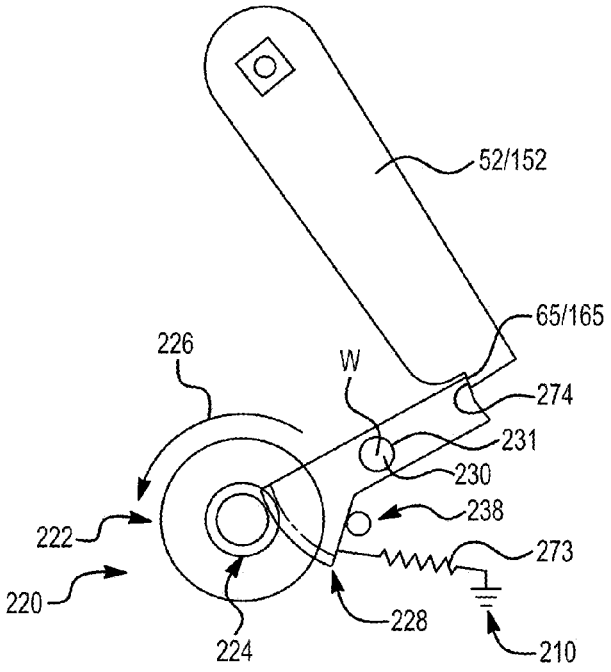
FIG. 10 shows a further embodiment of latch assemblies according to the present invention.

FIG. 10 shows an alternative release actuator assembly 220 for use with the release lever 52 of the latch assembly 10 or for use with the release lever 152 of the latch assembly 110. In this case, a motor 222 (in this example an electric motor) is drivingly coupled to a pinion gear 224 to rotate the pinion gear in a counter-clockwise direction 226 when it is required to open the latch. The pinion gear 224 engages a gear segment 228, which is caused to rotate in a clockwise direction about an axis 230 defined by the pivot pin 231. Clockwise rotation of the gear segment 228 causes the moveable abutment 274 of the gear segment 228 to disengage from the release abutment 65 of the release lever 52 or the release abutment 165 of the release lever 152, as appropriate.

A spring 273 (shown schematically and the functional equivalent of the spring 73) acts to bias the gear segment 228 in a counter-clockwise direction such that the abutment 274 reengages abutment 65 and 165 once the crankshaft position has been reset prior to closing the latch. A gear segment stop 238 limits counter-clockwise rotation of the gear segment.

The release actuator assembly 220 operates in a similar manner to the release actuator assembly 20 during opening and closing of the latch.

Figure 11:
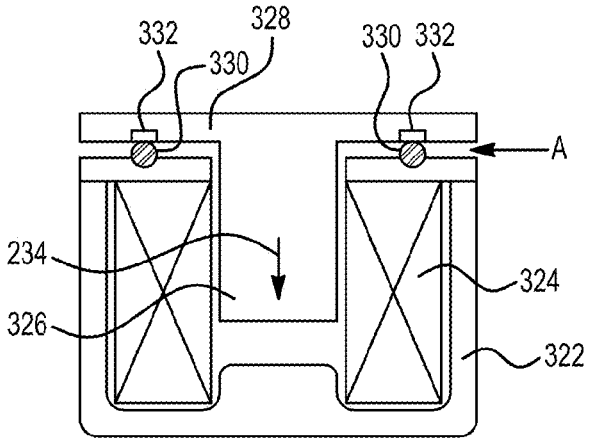
FIGS. 11, 12 and 13 show a further embodiment of a latch assembly according to the present invention.
Figure 12:
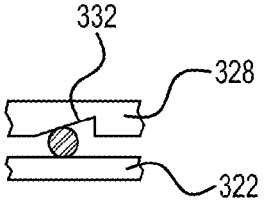
Figure 13:
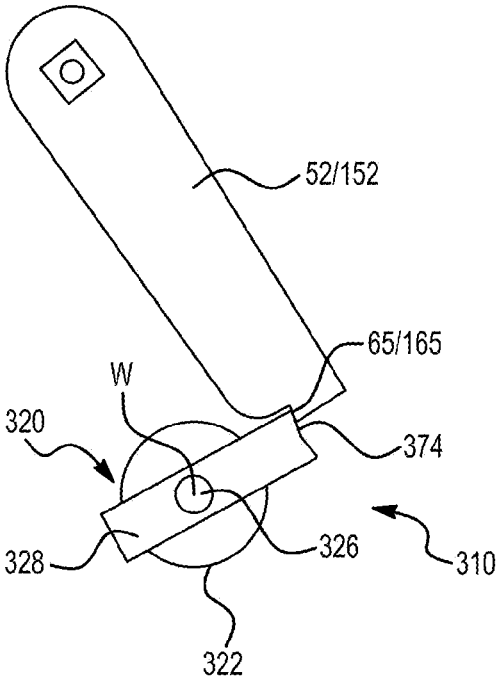

FIGS. 11, 12 and 13 show an alternative release actuator assembly 320 for use with the release lever 52 of the latch assembly 10 or the release assembly 151 of the latch assembly 110. In this case, a solenoid housing 322 includes a solenoid coil 324. A cylindrical solenoid core 326 is connected to a generally rectangular plate 328. The rectangular plate 328 is spaced from the top of the solenoid housing 322 by two ball bearings 330. Each ball bearing 330 engages a respective ramp 332 formed in the underside of the rectangular plate 328. When the solenoid coils 324 are electrically powered, the solenoid coil 324 moves in the direction of an arrow 234. However, because the ball bearings 330 are engaged in the respective ramps 332, the rectangular plate 328 is caused to rotate clockwise (when viewing FIG. 13), thereby disengaging the moveable abutment 374 from the release abutment 65 or 165 as appropriate. The solenoid core 326 and the rectangular plate 328 are returned to the start position shown in FIG. 13 by an appropriate spring (not shown, but functionally equivalent to the spring 73 and the spring 273) such that the moveable abutment 374 reengages the abutment 65 and 165 once the crankshaft position has been reset, prior to closing the latch. A stop (not shown but functionally equivalent to the stop 238) limits counter-clockwise rotation of the rectangular plate 328.

It will be appreciated that during rotation of the rectangular plate 328, the rectangular plate 328 moves slightly axially, into the plane of the paper, when viewing FIG. 13. Thus, the width of the plate and the width of the release abutment 65 or 165 is designed to be sufficiently wide to accommodate this slight axial movement.

The release actuator assembly 320 operates in a similar manner to the release actuator assembly 20 during opening and closing of the latch.

Figure 14:
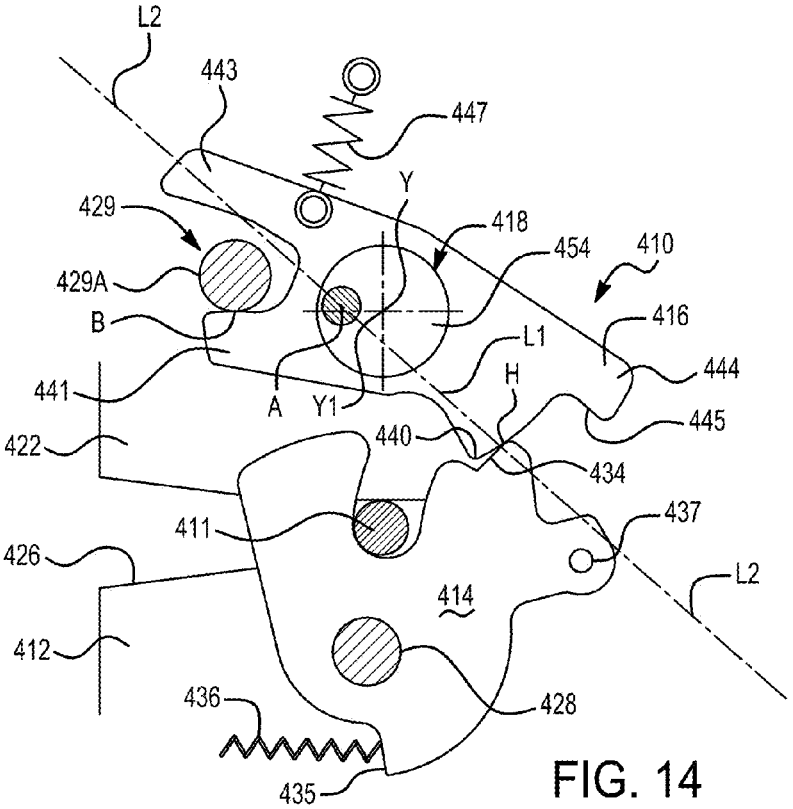
FIGS. 14, 15, and 16 show a further embodiment of a latch assembly according to the present invention.
Figure 15:
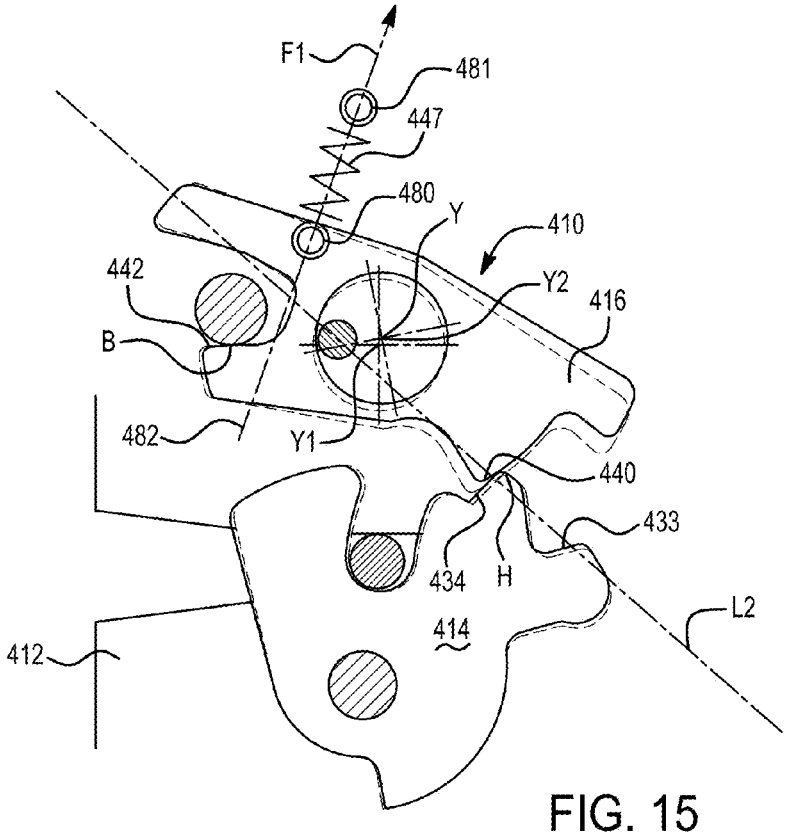
Figure 16:
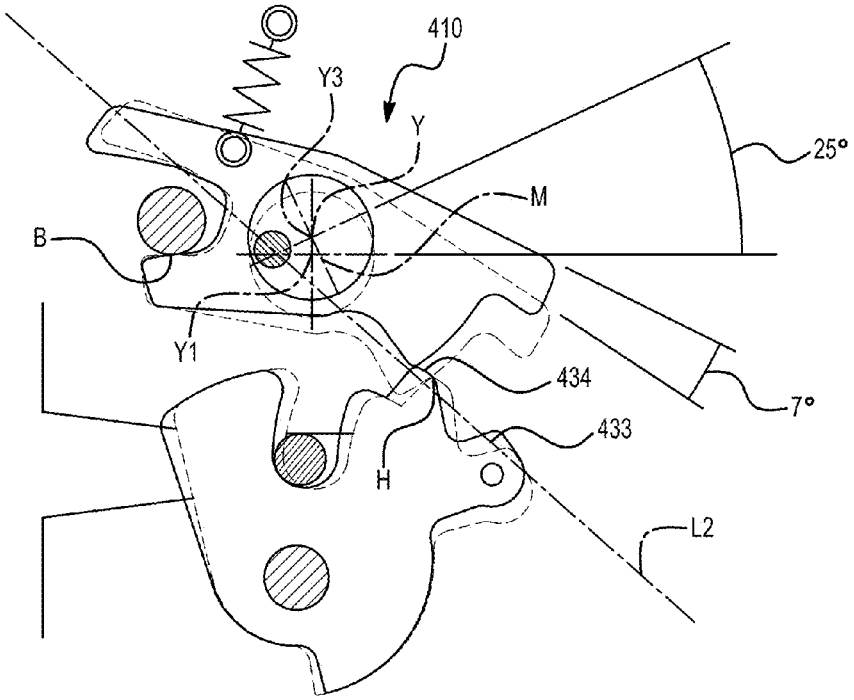

FIGS. 14 to 16 show a further embodiment of a latch assembly 410 with components that fulfil the same function as the equivalent components of the latch assembly 10 labelled 400 greater. Other than the operation of the spring 447, the latch assembly 410 includes similar components to the latch assembly 10 to enable it to operate in the same way as the latch assembly 10.

FIG. 14 shows the latch assembly 410 in its closed position. FIG. 15 shows the latch assembly starting to open, and FIG. 16 shows the position at which the pawl tooth 440 has cleared the tip of the closed abutment 434. Thus, at the FIG. 16 position, there is nothing preventing a latch bolt from opening fully to release the striker 411.

Consideration of FIGS. 14, 15 and 16 show that generally speaking the movement of the pawl (which is a compression pawl) can be approximated to rotation about the contact point B between the cylindrical outer surface 429A and the abutment surface 442 of the first arm 441. However, the movement is not truly rotational since a part of the pawl (namely the pawl axis Y) is constrained to move in an arc about the crankshaft axis A rather than in an arc about point B. Thus, the movement of the pawl at contact point B relative to the stop pin 429 is a combination of rotational movement and translational (sliding) movement. Indeed, the contact point B is not stationary and will move a relatively small distance around the cylindrical outer surface 429A. Thus, it will be appreciated that starting at the FIG. 14 position, the contact point B moves in a counter-clockwise direction around the cylindrical outer surface 429A of the stop pin 429.

Consideration of FIGS. 14 to 16 shows that, starting in the FIG. 14 position, the rotating claw 414 only ever rotates in a counter-clockwise direction during the release of the striker 411. This is because once the moveable abutment (not shown, but the equivalent of the abutment 74) has disengaged from the release abutment (not shown, but the equivalent of the release abutment 65) of the release lever (not shown, but the equivalent of the release lever 52), then it is the claw 414 that drives the pawl from the FIG. 14 position, through the FIG. 15 to the FIG. 16 position. The claw 414 in turn is driven from the FIG. 14 position through the FIG. 15 position to the FIG. 16 position and then onto the fully open position primarily by the striker 411, but also by the spring 436 (shown schematically).

A significant difference between the latch assembly 410 and the latch assembly 10 is the positioning of the spring 447 when compared with the spring 47. The spring 447 is a tension spring that acts between the pin 480 which is secured to the pawl 416 and the pin 481 which is secured to the latch chassis 412. The spring 447 creates a force F1 which acts at the pin 480 in the direction shown in FIG. 15. For ease of explanation, a dotted line 482 has been drawn on FIG. 15 simply as an extension of the line defined by force F1.

As mentioned above, during opening, the pawl 416 generally rotates about the point B. It can be seen that the line defined by force F1 and its extension line 482 are offset from the point B and hence the force F1 creates a counter-clockwise turning moment on the pawl 416 about the pivot B. Thus, the spring 447 assists in moving the pawl 416 from the FIG. 14 position through the FIG. 15 position to the FIG. 16 position during opening of the latch. In particular, once the pawl tooth 440 has cleared the closed abutment 434 (as shown in FIG. 16), then there is no tendency for the pawl tooth 440 to momentarily reengage and then release from the first safety abutment 433. This is in contrast to the pawl and claw interaction, described above, in relation to latch assembly 10 during opening.

During the final part of opening of the claw 414, the crankshaft assembly 418 is reset such that the crank pin axis Y returns to its FIG. 14 position (Y1). This resetting occurs in a similar manner to the resetting of the crank shaft assembly 18 as described above and in summary, the reset pin 437 moves a reset lever (not shown but the equivalent of the arm lever 60) in order to rotate the crank shaft back to its FIG. 14 position and returning the release lever (not shown but the equivalent of the release lever 52) to the position where it is engaged by a moveable abutment (e.g., the abutment 74, or the abutment 174, or the abutment 234, or the abutment 336).

As mentioned above, once the latch and associated door has been opened, the closing of the door will automatically relatch a latch. Significantly, no rotation of the crank shaft occurred during closing of the door. Accordingly, the crank pin axis does not rotate and as such the crank pin itself acts (during closing) as a simple pivot having a fixed axis Y1.

It will be appreciated from FIG. 15 that the line defined by force F1 and the associated extension line 482 is offset from Y1 and thus, during closing of the latch, the pawl rotates about axis Y1 (as opposed to the point B during opening of the latch), and the force F1 created by the spring 447 creates a clockwise turning moment on the pawl 416 about the axis Y1. This turning moment ensures that the pawl tooth 440 properly engages the first safety abutment 433 and the closed abutment 434 as appropriate.

In summary then, the spring 447 is arranged so as to create a force that acts on the pawl 416 at a particular point and in a particular direction. This force has dual benefits of a) creating a counter-clockwise torque about point B during opening of the latch, thereby assisting in releasing the pawl tooth 440 from the claw 414, and b) creating a clockwise torque about point Y1 during closing of the latch, thereby ensuring the pawl tooth 440 reengages the first safety abutment or the closed abutment as appropriate on the claw 414.

Thus, the spring 447 can be contrasted with the spring 47 which, during closing of the latch assembly 10, ensures the pawl tooth 40 engages the first safety abutment or the closed abutment as appropriate on the claw 14 but, during opening of the latch assembly 10, does not assist in releasing the pawl tooth 40 from the claw 14.

It will be appreciated that during opening of the latch the claw 414 and the pawl 416 both rotate in the same direction, in this case they both rotate in a counter-clockwise direction. When considering FIG. 14, it will also be appreciated that that portion of the pawl 416 situated between the closed abutment 434 and the crank pin 454 is under compression. Furthermore, Y1 is situated closer to pawl tooth 440 and the closed abutment 434 than the crank shaft axis A. Thus, as shown in FIG. 14 the pawl 406 can be said to be near (but not at) a "top dead center" position. This can be contrasted with the arrangement shown in FIG. 4 of U.S. Pat. No. 5,188,406 which shows a compression pawl at a bottom dead center position.

As mentioned above, during opening, the claw 414 and the compression pawl 416 both rotate in the same counter-clockwise direction. It will also be appreciated that during opening, the crank shaft assembly 418 also rotates in the same counter-clockwise direction.

It can be seen from FIG. 14 that pawl is in the engaged position and the latch bolt is in the closed position and a point of contact H is defined where the pawl contacts the claw. A line L1 can be constructed starting at point H and ending at the crank shaft axis A. Line L2 is coincident with line L1 and is constructed at a line that passes through point H and the crank shaft axis A. Line L2 has also been constructed from FIGS. 15 and 16. Note that line L2 passes through point H on FIGS. 15 and 16 and point H is defined as the point of contact between the pawl and claw when the latch arrangement is in the closed position as shown in FIG. 14. Thus, line L2 passes through the point of contact between the chain dotted pawl and chain dotted claw on FIGS. 15 and 16. Consideration of FIG. 14 shows that the pawl axis Y is spaced to one side of lines L1 and L2, in this case it is spaced on the upper right hand side of lines L1 and L2. Consideration of FIGS. 14, 15 and 16 show that during opening, the pawl axis Y defines a locus starting at the FIG. 14 position and ending at the FIG. 16 position and this locus is an arc centered on the crank shaft axis A. It will be appreciated that the locus M (shown on FIG. 16) starts at point Y1 (FIG. 14), passes through point Y2 (FIG. 15) and ends at point Y3 (FIG. 16). Locus M does not cross line L1 or L2.

Furthermore, when considering FIGS. 15 and 16, it will be appreciated that the instant crank pin axis Y2 and Y3 are spaced further away from lines L1 and L2 than the position of the crank pin axis Y1 when the latch is fully closed.

Furthermore, the instant position of the crank pin axis Y3 (as shown in FIG. 16) is spaced further away from lines L1 and L2 than the instant position of the crank pin axis Y2 (as shown in FIG. 15). Thus, during opening of the latch, and in particular during initial opening of the latch, the pawl axis Y moves away from the lines L1 and L2.

It can also be seen from FIG. 14 that the distance between the crank shaft axis A and the point B is greater than a distance between the crank shaft axis A and the pawl axis Y.

Figure 17:
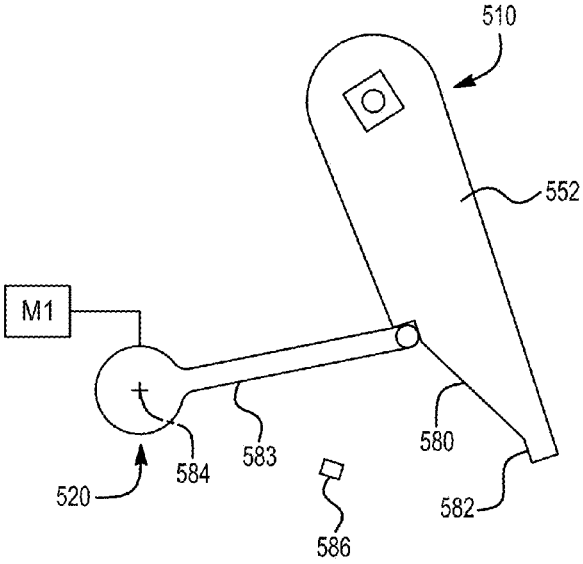
FIGS. 17 and 18 show a further embodiment of a latch assembly according to the present invention.
Figure 18:
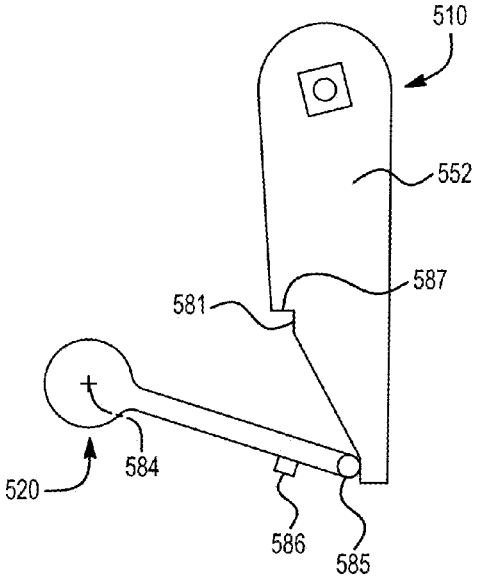

FIGS. 17 and 18 show a latch assembly 510 similar to the latch assembly 10. In this case, the lever 552 includes a ramp surface 580 having an end abutment 581 and 582. The arm 583 is pivotable about a pivot 584 and includes a roller 585 on the end of the arm remote from the pivot 584. The arm 583 can be driven in a clockwise direction from the FIG. 17 position to the FIG. 18 position by a motor M1 (shown schematically) to unlatch the latch. A stop 586 prevents the arm moving past the FIG. 18 position.

The motor M1 can also drive the arm in a counter-clockwise direction from the FIG. 18 position to the FIG. 17 position. The stop 587 is formed on the lever 552 and acts to prevent the arm 583 moving past the FIG. 17 position.

In use, the lever 552 is used in place of the release lever 52 of the latch assembly 10. The arm 583 and the stop 586 replace the release actuator assembly 20 of the latch assembly 10. The other components of the latch assembly 510 are identical to the equivalent components of the latch assembly 10 other than the latch assembly 510 does not require the reset components of the latch assembly 10. Thus, the latch assembly 510 does not include a reset lever equivalent to the reset lever 51 of the latch assembly 10, nor does it include a reset pin equivalent to the reset pin 37 of the latch assembly 10. This is because the lever 552 acts to both release the latch and also to reset the crankshaft.

The resetting of the crank shaft position in the latch assembly 510 is carried out by the arm 83 and its associated motor in conjunction with the lever 552.

Thus, FIG. 17 shows the latch in a closed position, similar to the closed position of the latch assembly 10 shown in FIG. 1B. The lever 552 is prevented from rotating in a clockwise direction by the arm 583. In order to open the latch, the motor M1 drives the arm 583 in a clockwise direction so that it pivots about the pivot 584 and moves to the FIG. 18 position. This in turn allows the lever 552 to rotate clockwise to the FIG. 18 position to allow the latch to open. The position of the lever 552 as shown in FIG. 18 is in an equivalent position to the release lever 52 as shown in FIG. 2. Once the latch is opened, i.e., the claw has moved to its opened position, the motor M1 is powered to drive the arm 583 in a counter-clockwise direction. This causes the roller 585 to run along the ramp surface 580 and drive the lever 552 in a counter-clockwise direction to return it to the FIG. 17 position. Typically, a micro switch acted upon by the claw 514 when the claw 514 reaches the open position will be used to sense when the claw 514 is opened, and hence when the motor M1 can be powered in the reverse direction to reset the crank shaft. Subsequent closing of the latch assembly 510 will cause the pawl 516 to pivot about the pawl axis and engage the first safety abutment or the closed abutment as appropriate, as described above in relation to the latch assembly 10.

Figure 19:
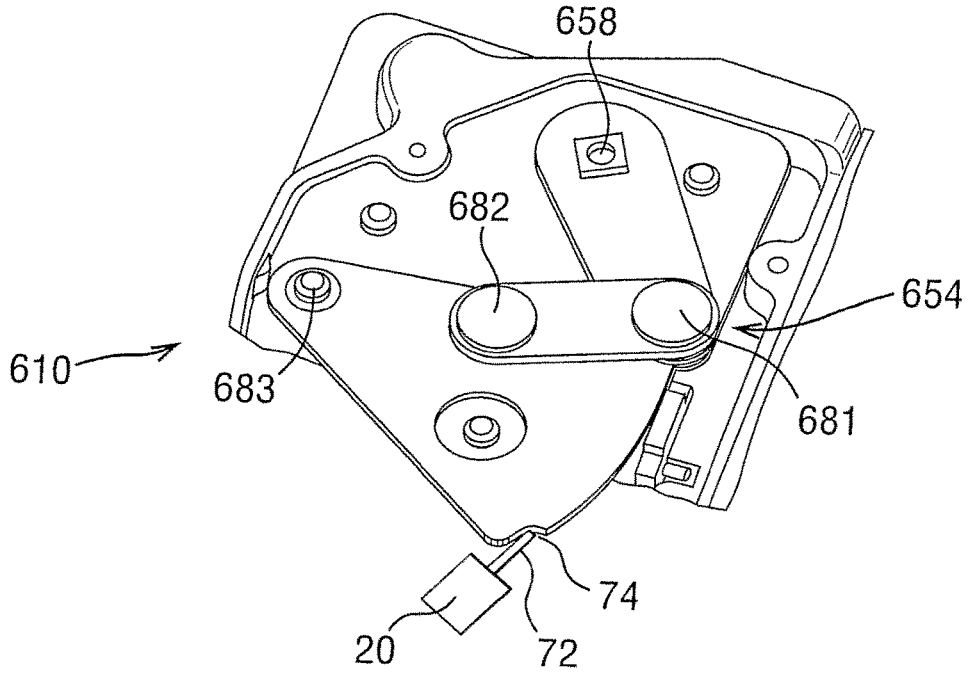
FIGS. 19 and 20 show a further embodiment of a latch assembly according to the present invention.
Figure 20:
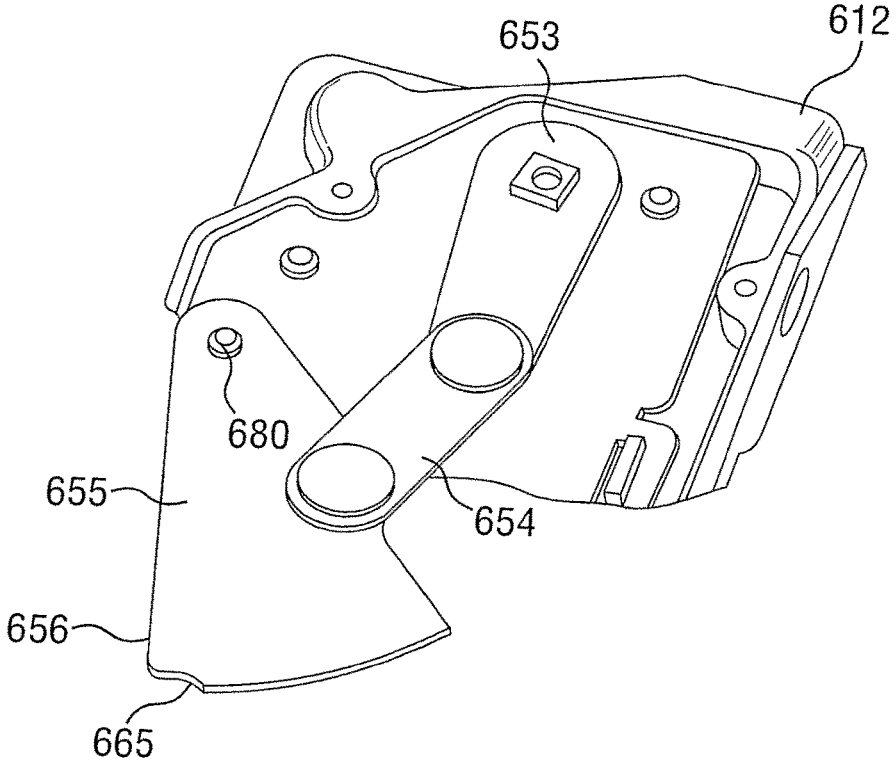

FIGS. 19 and 20 show an alternative release arrangement 652 that can be used to replace the release lever 52 of the latch assembly 10 or the release lever 152 of the latch assembly 110. The release arrangement consists of three major components, namely the lever 653, the link 654 and the lever 655. The lever 653 includes a square hole 664 (similar to the square hole 64). The square hole 664 is mounted on the square shaft 658 in the manner similar to the square hole 64 being mounted on the square shaft 55. Thus, the lever 653 is rotationally fast with the crank shaft.

The lever 655 is pivotally mounted on the pivot pin 680, which in turn is secured to the latch chassis 612. The lever 655 includes a release abutment 665 which is the equivalent of release abutment 65 of the latch assembly 10 and the equivalent of the release abutment 165 of the latch assembly 110.

The link 654 is pivotally mounted to the lever 653 and is also pivotally mounted to the lever 655. The latch assembly 610 includes the release actuator assembly 20 (shown schematically in FIG. 19). It will be seen that the abutment 74 of the release plate 72 is presented opposite to the release abutment 665 when the latch is in the closed position as shown in FIG. 19. To release the latch, the abutment 74 is pivoted out of the path of the release abutment 665 (as described above in respect of the manner in which the abutment 74 of the latch assembly 10 is pivoted out of the path of the release abutment 65), thereby allowing the lever 655 to pivot to the position shown in FIG. 20.

It will be appreciated that, starting from the FIG. 19 position, once the abutment 74 has been pivoted out of the path of the release abutment 665, it is the lever 653 which pushes the link 654, which in turn causes the lever 655 to rotate to the FIG. 20 position.

The lever 653 and the link 654 together define a pivot axis 681. The link 654 and the lever 655 together define a pivot axis 682. The pivot pin 680 defines a pivot axis 683 about which the lever 655 pivots. Consideration of FIG. 19 shows that the pivot axis 682 is situated below (when viewing the figure) a straight line joining the pivot axis 683 and the pivot axis 681. Because the pivot axis 682 lies below the line (rather than on the line or above the line), then as soon as the abutment 74 is moved out of the path of the release abutment 665, the latch automatically opens. It will be appreciated from FIG. 19 that the link 654 and the lever 655 are near (but not at) a "top dead center" position.

Clearly, in further embodiments, the release actuator assembly 20 could be replaced by the release actuator assembly 120 or the release actuator assembly 220 or the release actuator assembly 320.

In a yet further embodiment, the profile of the edge 656 of the lever 655 could be adapted to provide a ramp surface, end abutments and stops equivalent to items 580, 581, 582 and 587 of the latch assembly 510. With this modification, the motor M1, the arm 583 and the stop 586 of the latch assembly 510 could be used to both release and reset the latch assembly 610. Such an arrangement clearly would not require components the equivalent of the reset lever 51 or the reset pin 37.

FIGS. 21 to 30 show a further embodiment of a latch assembly 710 in which components that fulfil substantially the same function as shown in the latch assembly 10 are labelled 700 greater.

In this case, the latch assembly 710 does not have the equivalent of the stop pin 30. The counter-clockwise rotation of the compression pawl 716 is limited as will be further described below. As such, the pawl 716 does not include a third arm equivalent of the third arm 44 of the pawl 16. The reset lever 751 is integrally formed with the release lever 752. In this case, the reset lever 751 and the release lever 752 are formed on a generally planar component having a square hole which engages the square shaft 755 to ensure that both the reset lever 751 and release lever 752 are rotationally fast with the crank shaft. A boss (not shown, but the equivalent of the boss 61) is attached to the combined reset lever 751 and the release lever 752 and projects into the plane of the paper when viewing FIG. 21. Accordingly, the boss is hidden behind the combined release lever 752 and the reset lever 751. The cylindrical outer surface of the boss acts to provide a bearing surface for the crank shaft assembly.

The moveable abutment 774 is pivotable about a moveable abutment axis W, and a stop pin 780 limits counter-clockwise rotation of the moveable abutment 774. A further stop pin 781 limits clockwise rotation of the crank shaft by engagement with the release lever 752 (see FIG. 24). Both the springs 736 and 747 are torsion springs (as opposed to the compression springs 36 and 47).

Operation of the latch assembly 710 is as follows.

In summary, the pawl 716 of the latch assembly 10 is a compression pawl, i.e., that part of the pawl 716 that transmits the force FP from the claw to the crank pin axis Y is under compression (the pawls 16, 116 and 416 are similarly compression pawls). The latch assembly 710 is arranged such that the position of the crank shaft is reset upon opening of the latch.

Figure 21:
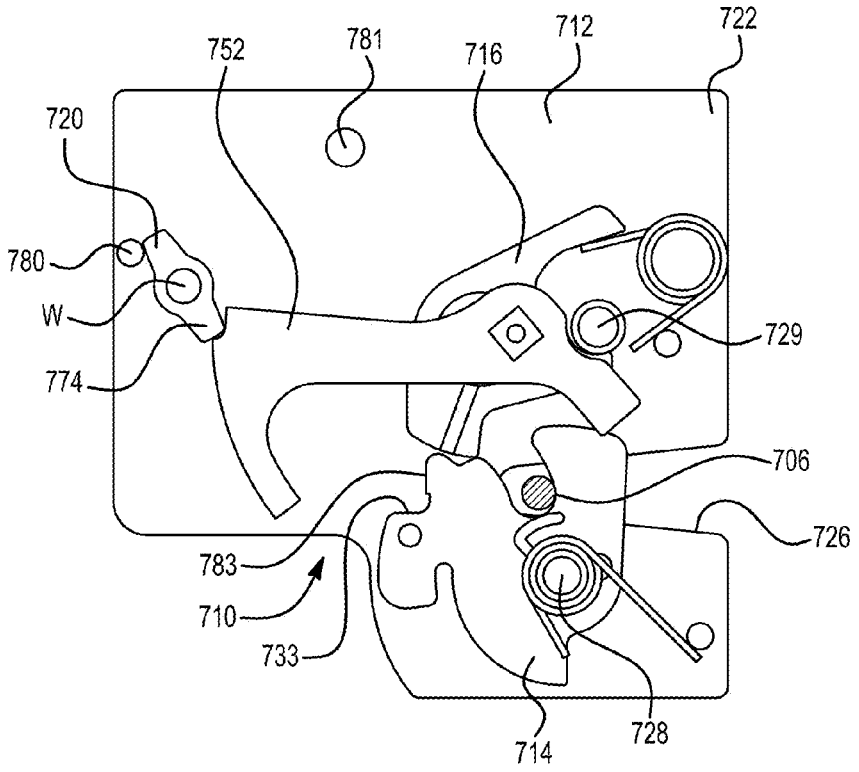
FIGS. 21, 22, 23, 24, 25, 26A, 26B, 27A, 27B, 28, 29 and 30 show a further embodiment of a latch assembly according to the present invention.

In more detail, FIG. 21 shows the latch assembly 710 in a closed position wherein the claw 714 is in a closed position, thereby retaining the striker 706. The claw 714 is held in this closed position by the pawl 716. The crank shaft is held in a stationary position by virtue of the moveable abutment 774 engaging the release abutment 765 of the release lever 752. Thus, as shown in FIG. 21, the force FS generated by the striker 706 produces a force FP (see FIG. 30) which creates a turning moment on the crank shaft assembly in a clockwise direction about the crank shaft axis A. This turning moment is reacted by the moveable abutment 774 so as to prevent the movement of the crank shaft arrangement.

Figure 22:
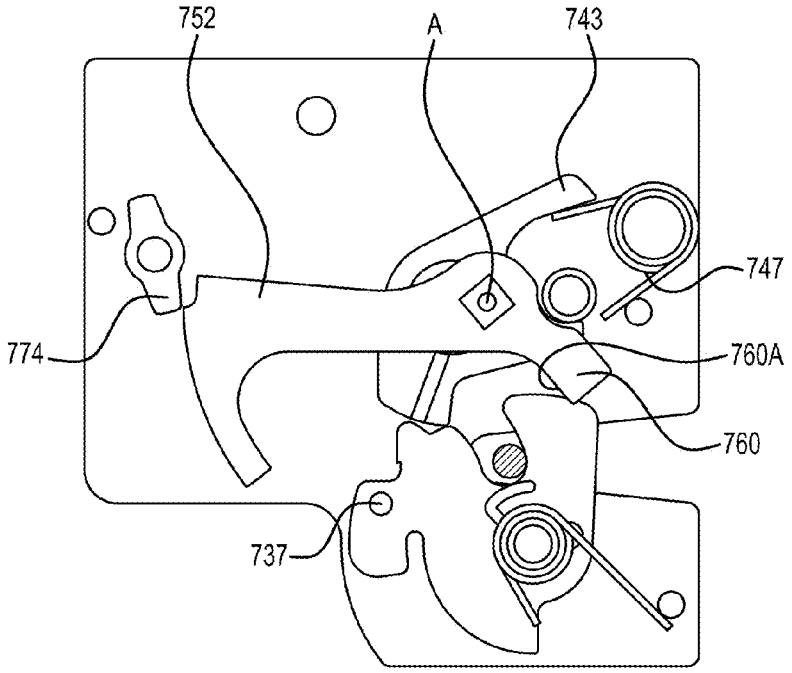

FIG. 22 shows the moveable abutment 774 having been disengaged from the release abutment 765 so that the above mentioned turning moment is no longer reacted, thereby allowing the force FP to move the eccentric arrangement in a clockwise direction about the crank shaft axis A such that the pawl moves to the disengaged position (FIG. 23), thereby allowing the claw 714 to move to the open position (FIGS. 26A and B), thereby releasing the striker 706 such that the latch is opened.

Figure 23:
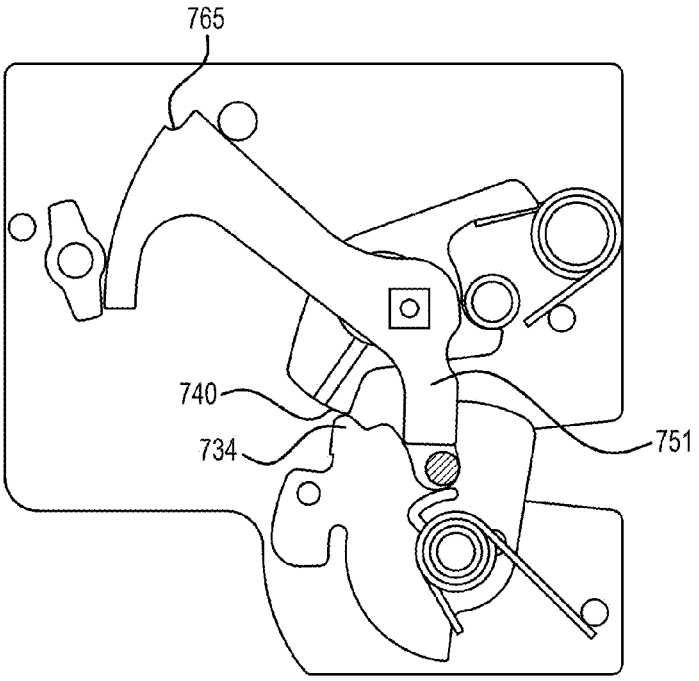

In FIG. 23, the force FP has caused the crank shaft to rotate clockwise (as witnessed by the clockwise rotation of the combined release lever 752 and the reset lever 751 which are rotationally fast with the crankshaft). Furthermore, the pawl 716 has started to rotate clockwise such that the pawl tooth 740 has just cleared the closed abutment 734. In particular, it will be appreciated that the claw has rotated slightly in a clockwise direction in FIG. 23 when compared with FIG. 22.

Figure 24:
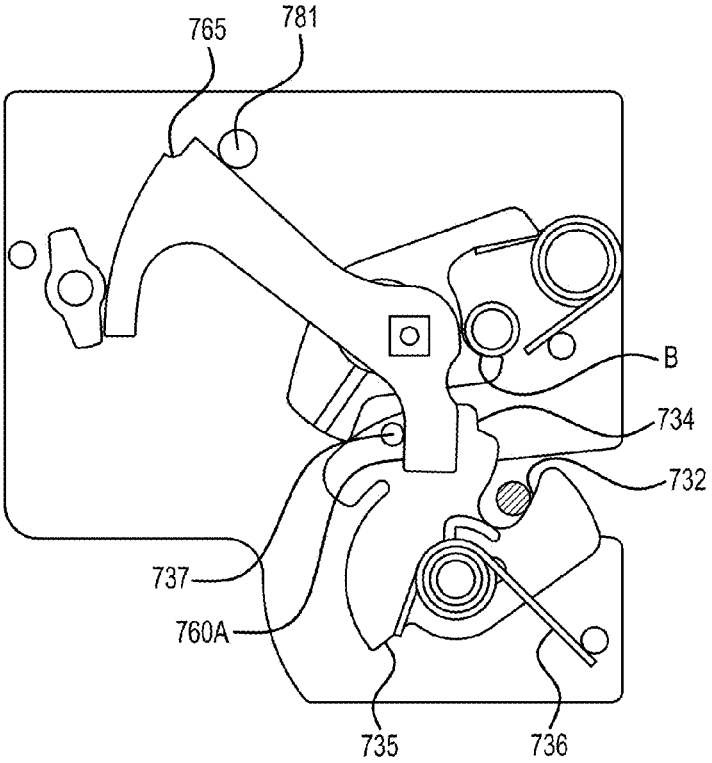
Figure 25:
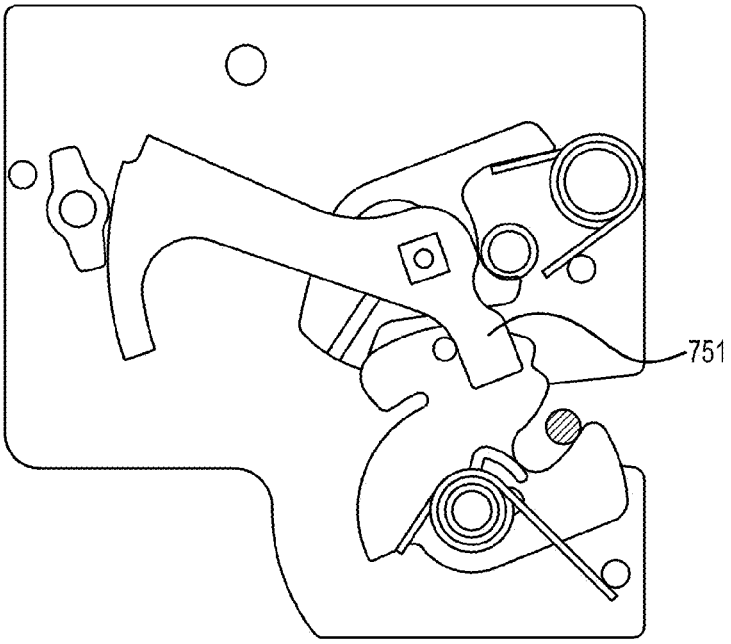
Figure 26A:
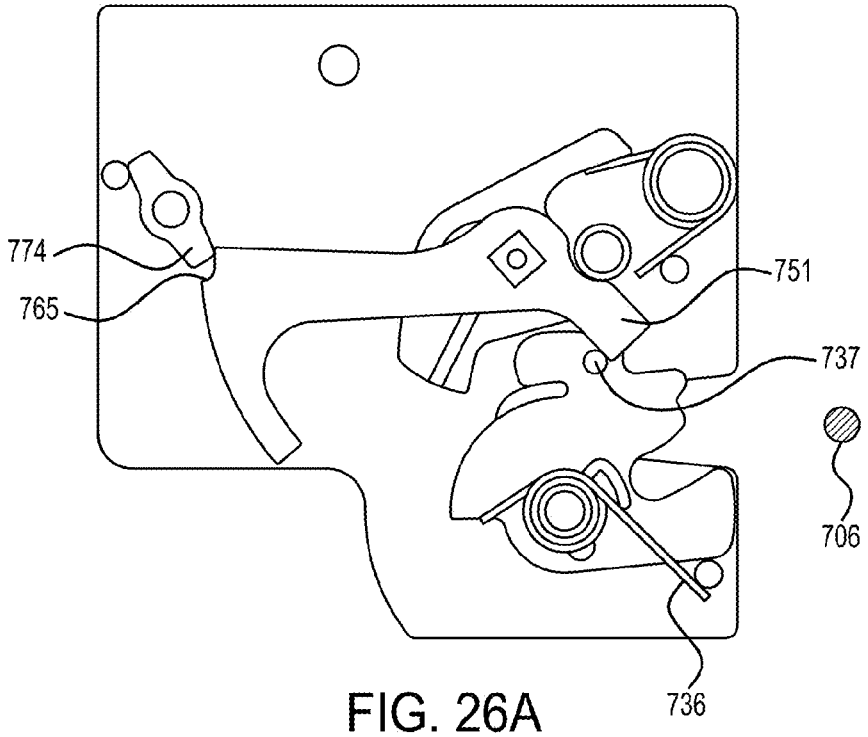
Figure 26B:
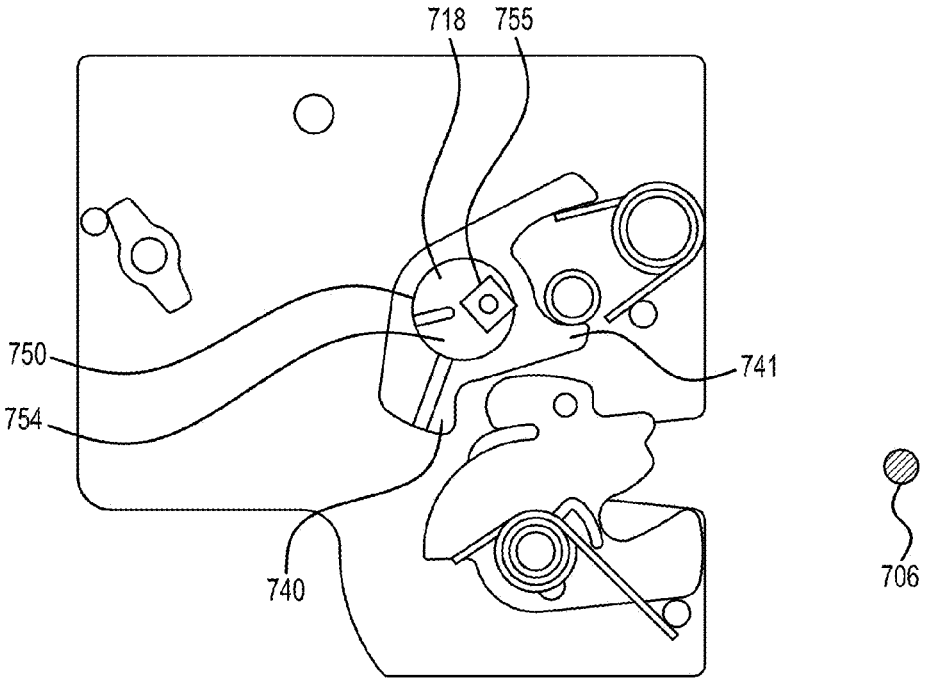

As shown in FIG. 23, there is nothing to prevent release of the striker, which therefore causes the claw to rotate in a clockwise direction through the FIG. 24 and FIG. 25 positions to the FIG. 26A position. The spring 736 assists in rotating the claw to the FIG. 26A position. However, during the movement of the claw from the FIG. 23 to the FIG. 26A position, resetting of the crank shaft position occurs as follows.

As shown in FIG. 24, the reset pin 737 has just engaged the edge 760A of the reset lever 751. Continued clockwise rotation of the claw causes the reset pin 737 to rotate the reset lever 751 and hence the release lever 752 and the crank shaft 750 in a counter-clockwise direction about the axis A. FIG. 25 shows the reset lever 751 having being partially rotated in a counter-clockwise direction, and FIG. 26A shows the reset lever 751 being fully rotated in the counter-clockwise direction. The spring 736 holds the claw in the FIG. 26A position, and hence the reset pin 737 holds the crank shaft in the position shown in FIG. 26A. In this case, there is a small gap between the moveable abutment 774 and the release abutment 765, and this indicates that the crank shaft has been rotated slightly past the closed position shown in FIG. 21. However, it will be appreciated that the crank shaft has been substantially (or generally) reset to its closed position as shown in FIG. 21.

Figure 27A:
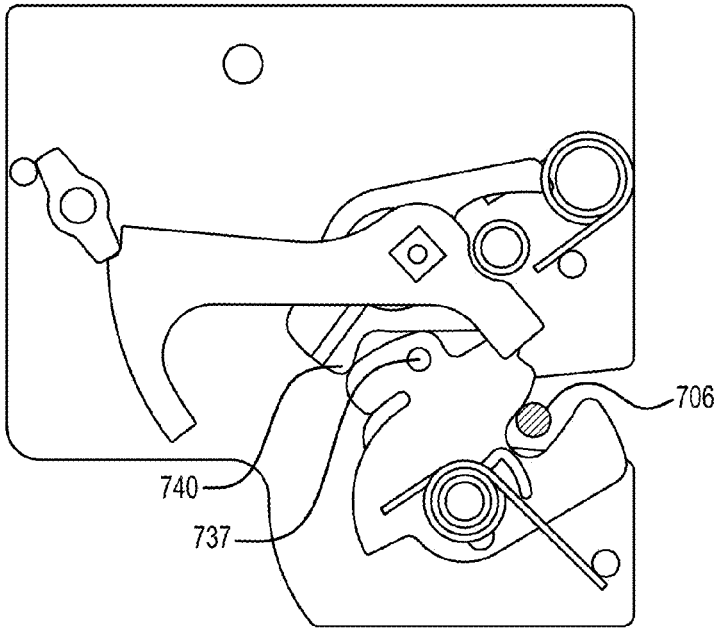
Figure 27B:
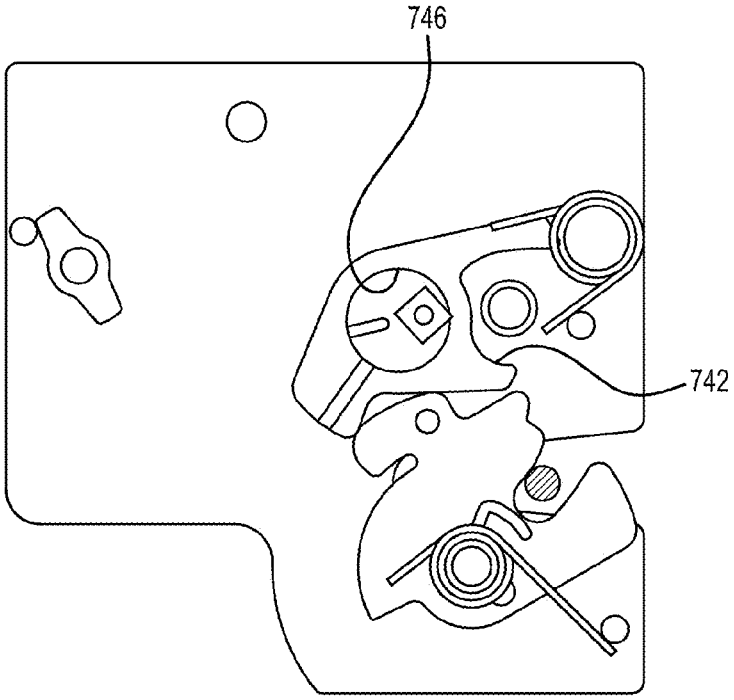
Figure 28:
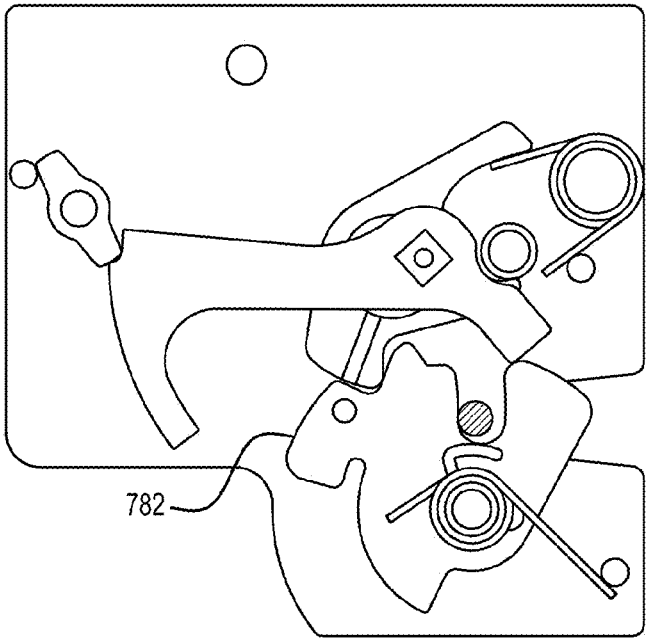
Figure 29:
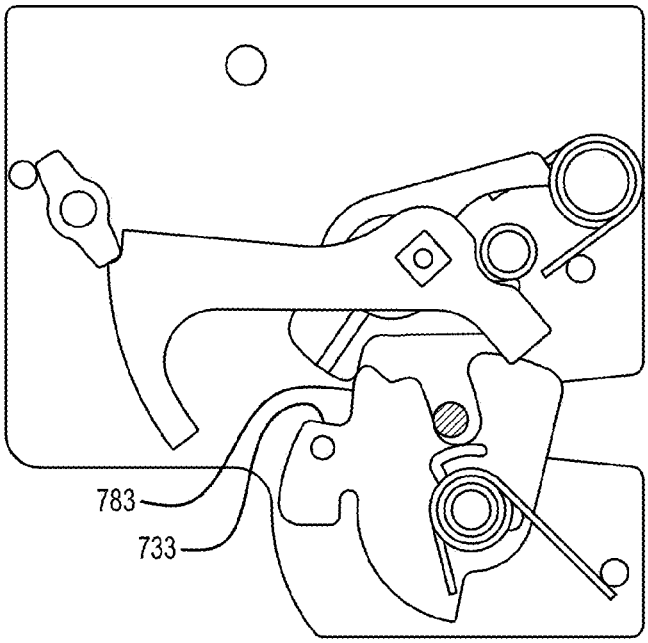
Figure 30:
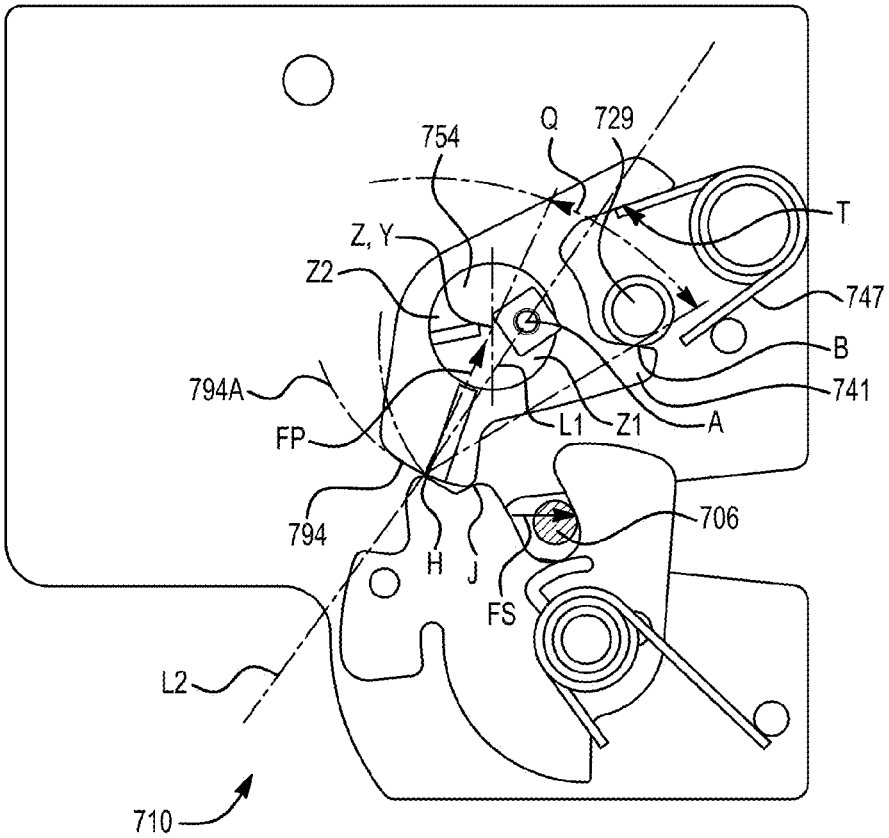

The sequence of events that occur during closure of the latch is shown in FIGS. 27 to 30. Thus, as shown in FIG. 27, the associated door has been partially closed such that the striker 706 has contacted and rotated the claw in a counter-clockwise direction, thus disengaging the reset pin 737 from the edge 760A, thereby allowing the crank shaft to rotate slightly clockwise such that it is positioned in the same position as the closed position as shown in FIG. 21 (note that the gap between the moveable abutment 774 and the release abutment 765 as shown in FIG. 26A has been closed as shown in FIG. 27A). FIG. 27A shows the pawl tooth 740 riding along an edge 782 of the claw, and FIG. 28 shows the pawl tooth in engagement with the first safety abutment 733. Continued closing of the door, and hence rotation of the claw in a counter-clockwise direction, will cause the pawl tooth to ride over the edge 783 of the claw and then engage the closed abutment 734, as shown in FIG. 30.

FIGS. 31 to 40 show a further embodiment of a latch assembly 810 in which components which fulfill substantially the same function as those shown in the latch assembly 10 are labelled 800 greater.

The latch assembly 810 has no component the equivalent of the stop pin 30, and the clockwise rotation of the pawl 816 is limited in a manner that will be described below. An edge 837 of the claw performs the function of the reset pin 37, as will be described further below. The latch assembly 810 includes an arm 841/843 which performs the function of both the arms 41 and 43. The combined reset/release lever 851/852 performs the function of the reset lever 51 and the release lever 52. The latch assembly 810 further includes a link 880, the upper end of which (when viewing the figures) is pivotally connected to the combined reset/release lever 851/852. The lower end of the link 880 is provided with a pin (not shown since it is hidden by the lower end of the link) which projects into the plane of the paper and sits within the guide slot 881. The lower end of the link 880 includes a region which acts as an abutment 882, the purpose of which will be described below.

In summary, the pawl 816 is a tension pawl, since that part of the pawl 816 that transmits the force FP to the crank pin axis Y of the pawl 816 is substantially in tension. Furthermore, the position of the crank shaft is reset to its closed position during the opening of the claw 814.

Figure 31:
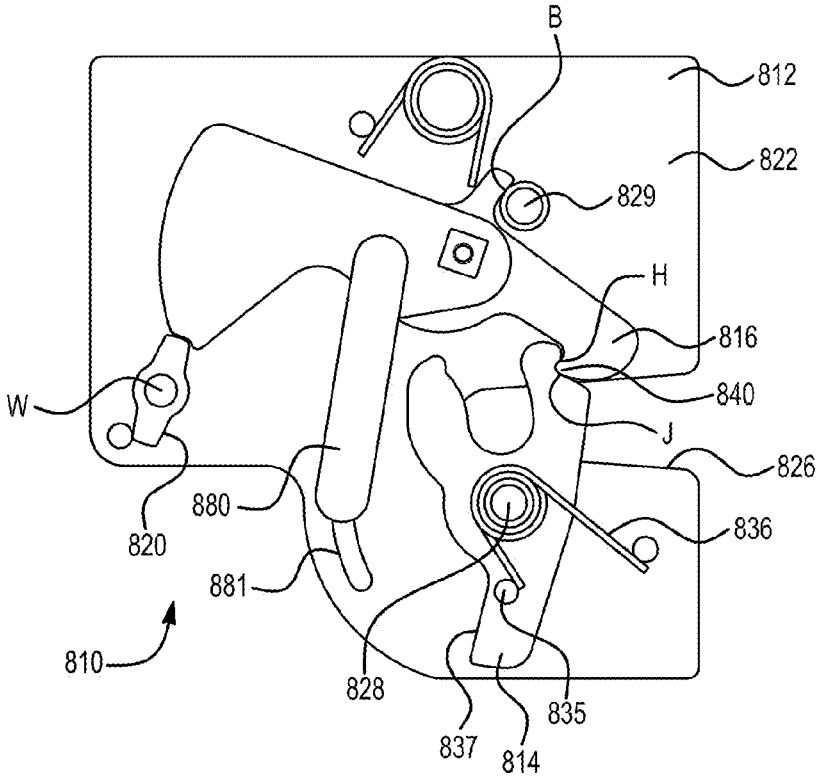
FIGS. 31, 32, 33, 34, 35, 36A, 36B, 37A, 37B, 38A, 38B, 39A, 39B and 40 show a further embodiment of a latch assembly according to the present invention.
Figure 32:
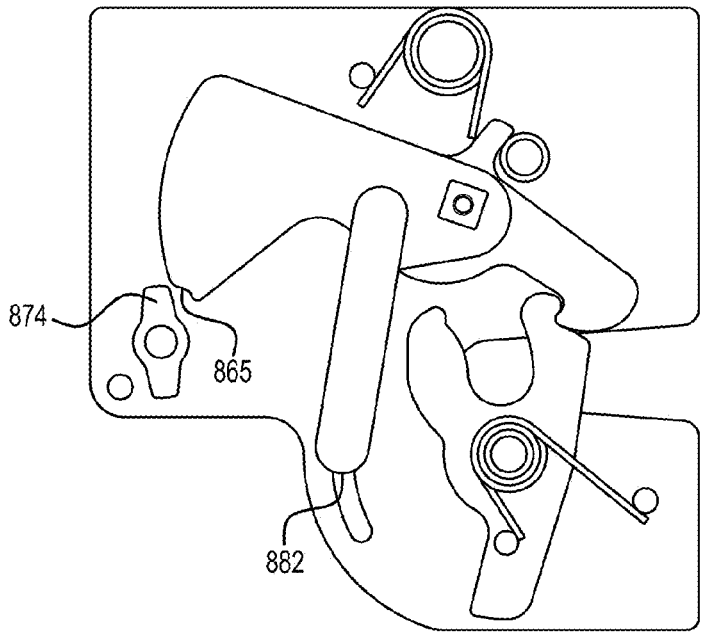
Figure 33:
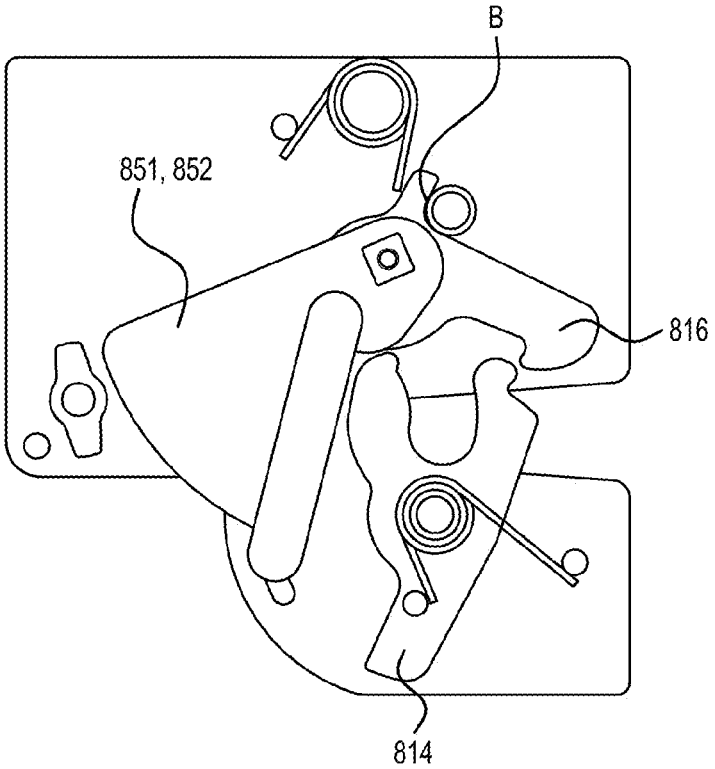
Figure 34:
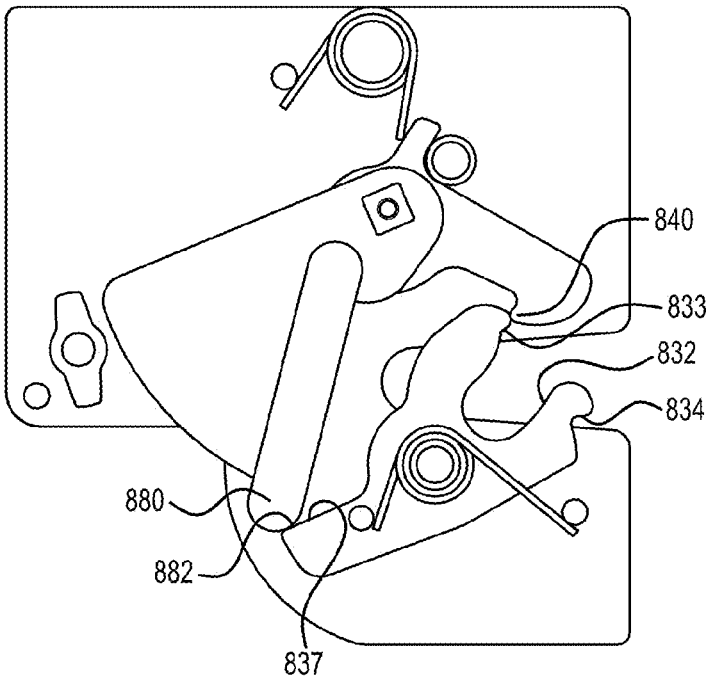
Figure 35:
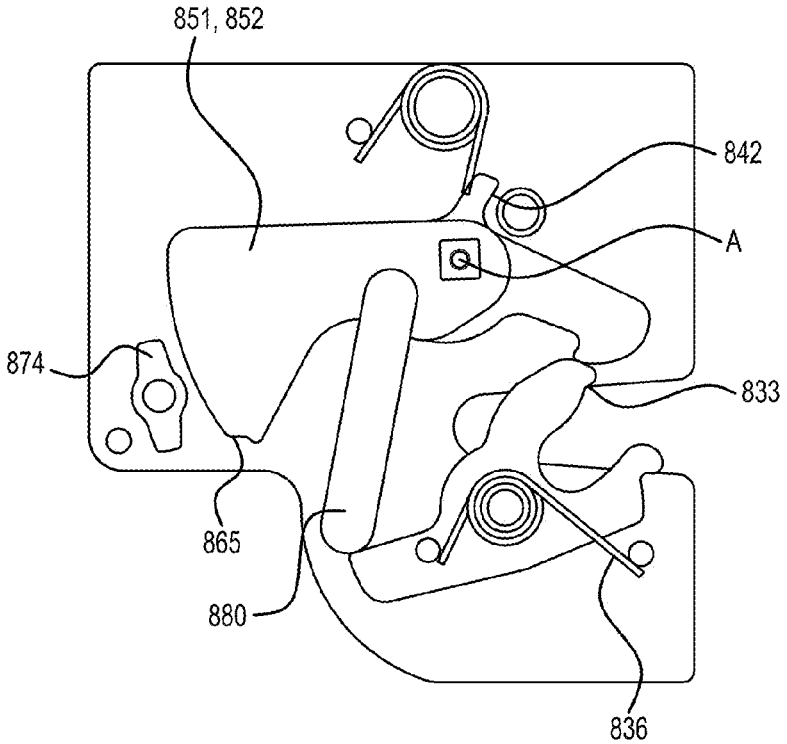
Figure 36A:
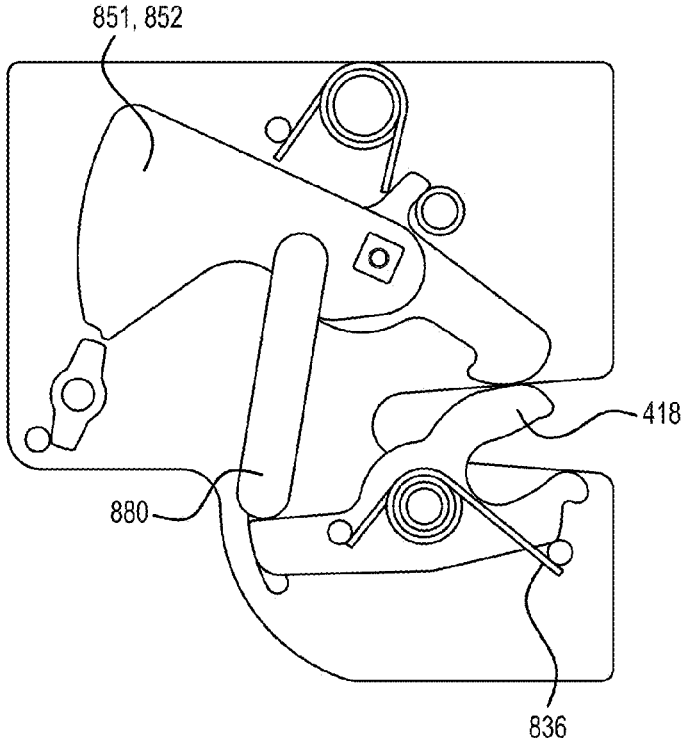
Figure 36B:
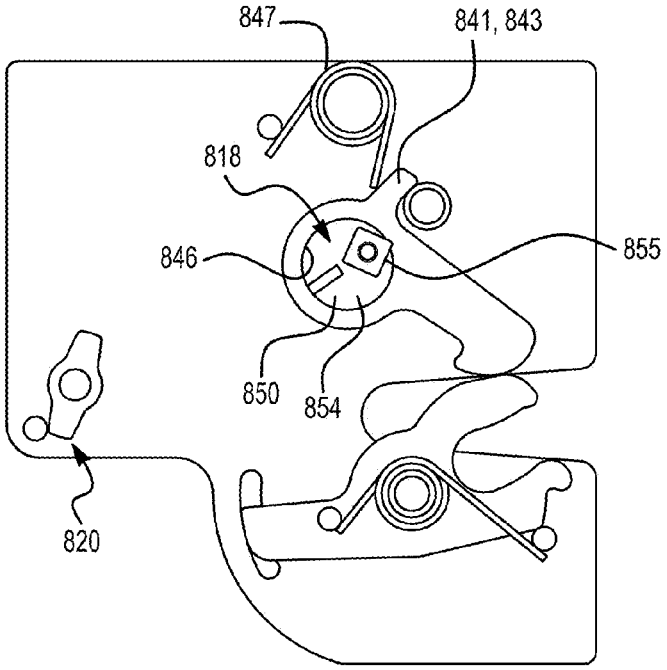
Figure 37A:
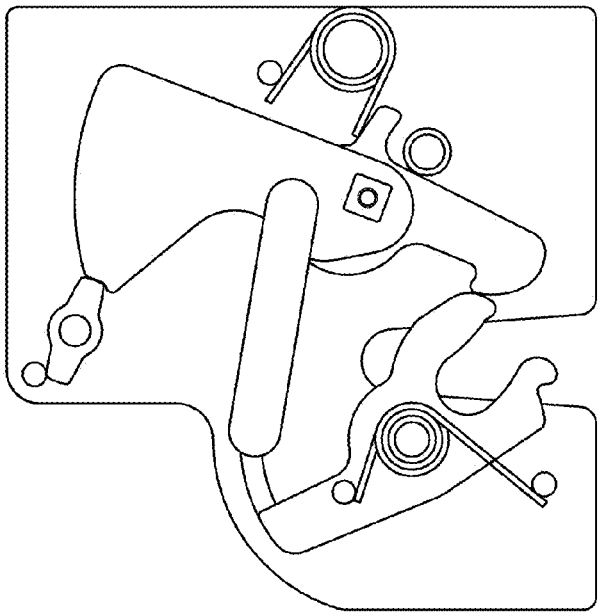
Figure 37B:
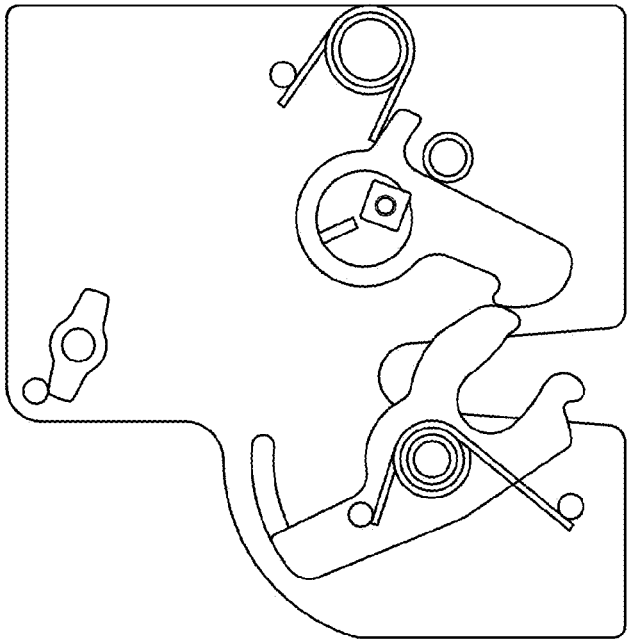
Figure 38A:
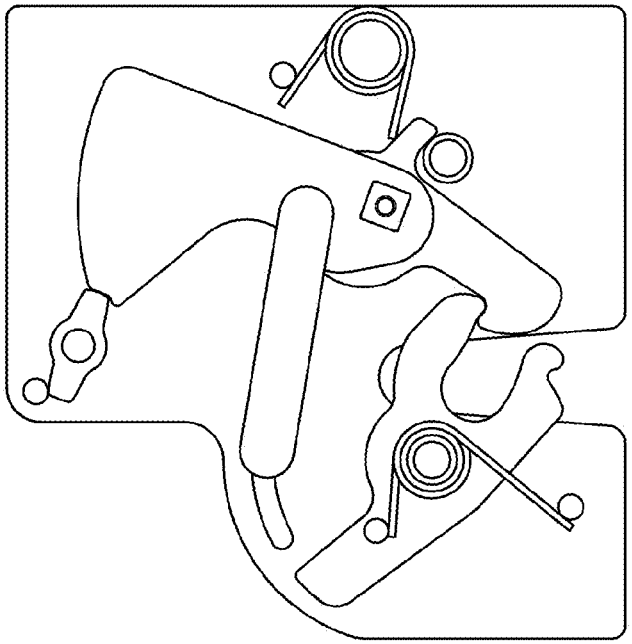
Figure 38B:
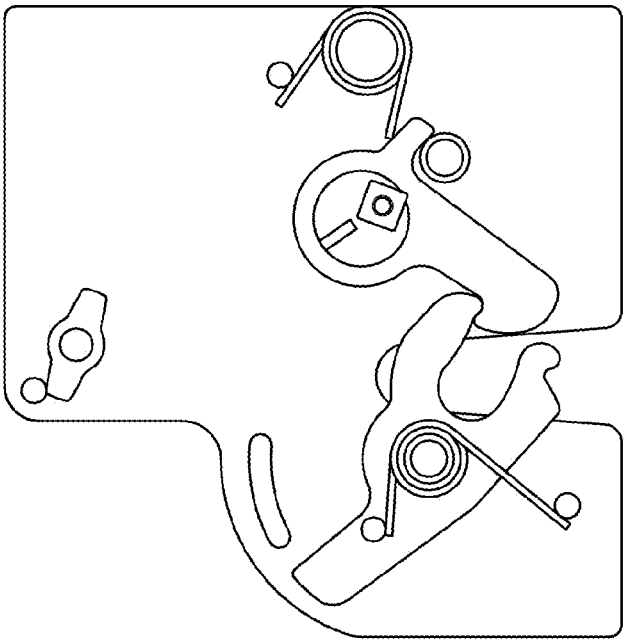
Figure 39A:
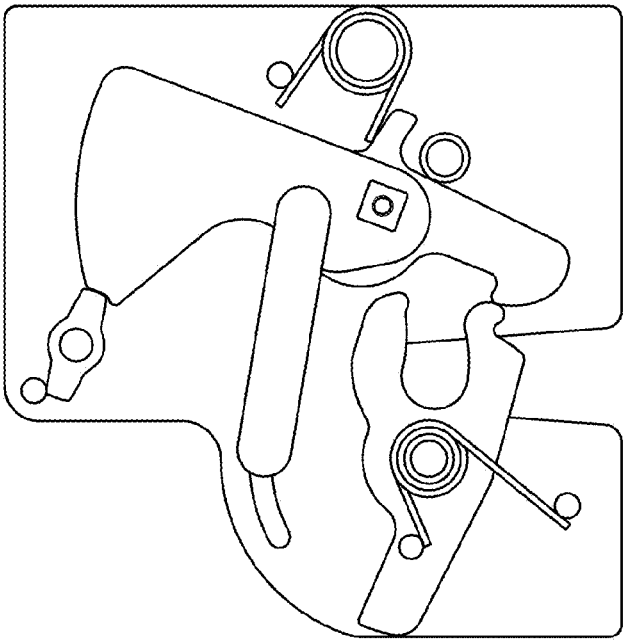
Figure 39B:
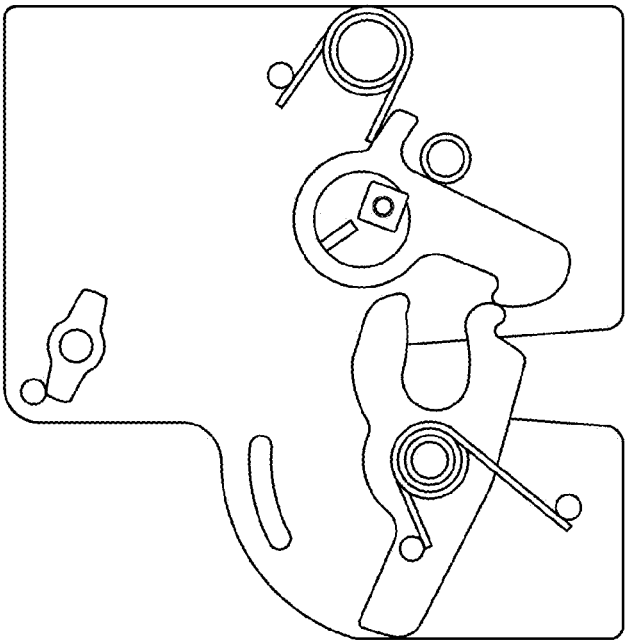

Thus, FIG. 31 shows the latch in a closed position with the pawl tooth 840, preventing the claw 814 from rotating clockwise. The crank shaft is prevented from rotating in a counter-clockwise direction by virtue of engagement between the moveable abutment 874 and the release abutment 865. FIG. 32 shows the moveable abutment 874 has been disengaged from the release abutment 865, and FIG. 33 shows that the claw 814 has started to rotate clockwise in an opening direction and has driven the pawl 816 in a counter-clockwise direction about the point B. The crank shaft has rotated in a counter-clockwise direction, as witnessed by the position of the reset/release lever 851/852. The lower end of the link 880 has moved generally downwards and has been guided by the guide slot 881 to the position shown in FIG. 33. As shown in FIG. 34, the pawl 816 has rotated further clockwise in an opening direction, wherein the first safety abutment 833 has just passed underneath the pawl tooth 840. At this point, the edge 837 has just come into contact with the abutment 882 of the link 880. As shown in FIG. 35, continued rotation of the claw 814 in a clockwise direction, under the influence of the spring 836, causes the edge 837 of the claw 814 to start to lift the link 880 and hence start to pivot the reset/release lever 851/852 (and hence the crankshaft) in a counter-clockwise direction. FIGS. 36A and 36B shows the latch in a fully open condition wherein the claw 814 is biased to the position shown by the spring 836 and hence the link 880 and the reset/release lever 851/852 are held in the position shown. It is apparent that (like the position shown in FIG. 26A) the crank shaft has been reset to a position slightly past that shown in FIG. 31. FIGS. 37A and B show the latch starting to close by virtue of a striker (not shown) starting to rotate the claw in a counter-clockwise direction. At this position, the moveable abutment 874 is engaged with the release abutment 865. Continued closing of the latch causes the latch bolt to rotate in a counter-clockwise direction to the position shown in FIGS. 38A and B. At this point, the claw 814 is in a first safety position. Continued closing of the door moves the components through the position shown in FIGS. 39A and B back to the fully closed position as shown in FIG. 31.

FIGS. 41 to 51 show a latch assembly 910 in which components that fulfill substantially the same function as those shown in the latch assembly 10 are labelled 900 greater.

In this case, the spring abutment/reset pin 925/937 fulfills the function of the spring abutment 35 and the reset pin 37. The reset/release lever 951/952 fulfills the function of the reset lever 51 and the release lever 52.

In summary, the latch assembly 910 includes a compression pawl 916. Whereas on the latch assembly 810 the crank shaft is reset during opening of the latch, in the latch assembly 910 the resetting of the crank shaft occurs during closing of the latch. Whereas the link 880 acted in compression to reset the crank shaft position of latch assembly 810 during opening of the latch, the link 980 acts in tension to reset the crank shaft position of the latch assembly 910 during closing of the latch.

Thus, in detail, the link 880 is pivotally mounted at the pivot 981 to the reset/release lever 951/952. The link 980 is biased in a counter-clockwise direction around the pivot 981 by the spring 982 acting on the abutment 983 of the link 980 and on the abutment 984 of the retention plate 922. At the lower end of link 980 is a hook surface 985, a ramp surface 986 and a lower abutment surface 987. Mounted on the retention plate is a projecting link stop pin 988. Operation of the latch assembly 910 is as follows.

Figure 41:
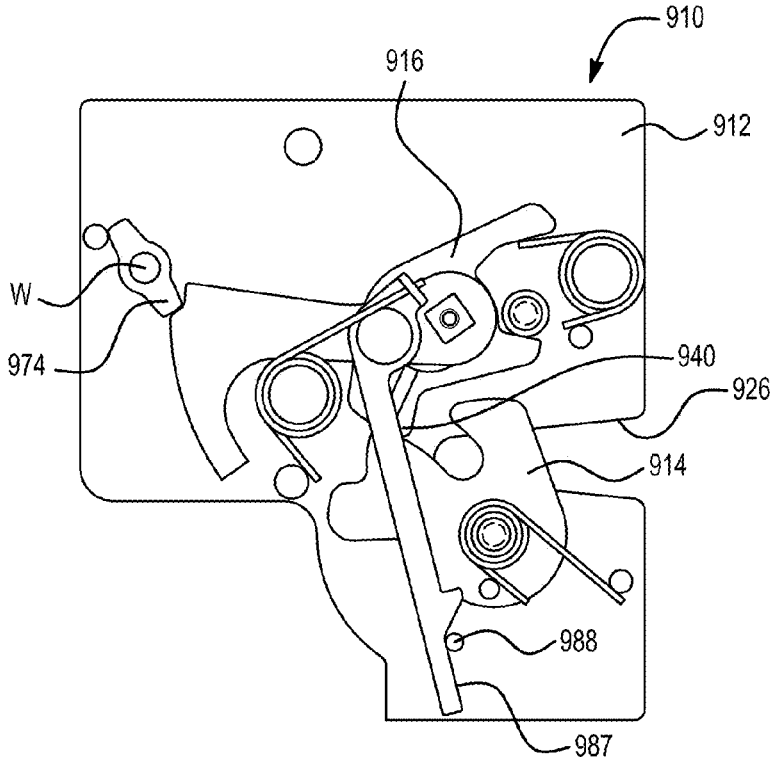
FIGS. 41 to 51 show a further embodiment of a latch assembly according to the present invention.

FIG. 41 shows the claw 914 being held in a closed position by the pawl 916. The crank shaft (not visible but functionally equivalent to crank shaft 50) is held in a fixed position by virtue of engagement between the moveable abutment 974 and the release abutment 965. The spring 982 biases the lower abutment surface 987 into engagement with the link stop pin 988.

Figure 42:
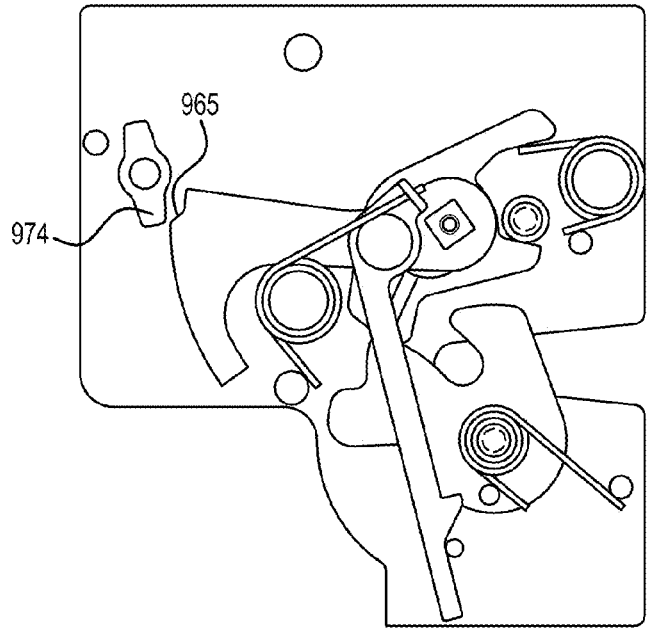
Figure 43:
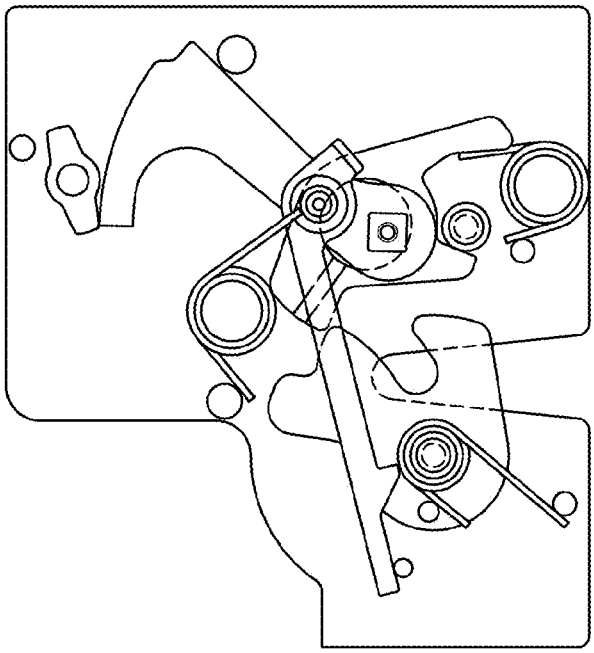
Figure 44:
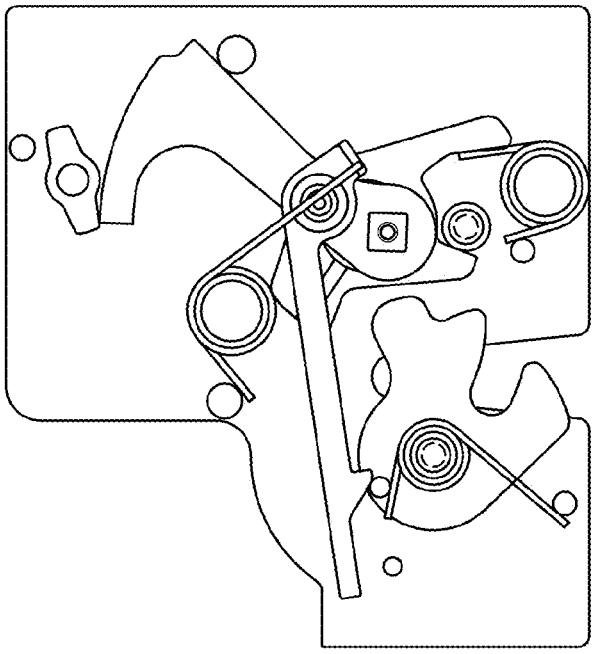
Figure 45:
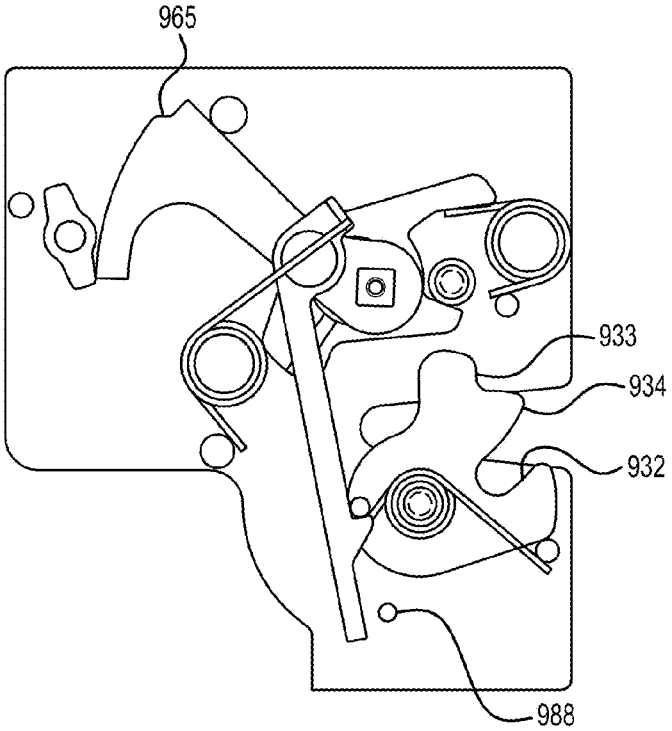

FIG. 42 shows the moveable abutment 974 has disengaged from the release abutment 965, allowing the claw 914 to drive the pawl 916 clockwise to the FIG. 43 position and to drive the crank shaft clockwise to the FIG. 43 position. Continued opening of the latch causes the claw 914 to rotate clockwise to the FIG. 44 position, whereupon the pin 935/937 has engaged and ridden up ramp surface 986, thereby rotating the link 980 in a clockwise direction about the pivot 981. Continued clockwise rotation of the claw 914 causes the pin 935/937 to move off the end of the ramp surface 986 and engage the hook surface 985, as shown in FIG. 45. In this position, the latch is open. However, it will be appreciated (by comparing the position of the reset/release lever 951/952 in FIGS. 41 and 45) that the crank shaft is not in its closed position i.e., the crank shaft has not been reset to its closed position.

However, upon closing of the latch, the crank shaft is reset prior to the closed abutment 934 passing under the pawl tooth 940 (and in this case also prior to the first safety abutment 933 passing under the pawl tooth 940) as follows.

Figure 46:
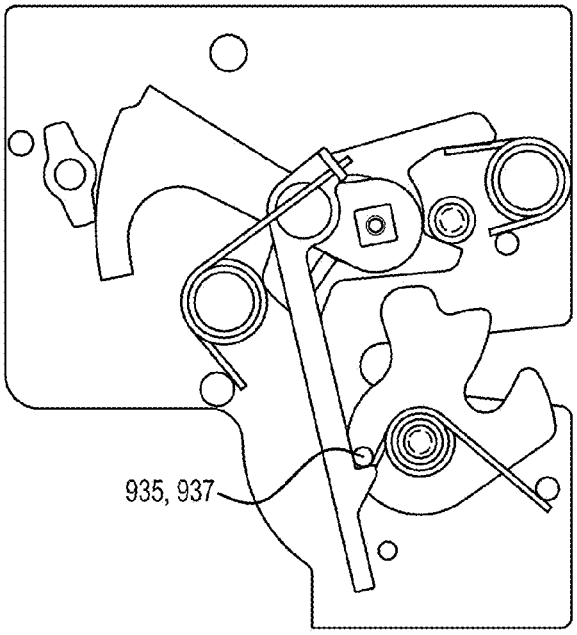

As shown in FIG. 46, the claw 914 has started to rotate in a counter-clockwise direction by virtue of engagement with the striker (not shown). This counter-clockwise rotation causes the pin 935/937 to move generally downwardly and, by virtue of engagement of the pin with the hook surface 985, cause the link 980 to move generally downwardly. The link 980 in turn causes the reset/release lever 951/952 to rotate in a counter-clockwise direction (contrast the position of the reset/release lever in FIG. 46 and FIG. 45). Continued closing of the latch causes the pin 935/937 to move to the FIG. 47 position and hence causes the release abutment 965 to move past the moveable abutment 974.

Figure 48:
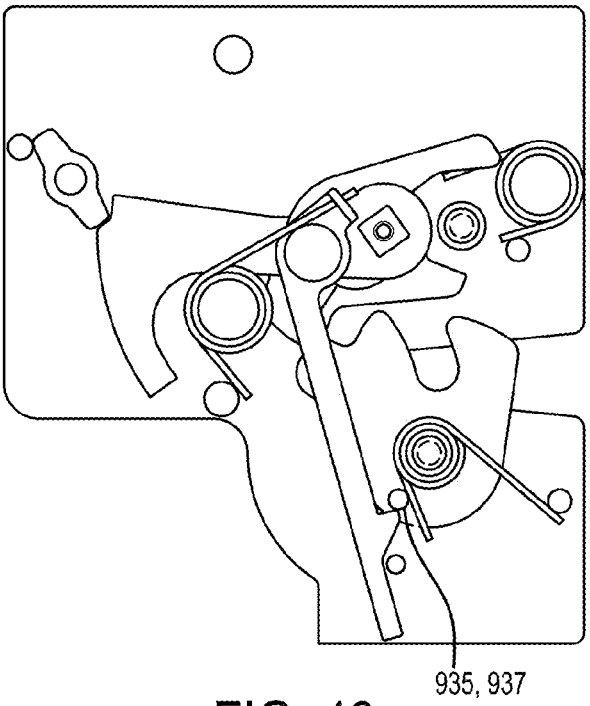
Figure 49:
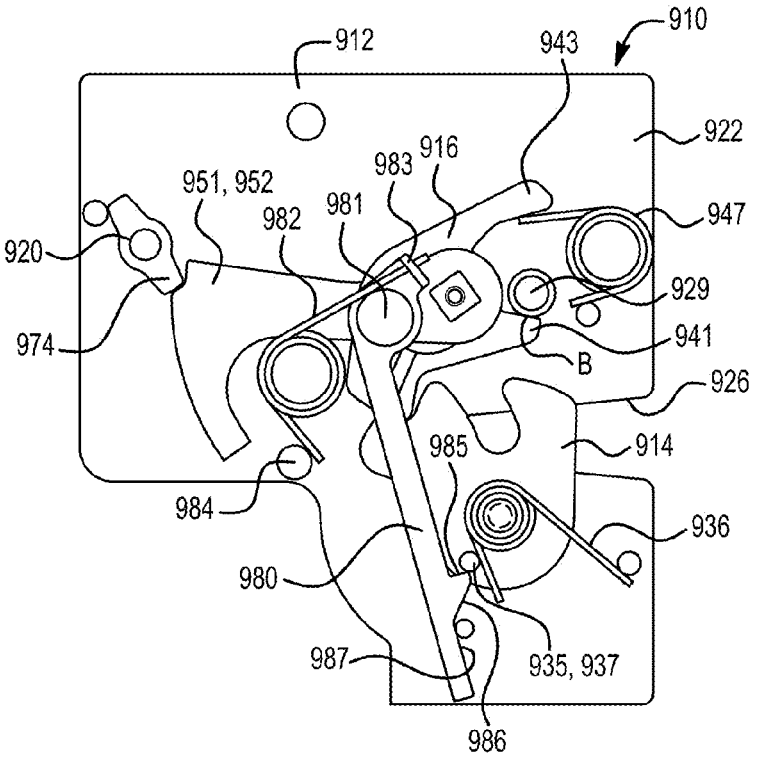

FIG. 48 shows the latch assembly in a reset position i.e., the release abutment 965 has being reengaged with the moveable abutment 974, and hence the crank shaft has been reset to its closed position (i.e., the position shown in FIG. 41). Note that this resetting of the crank shaft, while occurring during closing of the latch, nevertheless has occurred prior to the first safety abutment 933 passing underneath the pawl tooth 940. FIG. 49 shows the latch having being closed slightly further such that the pawl tooth 940 engages with the first safety abutment 33. In particular, it can be seen that the first arm 941 is now in engagement with the stop pin 929 at B.

Figure 47:
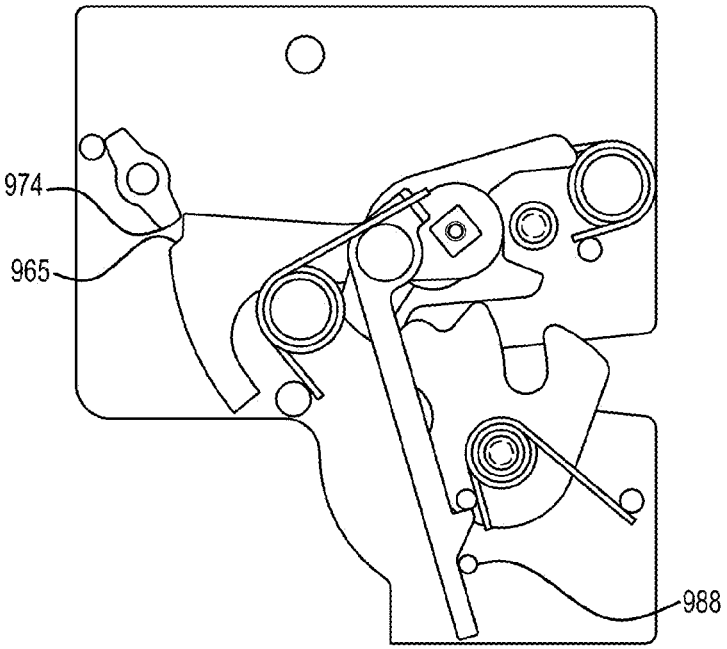
Figure 50:
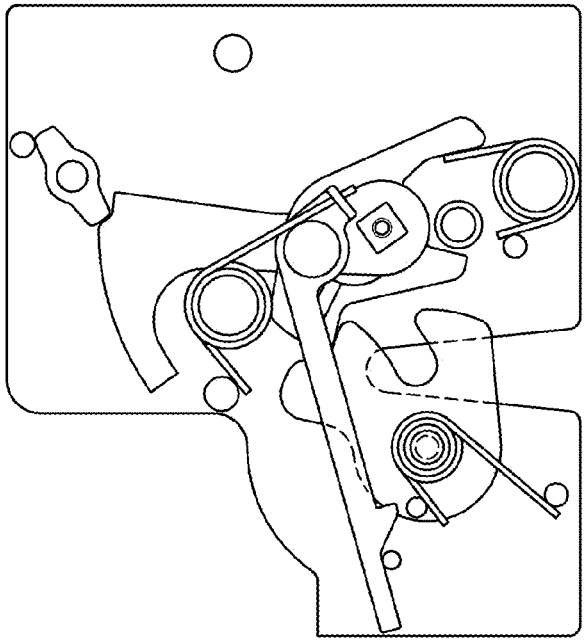
Figure 51:
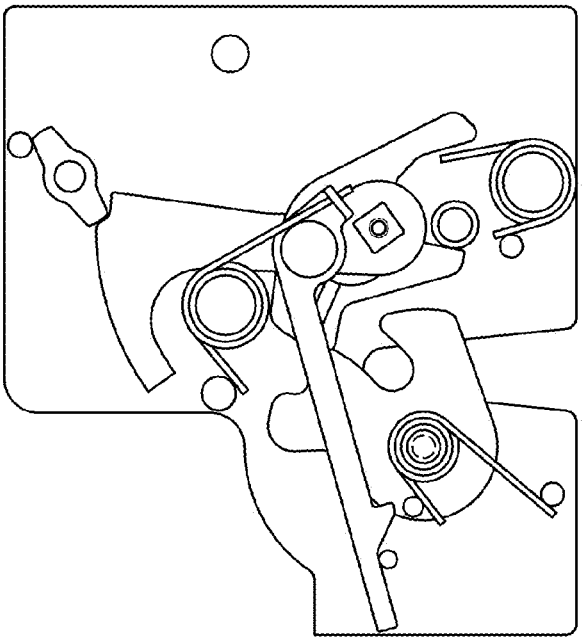

FIG. 50 shows the pawl tooth 940 riding up an edge of the claw 914, and FIG. 51 shows the pawl tooth 940 having fully reengaged with the closed abutment 934 and the stop pin 29. As such, the crank shaft is in its closed position as shown in FIG. 47. It will be seen from FIG. 47 that movement of the pin 935/937 about the claw axis has drawn the lower abutment surface 987 into engagement with the link stop pin 988. Thus continued closing of the latch causes the pin 935/937 to move generally in a rightwardly direction to disengage from the hook surface 985, since the link stop pin 988 prevents the lower end of the link 980 moving in the generally rightwardly direction. FIG. 49 shows the link stop 988 in engagement with the lower abutment surface 987, and hence the spring 982 acts to move the link 980 in a generally upwardly direction, thereby reengaging the release abutment 965 with the moveable abutment 974.

FIGS. 52 to 59 show a latch assembly 1010 in which components which fulfill substantially the same function as those of the latch assembly 10 are labelled 1000 greater. A spring (not shown, but similar to spring 936) biases the claw 1014 in a clockwise direction and acts upon the combined spring abutment/reset pin 1035/1037 and reacts on the pin 1090. A link 1080 is pivotally mounted at the pivot 1081 to the combined reset/release lever 1051/1052. The spring abutment/reset pin 1053/1037 is received within a guide slot 1082 of the link 1080.

In summary, the latch assembly 1010 includes a compression pawl 1016. The latch assembly is arranged such that the crank shaft is reset to its closed position upon opening of the latch. However, whereas the crank shaft assembly 18 and the associated pawl 16 both rotate in the same direction (in a clockwise direction when viewing FIG. 1) during opening of the latch, the crank shaft assembly 1018 rotates in an opposite direction to the pawl 1016 during initial opening of the latch. Thus, when considering the opening sequence of FIGS. 52, 53 and 54, the pawl 1016 is being rotated in a clockwise direction, whereas the same opening sequence figures show the combined reset/release lever 1051/1052, and hence the crank shaft assembly 1018 being rotated in a counter-clockwise direction. While FIGS. 55 and 56 show the last part of the opening sequence, they also show the resetting of the crank shaft assembly. Thus, FIGS. 52, 53 and 54 show the opening sequence prior to resetting, and it is during this sequence that the crank shaft and pawl 1016 are rotating in opposite directions.

Figure 52:
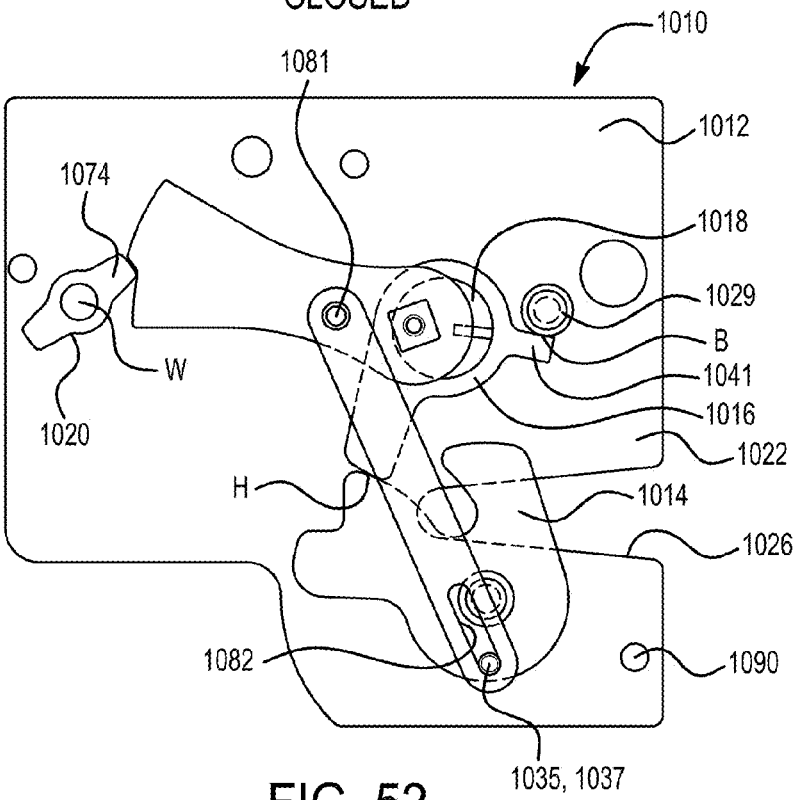
FIGS. 52 to 59 show a further embodiment of a latch assembly according to the present invention.
Figure 53:
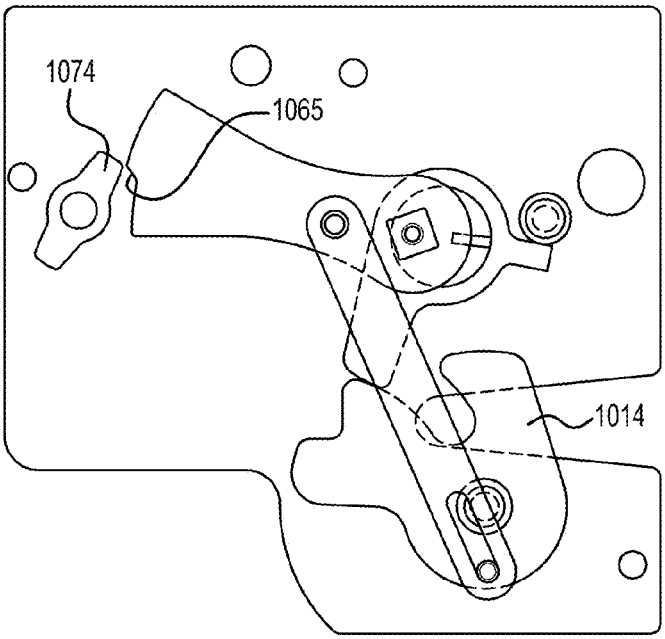

Thus, as shown in FIG. 52, the latch is in a closed position, with the claw 1014 being held there by the pawl 1016. The crank shaft is prevented from rotating in a counter-clockwise direction by engagement between the release abutment 1065 and the moveable abutment 1074. As shown in FIG. 53, the moveable abutment 1074 has been disengaged from the release abutment 1065, thereby allowing the crank shaft to start to rotate in a counter-clockwise direction, while the pawl 1016 starts to rotate in a clockwise direction, both being driven by the claw 1014.

Figure 54:
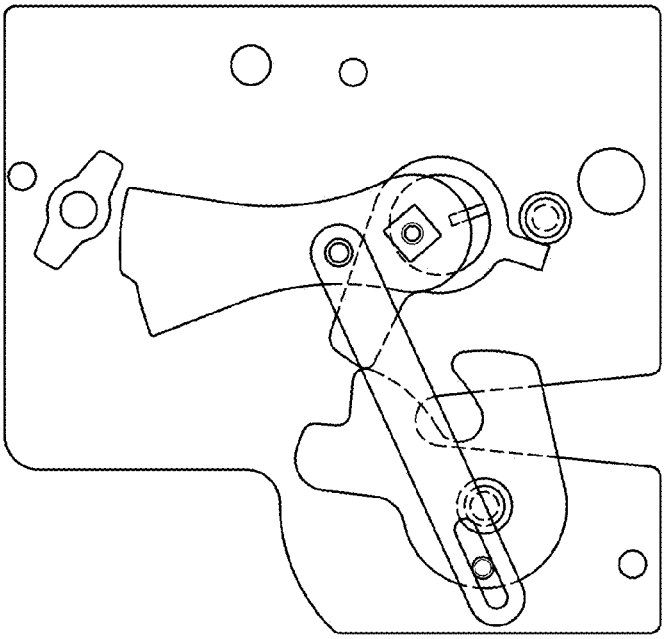
Figure 55:
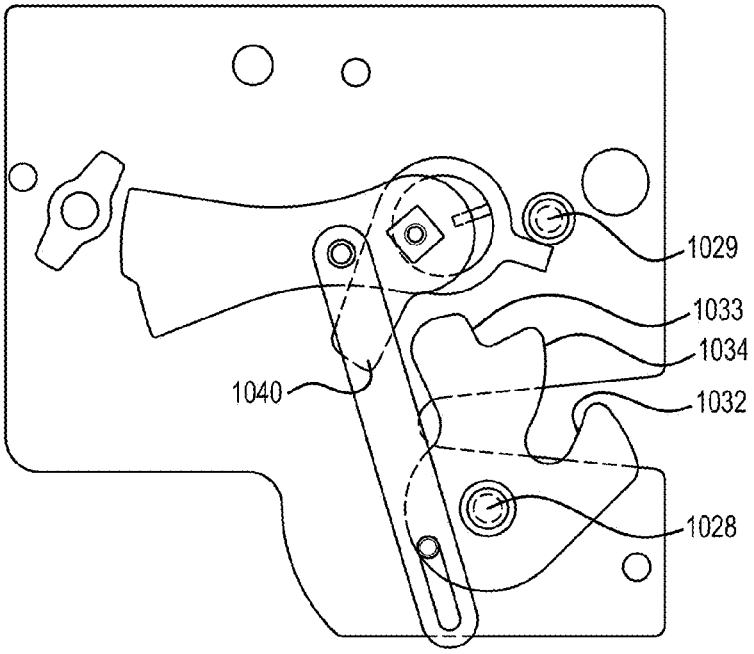
Figure 56:
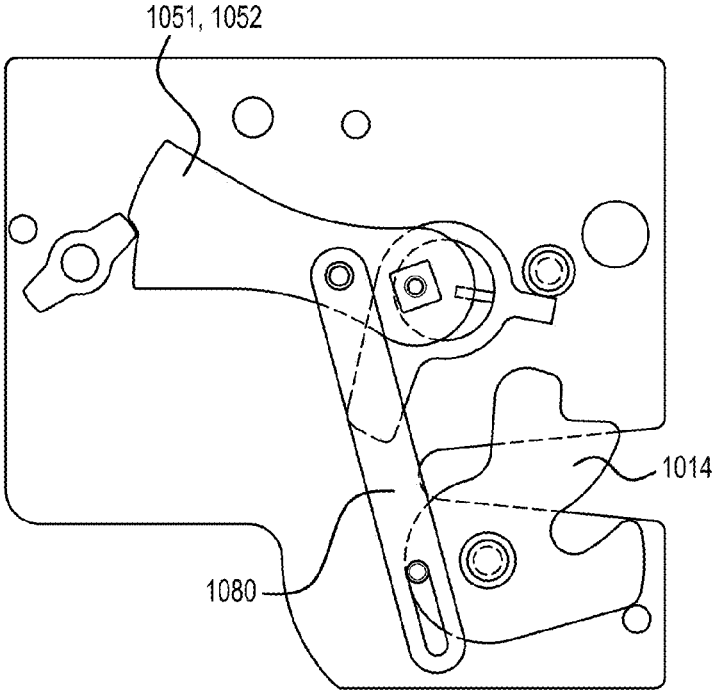
Figure 57:
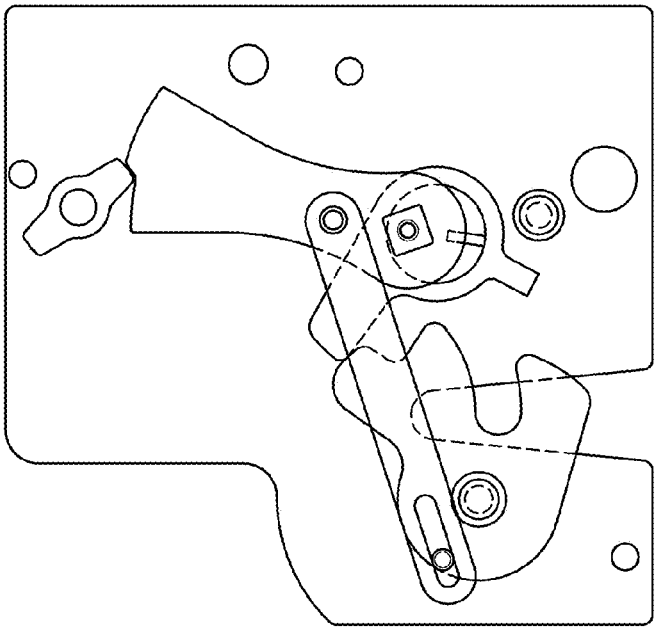
Figure 58:
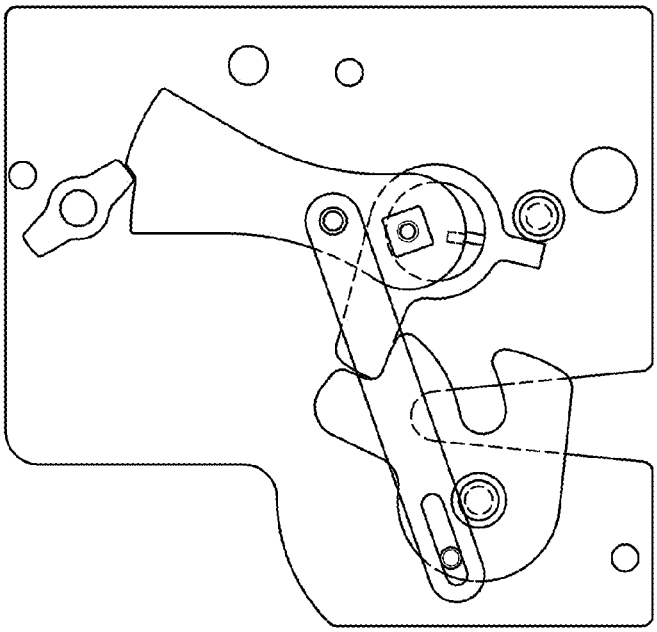
Figure 59:
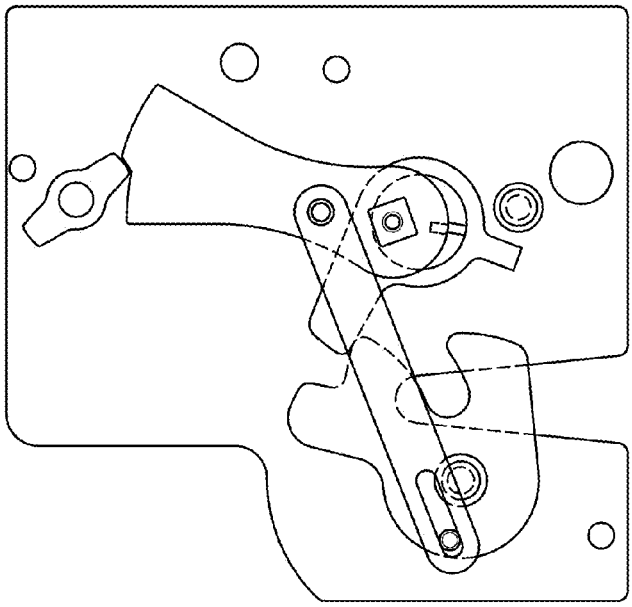

As shown in FIG. 54, the pawl tooth 1040 is about to clear the closed abutment, and as shown in FIG. 55, both the closed abutment and first safety abutment have passed under the pawl tooth 1040. It can also be seen from FIG. 55 that the spring abutment/reset pin 1035/1037 has moved to the upper end of guide slot 1082. Continued clockwise rotation of the claw 1014 causes the spring abutment/reset pin 1035/1037 to push the link 1080 generally upwardly, thereby rotating the combined reset/release lever 1051/1052, and hence the crank shaft clockwise to the closed position. The sequence of FIGS. 56, 57, 58, 59 and then 52 shows progressive closing of the latch.

Figure 60:
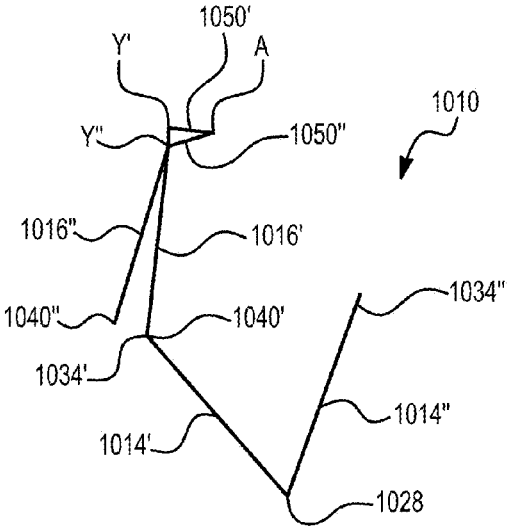
FIG. 60 shows a composite schematic view of FIGS. 52 and 55.

FIG. 60 is a schematic representation of certain components of the latch assembly 1010 showing both the closed position of FIG. 52 and the partially open, but prior to resetting of the crank shaft position of FIG. 55. Reference numbers having the superscript relate to components drawn in the closed FIG. 52 position whereas reference numbers having the superscript represent components drawn in the FIG. 55 position. The release abutment 1065 and the associated moveable abutment 1070 are not shown. Also, the point B (the point at which the stop pin 1029 and the arm 1041 engage) is not shown.

Clearly, the claw pivot pin 1028 and the crank shaft axis A are in the same position in both FIG. 52 and FIG. 55. In the closed position, the latch bolt 1014 is held in position by the pawl 1016', and hence the pawl tooth 1040' is shown in engagement with the closed abutment 1034'. In the partially open position of FIG. 55, the claw has rotated clockwise to the 1014" position, the pawl has been rotated clockwise to the 1016" position, and the crank shaft has been rotated counter-clockwise to the 1050" position.

Thus, FIG. 60 more clearly shows how the pawl 1060 of the latch assembly 1010 initially rotates in one direction (clockwise), whereas the crank shaft initially rotates in the other direction (counter-clockwise).

It should also be noted that the claw rotates in the same direction as the pawl and hence in an opposite direction to the crank shaft.

As previously mentioned, the pawl 1016 is a compression pawl and it is also possible to provide a tension pawl that initially rotates in one direction during opening while the associated crank shaft rotates in another direction. Such an embodiment is shown schematically in FIG. 61.

Figure 61:
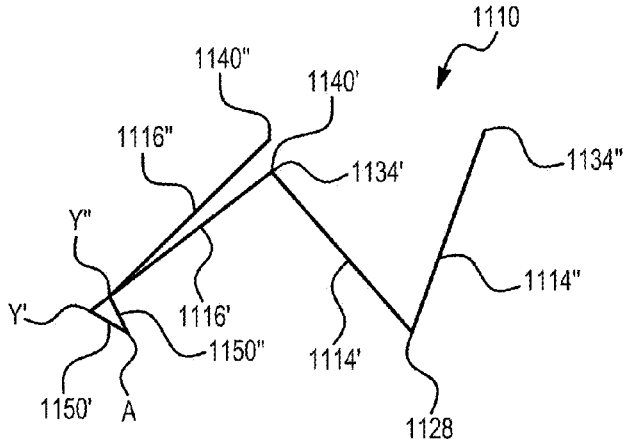
FIG. 61 shows a schematic composite view of a further embodiment of a latch assembly according to the present invention.

Thus, those components of the latch assembly 1110 that fulfill substantially the same function as those of the latch assembly 1010 are labelled 100 greater. A release abutment the equivalent of the release abutment 1065 and a moveable abutment, the equivalent of moveable abutment 1074 are not shown, but one skilled in the art would appreciate how such components would interact with the crank shaft 1150. Also a stop pin the equivalent of the stop pin 1029 and an arm the equivalent of arm 1041 is not shown in FIG. 61 and hence the point B is not shown. However, one skilled in the art would readily be able to ascertain where such components would be situated. FIG. 61 is a composite view showing components in a closed position and also in a position just prior to resetting of the crank shaft 1150. The resetting mechanism for the latch assembly 1110 is not shown, but could be any of the resetting mechanisms described in relation to the other embodiments of the present invention mentioned above or below. In particular, the resetting of the crank shaft could occur during opening of the latch or alternatively it could occur during closing of the latch. As mentioned above, the pawl 1116 is a tension pawl. The pawl 1116' and the claw 1114' are shown such that the pawl tooth 1140' is in engagement with the closed abutment 1134 when the latch is in the closed position. Upon release of the latch the claw rotates clockwise about claw pivot pin 1128 to the 1114" position, the pawl rotates counter-clockwise to the 1116" position, and the crank shaft rotates clockwise to the 1150" position.

It will be appreciated that during initial opening of the latch assembly 1110, the pawl 1116' rotates in one direction (counter-clockwise), whereas the crank shaft rotates in the other (clockwise) direction. In this case, the claw 1114' rotates in the same direction as the crank shaft and hence in an opposite direction to rotation to the pawl 1116'.

FIGS. 62 to 67 show a further embodiment of a latch assembly 1210 in which components which fulfill substantially the same function as those shown in the latch assembly 10 are labelled 1200 greater.

In this case, the pawl 1216 is a compression pawl, and the eccentric arrangement is in the form of a link arrangement 1218. The link arrangement 1218 includes the link 1250, which is pivotally mounted to the latch chassis 1212 at the pivot 1280. The pivot 1280 can take the form of a pin rotationally fast with the latch chassis 1212 about which the link 1250, can rotate. Alternatively, the pivot 1280 can take the form of a pin rotationally fast with the link 1250, with the pin being rotatable in a hole of the latch chassis 1212. Alternatively, the pivot 1280 can take the form of a pin freely rotatable in both the latch chassis 1212 and the link 1250. The pawl 1216 is pivotally mounted at the pivot 1281 to the link 1250. The pivot 1281 can take the form of a pin rotationally fast with the link 1250 and about which the pawl 1216 can pivot. Alternatively, the pivot 1281 can take the form of a pin rotationally fast with the pawl 1216 with the pin engaging a hole in the link such that the link can rotate relative to the pin.

Alternatively, the pivot 1281 can take the form of a pin which is freely rotatable relative to the pawl 1216 and the link 1250. A spring (not shown) biases the pawl in a counter-clockwise direction when viewing the figures and a stop (not shown) limits counter-clockwise rotation of the pawl relative to the link 1250.

Figure 62:
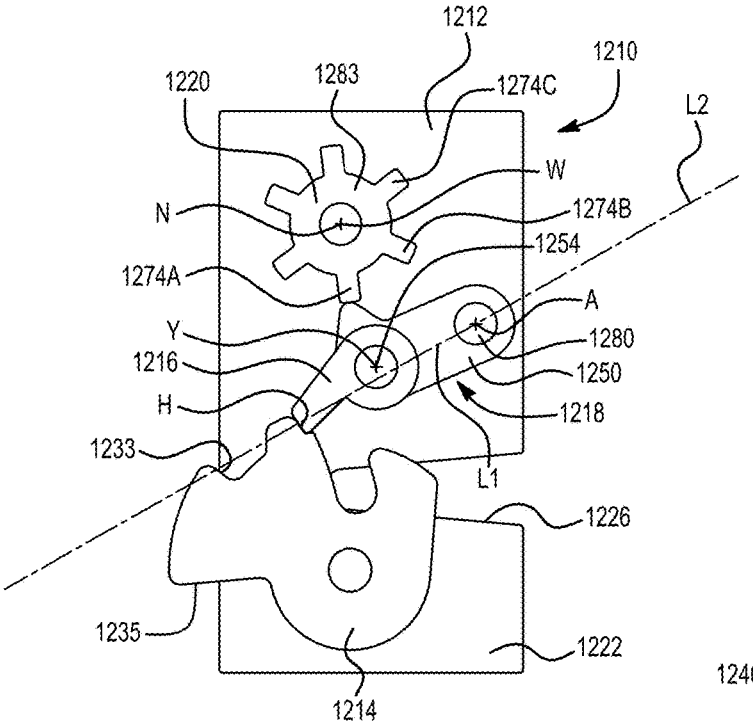
FIGS. 62, 62A, 62B, 63, 64, 65, 66 and 67 show a further embodiment of a latch assembly according to the present invention.
Figure 62A:
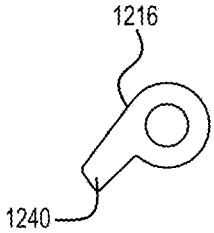

In this case, the moveable abutment 1274 includes 6 distinct moveable abutments 1274A, 1274B, 1274C, 1274D, 1274E and 1274F. The six movable abutments 1274A to 1274F are mounted on a wheel 1283, which is rotatably mounted about axis N. As shown in FIG. 62, it can be seen that axis Y lies above line LI drawn between the point of contact H between the pawl tooth and the claw and the axis A.

Operation of the latch assembly 1210 is as follows. FIG. 62 shows the latch assembly in a closed condition with the claw 1214 being retained by the pawl 1216. Rotation of the link 1250 is prevented by virtue of engagement between the release abutment 1265 and the moveable abutment 1274A.

Figure 63:
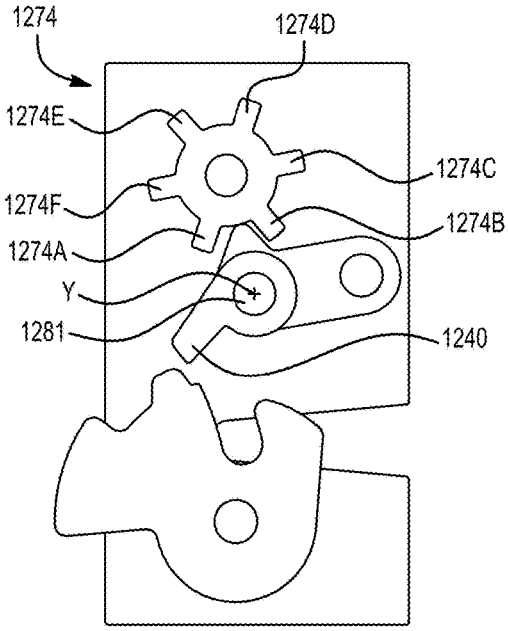
Figure 62B:
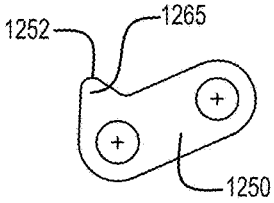

In order to open the latch, the wheel 1282 is rotated clockwise through approximately 30° by a power actuator (not shown), such as an electric motor, preferably a stepper motor. FIG. 63 shows the wheel having been rotated which then allows the claw to drive the link 1250 and the pawl 1260 to the position shown in FIG. 63. It can be seen that release abutment 1265 sits between moveable abutment 1274A and 1274B.

Figure 64:
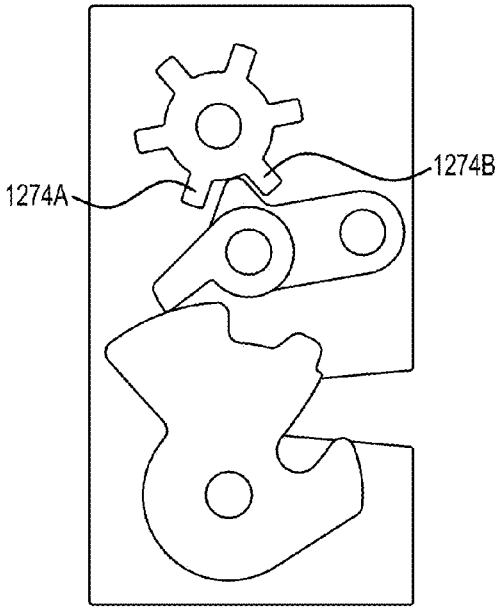
Figure 65:
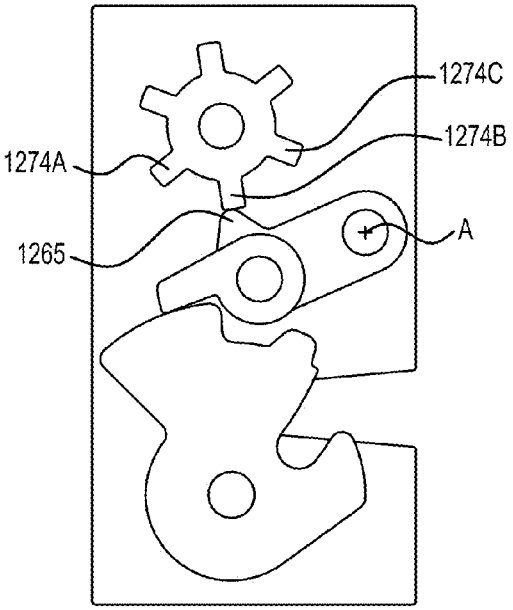

FIG. 64 shows the claw having rotated to an open position. FIG. 65 shows how the link is reset. Thus, wheel 1282 is rotated clockwise approximately 30° such that moveable abutment 1274B acts to drive the link 1250 in a counter-clockwise direction about axis A such that moveable abutment 1274B engages the release abutment 1265. The motor controlling rotation of the wheel 1282 is controlled by a suitable controller, which in turn will receive signals from sensors, typically limit switches, that indicate when the latch is in the open position shown at FIG. 64 so that the wheel can be rotated to the position shown in FIG. 65 ready for subsequent closing of the latch.

Figure 66:
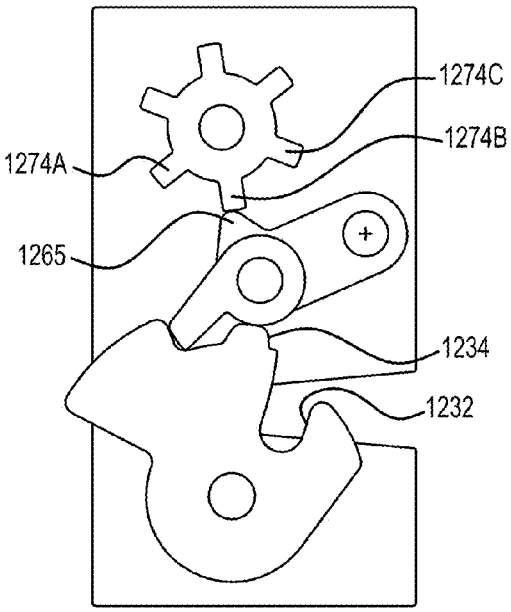
Figure 67:
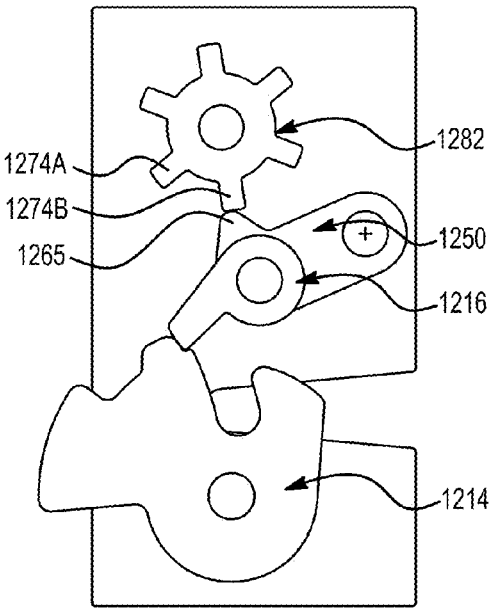

FIG. 66 shows the claw having been closed to a first safety position and continued counter-clockwise rotation of the claw will move the latch assembly to the FIG. 67 position. It will be appreciated that the FIG. 67 position differs from the FIG. 62 position only in as much as in FIG. 67 the moveable abutment 1274B is in engagement with the release abutment 1255, whereas in FIG. 62 it is moveable abutment 1274A that is in engagement with the release abutment 1265.

It will be appreciated that several different types of moveable abutment and associated release actuator assemblies have been described. Any of these moveable abutments and any of the release actuator assemblies could be used with any of the latch assemblies.

As will be appreciated, the release actuator assemblies 520 and 1220 also act to reset the eccentric arrangement. Where these release actuator assemblies are used with any of the other embodiments of latch assemblies, the associated resetting mechanism is no longer required.

The release arrangement 652, which primarily includes the lever 653, the link 654 and the lever 655 could be used with any of the other embodiments of the latch assembly.

The latch assemblies 10, 110, 210, 310, 410, 510, 610, 710, 910, 1010 and 1210 all include compression pawls. In these latch assemblies, the pawl must be rotated in one direction to disengage it from the claw. The claw then rotates in the same rotational direction to release the striker.

The latch assemblies 810 and 1110 include tension pawls. In these latches, the pawl is rotated in one direction to disengage it from the claw, and the claw then rotates in an opposite direction to release the striker.

During initial opening of the latch assemblies 10, 110, 210, 310, 410, 510, 610, 710, 810, 910 and 1210, the pawl rotates in the same direction as the eccentric arrangement.

During initial opening of the latch assemblies 1010 and 1110, the pawl rotates in an opposite direction to the eccentric arrangement.

The moveable abutments described are all rotated to disengage them from the associated release abutment. As such, they can be considered as a secondary pawl which hold the eccentric arrangement in its closed position, and the primary pawl (16, 116, 416, 716, 816, 916, 1016, 1116, 1216) acts to retain the associated latch bolt (rotating claw) in its closed position. The pivot axis of this secondary pawl is shown on the figures as W.

In further embodiments, the moveable abutment could move linearly rather than rotationally.

Consideration of FIG. 30 shows that the pawl is in contact with the claw in two places, namely at H and J. Furthermore, the drawing shows the arm 741 of the pawl 716 is in contact with the stop pin 729. In fact, due to a build up of tolerances, physical embodiments of the pawl would either contact the claw at J or the stop pin at B.

If we consider the scenario where the pawl contacts stop pin 29 at B, there will be a small gap between the pawl and claw at J. The forces acting on the pawl are FP (as a result of the door weather seal creating force FS) and also a force T generated by spring 747. The force T which creates a counter-clockwise turning moment on the pawl about axis Y. It will be appreciated, that in this scenario, where a small gap exists at J, the force T is reacted at B, whereas force FP is reacted by the crank pin 754.

If we consider the scenario where tolerances create a small gap at B and contact at J, then force T is reacted at J, and the force FP continues to be reacted by the crank pin 754. In this scenario, as soon as the latch starts to open the small gap at B will be closed thereby allowing the contact at B to act as a pivot point for the pawl as previously described.

Thus, whether there is a small gap at B or J when the latch is in the closed position due to tolerances is immaterial to the overall functioning of the latch.

Consideration of FIG. 1 shows contact between the pawl and claw at H and a small gap at J. There is also contact between the stop pin 29 and pawl at B, and further contact between the stop pin 30 and the pawl at K. Again, due to tolerances in a physical embodiment, while there will always be contact at H, the tolerance build up may create contact at K with a small gap at B and J, or alternatively contact at B with a small gap at K and J, or alternatively contact at J with a small gap at K and B. Whichever of these scenarios occurs in the physical embodiment, it does not effect the overall functioning of the latch assembly.

Consideration of FIG. 31 shows the pawl is in engagement with the claw at H and J and also shows that the pawl is in engagement with the stop pin 829 at B. Due to tolerance build ups in a physical embodiment, while the pawl and claw will always contact at H, there will either be contact at J with a small gap at B or contact at B with a small gap at J. Either scenario does not effect the functioning of the latch.

Consideration of FIG. 52 shows that the pawl contacts the stop pin 1020 at B and contacts the claw at H. The surface of the pawl at and adjacent H is formed as an arc centered on the pawl axis Y, and the claw surface lies generally parallel to the pawl surface in this region. As such, there is no lip on the claw to create a contact equivalent of J of FIG. 30. As such, whatever the tolerance build up of a physical embodiment of the latch assembly 1010, there will always be contact at H and there will always be contact at B.

Consideration of FIG. 30 shows that an end surface 794 of the pawl is arcuate (see dotted extension line 794A and is centered on the pawl axis Z (the equivalent of crank pin axis Y). Under these circumstances, the pawl to claw geometry is said to be neutral i.e., force FP acts through Z and hence does not create any turning moment on the pawl about axis Z.

In an alternative embodiment, the end surface 794 could be arcuate but centered at point Z1. The pawl to claw geometry would then be said to be positive and such geometry tends to make it harder to disengage the pawl from the claw.

In alternative embodiment, the end surface 794 could be arcuate and centered on point Z2. Under these circumstances, the pawl to claw geometry would then be said to be negative and such geometry makes it easier to disengage the pawl from the claw.

The present invention is applicable to pawl to claw geometry's that are neutral, positive and negative when the latch is in the closed position.

Figure 40:
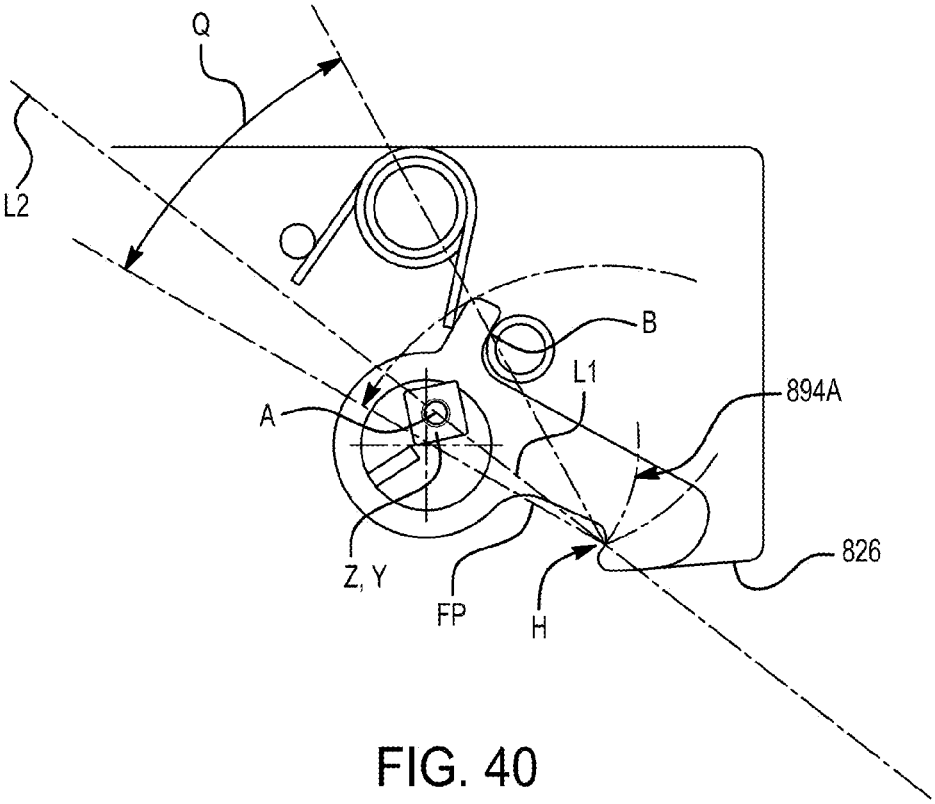

Consideration of FIG. 40 (which shows the pawl in the closed position) shows that the tension pawl 816 to the claw 814 geometry is also neutral since the end surface 894 (not labelled for clarity) and associated chain dotted extension 894A are arcuate and centered on the pawl axis Z (equivalent to the crank pin axis Y).

Returning to FIG. 30, as previously mentioned, the pawl to claw geometry is neutral. It should be emphasized that because the crank shaft cannot rotate, when considering whether the pawl to claw geometry is neutral, positive or negative, the point about which the pawl may rotate is definitive. In other words, since the crank shaft is fixed, the pawl can only rotate about the crank pin, i.e., can only rotate about axis Y, and since end surface 794 is centered on axis Y, the geometry is neutral.

However, consider the situation where the moveable abutment 774 has just disengaged from the release abutment 765, but no other components have yet moved (i.e., the situation shown in FIG. 22). Under these circumstances, the pawl to claw geometry instantaneously becomes negative. This is best seen in FIG. 30. With the crank shaft free to rotate, the instantaneous point of rotation of the pawl becomes the point B. Clearly, the center of the end surface 794 remains at axis Z. When considering a line drawn between H and B and Z lies above this line and hence the instantaneous pawl to claw geometry becomes negative.

The analogous scenario is that the point Z2 also lies above a line drawn between H and Z and in an embodiment where the end surface 794 was centered on Z2, the pawl to claw geometry would be negative (as discussed above).

Thus, at the instant the crank shaft is freed to rotate, the instantaneous center of rotation of the pawl moves from Z to B, and the pawl to claw geometry becomes significantly negative thereby making it easier to release the pawl. In fact, with the instantaneous center of rotation of the pawl at B, the pawl to claw geometry is so negative that the pawl automatically slips out of engagement from the claw as the claw is driven to the open position.

A line drawn between H and Z subtends an angle Q relative to a line drawn between H and B. In this case, Q is 34° and hence the instantaneous claw geometry can be said to be 34° negative. There will clearly be friction associated with the latch as it opens, and provided the instantaneous claw to pawl geometry is sufficiently negative, then this friction will be overcome. Typically, in modern latches using steel pawls, steel claws and steel pivot pins, the latch system friction is such that an instantaneous pawl to claw geometry of about 25° negative is required. Thus, in the present case there is a sufficient margin of negative geometry (−9°) to ensure that the latch will still open even after wear has occurred during use or dirt or corrosion has started to increase the system friction of the latch. In further embodiments, the instantaneous claw to pawl geometry could be 30° or more, or 35° or more, or 40° or more, upon disengagement of the moveable abutment from the release abutment.

As previously mentioned, FIG. 40 shows a pawl to claw geometry that is neutral when the crank shaft is fixed. The instant the crankshaft is freed to rotate, the pawl geometry becomes negative, in this case 30° negative (angle Q is 30°). Thus, the arrangement shown in FIG. 40 is such that the pawl will be driven open by the claw to release the striker and open the latch.

As shown in FIGS. 30 and 40, point B is located further from point H than point Z. However, in further embodiments, the point B could be closer to point H than point Z, and the pawl to claw geometry could still go from neutral to significantly negative when the crankshaft is freed.

In further embodiments, the pawl to claw geometry could be negative when the latch is fully closed and the crank shaft is fixed. Thus, the pawl to claw geometry could be between zero and 5 degrees negative or between 5 and 10 degrees negative. Under such circumstances, the instantaneous change in pawl to claw geometry as the crank shaft is released could be less. For example, starting with a pawl to claw geometry of 10° negative with the latch closed, upon release of the latch, the pawl to claw geometry could change to 30° negative (i.e., an overall change of 20° negative), and the latch would still open.

In further embodiments, the pawl to claw geometry with the latch closed and the crankshaft fixed could be positive, for example between 0° and 5° positive, or between 5° and 10° positive. Under these circumstances, a greater angle change of pawl to claw geometry is required when the crank shaft is released. For example, if with the latch closed and the crank shaft fixed the pawl to claw geometry is 5° positive, and with the crank shaft free to rotate, the instantaneous pawl to claw geometry changes to 30° negative, there will have been an overall change of 35° negative and the latch will still open automatically.

Consideration of FIGS. 62 to 67 shows that there is no instantaneous change in pawl geometry between the FIG. 62 position where the link arrangement 1218 is fixed and a position (not shown) where the wheel has rotated to the FIG. 63 position but the link arrangement 1218 and the pawl 1216 have not yet started to move. Nevertheless, by arranging a suitable pawl to claw geometry, the embodiments shown in FIG. 62 can be arranged to open automatically by virtue of the claw driving the pawl to the FIG. 63 position.

As mentioned above, when the vehicle door is closed, the weather seals of the door are in a compressed state and the striker generates a seal force FS on the mouth of the latch bolt. Force FS in turn generates a force FP. Once the crank shaft has been released (i.e., the moveable abutment has disengaged from the release abutment), the claw rotates to the open position and drives the pawl to a position whereby the closed abutment and the first safety abutment of the claw can pass underneath the pawl tooth.

The force FS acts on the claw in an opening direction. It will also be appreciated that springs 36, 436, 736, 836 and 936 also generate a force on the claw tending to rotate it in an opening direction. Equivalent claw springs (not shown) are provided on all the embodiments shown in the attached drawings to bias the claw in an opening direction when the latch is closed. All these claw biasing springs will typically be sufficiently powerful enough to move the claw from the closed position to the open position upon release of the eccentric arrangement even in the absence of a striker.

As previously mentioned, the spring 447 creates a counter-clockwise torque about point B during opening of the latch, thereby assisting in releasing the pawl tooth 440 from the claw and also creates a clockwise torque about point Y1 during closing of the latch, thereby ensuring the pawl tooth 440 re-engages the first safety abutment or the closed abutment as appropriate on the claw 414. Pawl springs can be arranged on the other embodiments of the present invention to assist in releasing the pawl tooth during opening of the latch and also to ensure the pawl tooth reengages first safety abutment and/or closed abutment during closing of the latch.

The foregoing description is only exemplary of the principles of the invention. Many modifications and variations are possible in light of the above teachings. It is, therefore, to be understood that within the scope of the appended claims, the invention may be practiced otherwise than using the example embodiments which have been specifically described. For that reason the following claims should be studied to determine the true scope and content of this invention.

What is claimed is:

1. A latch assembly having a chassis, a latch bolt, movably mounted on the chassis and having a closed position for retaining a striker and an open position for releasing the striker, a pawl having an engaged position at which the pawl is engaged with the latch bolt to hold the latch bolt in the closed position and a disengaged position at which the pawl is disengaged from the latch bolt thereby allowing the latch bolt to move to the open position, an eccentric arrangement defining an eccentric axis and a pawl axis remote from the eccentric axis, with the eccentric being rotatable about the eccentric axis and with the pawl being rotatable about the pawl axis, in which when the pawl moves from the engaged position to the disengaged position the eccentric arrangement rotates in one of a clockwise and anticlockwise direction about the eccentric axis and with the pawl in the engaged position a force applied to the pawl by the latch bolt creates a turning moment on the eccentric arrangement about the eccentric axis in said one of a clockwise and anticlockwise direction and the eccentric arrangement is prevented from rotating in said one of a clockwise and anticlockwise direction by a moveable abutment, in which with the pawl in the engaged position and the latch bolt in the closed position a point of contact between the pawl and the latch bolt is defined and a straight line is defined starting at said eccentric axis and ending at said point of contact between the pawl and the latch bolt, and the pawl axis defines a locus between the engaged and disengaged positions of the pawl, in which said locus does not cross said straight line.

2. A latch assembly as in claim 1 wherein the pawl rotates in said one of clockwise and anticlockwise direction when moving from the engaged position to the disengaged position.

3. A latch assembly as in claim 1, wherein the pawl rotates in another of said clockwise and anticlockwise directions when moving from the engaged position to the disengaged position.

4. A latch assembly as in claim 1, wherein the moveable abutment is pivotable.

5. A latch assembly as in claim 1, wherein the moveable abutment is actuable by a powered release actuator, such as an electromagnet or a motor drivingly coupled to a pinion gear which engages a pivotable gear segment forming part of the moveable abutment, or a solenoid having a solenoid core to which is attached the moveable abutment and which core is arranged to rotate, or wherein the moveable abutment comprises two or more distinct moveable abutments mounted on a wheel which is rotationally moveable by a motor.

6. A latch assembly as defined in claim 5 in which the powered release actuator also acts to return the eccentric arrangement to a closed position.

7. A latch assembly as defined in claim 1, wherein the moveable abutment is manually actuable.

8. A latch assembly defined in claim 1, wherein which with the latch in the closed condition a release abutment of the eccentric arrangement engages the moveable abutment to prevent the eccentric arrangement moving in said one of a clockwise and anticlockwise direction.

9. A latch assembly as defined in claim 8 in which the release abutment is defined on a release lever of the eccentric arrangement.

10. A latch assembly as defined in claim 7 in which the movable abutment is defined a release arrangement having a first lever rotationally fast with the eccentric arrangement and a second lever pivotally mounted on the latch chassis and including a release abutment with the first and second levers being operably coupled by a link pivotally mounted at one end to the first lever and pivotally mounted at another end to the second lever.

11. A latch arrangement as in claim 1, wherein in which the eccentric arrangement includes a crankshaft having a crank pin, the crankshaft having a crankshaft axis defining the eccentric axis and the crank pin having a crank pin axis defining the pawl axis.

12. A latch assembly as defined in any claim 11 in which the crank shaft is supporting in a bearing on a first side of the crank pin and is supported in a bearing on a second side of the crank pin.

13. A latch assembly as defined in claim 12 in which the crank shaft has a crank shaft radius and the crank pin has a crank pin radius and the crank pin axis is offset from the crank shaft axis by less than the crank pin radius plus the crank shaft radius.

14. A latch assembly as defined in claim 13 in which the crank pin axis is offset from the crank shaft axis by less than the crank pin radius, or the crank pin axis is offset from the crank shaft axis by less than the crank pin radius minus the crank shaft radius.

15. A latch assembly as defined in claim 1 wherein the eccentric arrangement includes a link having a first end defining the eccentric axis and a second end defining the pawl axis.

16. A latch assembly as defined in claim 1 in which the latch has a closed condition wherein:

the latch bolt is in the closed position, the pawl is in the engaged position, and the pawl axis is in a first position, and the latch has an open condition wherein:

the claw is in the open position the pawl is in the disengaged position and the pawl axis is substantially in said first position.

17. A latch assembly as defined in claim 16 in which during movement of the latch bolt from the closed position to the open position the eccentric arrangement rotates in said one of a clockwise and anticlockwise direction such that the pawl axis moves to a second position and the latch bolt rotates the eccentric arrangement in the other of said clockwise and anticlockwise direction such that the pawl axis is substantially returned to the first position.

18. A latch assembly as defined in claim 1 in which the latch has a closed condition wherein:

the latch bolt is in the closed position, the pawl is in the engaged position, and the pawl axis is in the first position, the latch has an open condition wherein:

the latch bolt is in the open position, the pawl is in the disengaged position, and the pawl axis is in a second position, and the latch has a reset condition wherein:

the latch bolt is partially closed, the pawl is in the disengaged position, and the pawl axis is in said first position.

19. A latch assembly having a chassis, a latch bolt, movably mounted on the chassis and having a closed position for retaining a striker and an open position for releasing the striker, a compression pawl having an engaged position at which the compression pawl is engaged with the latch bolt to hold the latch bolt in the closed position and a disengaged position at which the compression pawl is disengaged from the latch bolt thereby allowing the latch bolt to move to the open position, an eccentric arrangement defining an eccentric axis and a pawl axis spaced from the eccentric axis by a first distance, with the eccentric being rotatable about the eccentric axis and with the pawl being rotatable about the pawl axis, in which with the pawl in the engaged position and the latch bolt in the closed position a point of contact between the pawl and the latch bolt is spaced from the eccentric axis by a second distance which is greater than the first distance and a straight line is defined starting at said eccentric axis and ending at said point of contact between the pawl and the latch bolt, and the pawl axis defines a locus between the engaged and disengaged positions of the pawl, in which said locus does not cross said straight line.

20. A latch assembly having a chassis, a latch bolt, movably mounted on the chassis and having a closed position for retaining a striker and an open position for releasing the striker, a tension pawl having an engaged position at which the tension pawl is engaged with the latch bolt to hold the latch bolt in the closed position and a disengaged position at which the tension pawl is disengaged from the latch bolt thereby allowing the latch bolt to move to the open position, an eccentric arrangement defining an eccentric axis and a pawl axis spaced from the eccentric axis by a first distance, with the eccentric being rotatable about the eccentric axis and with the pawl being rotatable about the pawl axis, in which with the pawl in the engaged position and the latch bolt in the closed position a point of contact between the pawl and the claw is spaced from the eccentric axis by a second distance which is less than the first distance and a straight line is defined starting at the eccentric axis and ending at the point of contact between the pawl and the latch bolt, and the pawl axis defines a locus between the engaged and disengaged positions of the pawl, in which said locus does not cross said straight line.

* * * * *